US007318320B2

(12) United States Patent
Yabu et al.

(10) Patent No.: US 7,318,320 B2
(45) Date of Patent: Jan. 15, 2008

(54) HUMIDITY CONTROL APPARATUS

(75) Inventors: Tomohiro Yabu, Osaka (JP); Guannan Xi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 311 days.

(21) Appl. No.: 10/503,211

(22) PCT Filed: Jan. 30, 2003

(86) PCT No.: PCT/JP03/00944

§ 371 (c)(1),
(2), (4) Date: Mar. 14, 2005

(87) PCT Pub. No.: WO03/067160

PCT Pub. Date: Aug. 14, 2003

(65) Prior Publication Data

US 2005/0150237 A1 Jul. 14, 2005

(30) Foreign Application Priority Data

Feb. 4, 2002 (JP) ..... 2002-026268
Apr. 17, 2002 (JP) ..... 2002-114825

(51) Int. Cl.
*F25D 17/06* (2006.01)

(52) U.S. Cl. ..... 62/94

(58) Field of Classification Search ..... 62/94, 62/173, 176.1, 146; 96/146
See application file for complete search history.

(56) References Cited

U.S. PATENT DOCUMENTS 5,791,153 A * 8/1998 Belding et al. ..... 62/93
5,860,284 A * 1/1999 Goland et al. ..... 62/94
6,199,388 B1 * 3/2001 Fischer, Jr. ..... 62/90

FOREIGN PATENT DOCUMENTS

| | | | |
|---|---|---|---|
| JP | 5-200238 | A | 8/1993 |
| JP | 09-196483 | A | 7/1997 |
| JP | 09-329371 | A | 12/1997 |
| JP | 10-026369 | A | 1/1998 |
| JP | 2000-065395 | A | 3/2000 |
| JP | 2000-257968 | A | 9/2000 |
| JP | 2000-329375 | A | 11/2000 |
| JP | 2000-337657 | A | 12/2000 |
| JP | 2000-346396 | A | 12/2000 |
| JP | 2001-074275 | A | 3/2001 |
| JP | 2001-263732 | A | 9/2001 |

* cited by examiner

*Primary Examiner*—Melvin Jones
(74) *Attorney, Agent, or Firm*—Birch, Stewart, Kolasch & Birch, LLP

(57) ABSTRACT

A humidity control apparatus includes two adsorbing elements (81, 82), and performs a batch-type operation. The humidity control apparatus includes a refrigerant circuit (100). A second air for regenerating the adsorbing element (81, 82) is heated through a regenerative heat exchanger (102) of the refrigerant circuit (100). The refrigerant circuit (100) includes a first heat exchanger (103) and a second heat exchanger (104). In a dehumidification mode, the first heat exchanger (103) serves as an evaporator, and the first air to be supplied exchanges heat with the refrigerant. At this point, the second heat exchanger (104) is inactive. In a dehumidification mode, the second heat exchanger (104) serves as an evaporator, and the first air to be discharged exchanges heat with the refrigerant. At this point, the first heat exchanger (103) is inactive.

25 Claims, 29 Drawing Sheets

HUMIDITY CONTROL APPARATUS

TECHNICAL FIELD

The present invention relates to a humidity control apparatus for controlling the humidity of the air.

BACKGROUND ART

A humidity control apparatus using a so-called "desiccant rotor" and a heat pump in combination with each other has been known in the art, as disclosed in Japanese Laid-Open Patent Publication No. 9-329371. In such a humidity control apparatus, the condenser of the heat pump is provided along the air passageway for regeneration, and the evaporator of the heat pump is provided along the supply air passageway for supplying the air into the room. The humidity control apparatus performs an operation of dehumidifying the supply air for ventilation through the desiccant rotor and supplying the air into the room while regenerating the desiccant rotor with the discharge air for ventilation.

Specifically, the outside air is taken into the humidity control apparatus as the supply air for ventilation. The outside air is dehumidified through the desiccant rotor and then flows into the supply air passageway. Then, the air is cooled by heat exchange with the refrigerant through the evaporator, and then supplied into the room. Moreover, the room air is taken into the humidity control apparatus as the discharge air for ventilation. The room air is heated by heat exchange with the refrigerant through the condenser while flowing along the air passageway for regeneration. Then, the air is used for the regeneration of the desiccant rotor, after which it is discharged to the outside.

Problems to be Solved

However, the conventional humidity control apparatus described above has a configuration that is made only in view of the dehumidification mode for dehumidifying the air to be supplied into the room, and cannot provide a sufficient capacity when it is used in the humidification mode for humidifying the air to be supplied into the room.

In order to perform a humidification mode operation, it is necessary that an air humidified with the moisture desorbed from the desiccant rotor is passed into the supply air passageway. In the humidity control apparatus, however, the evaporator of the heat pump is provided along the supply air passageway. Therefore, the humidified supply air is cooled through the evaporator, where a portion of the moisture contained in the air is condensed. Thus, with the humidity control apparatus, the moisture contained in the supply air is reduced as the supply air passes through the evaporator, failing to provide a sufficient humidification capacity.

The present invention has been made in view of the above, and has an object to provide a humidity control apparatus having a refrigerant circuit with which it is possible to obtain a sufficient humidification capacity.

DISCLOSURE OF THE INVENTION

A first solution of the present invention is a humidity control apparatus, including an adsorbing element (81, 82) including an adsorbent for bringing the adsorbent into contact with an air, and a refrigerant circuit (100) including a refrigerant circulating therethrough to perform a refrigerating cycle, wherein: the humidity control apparatus performs an adsorption operation of adsorbing moisture in a first air onto the adsorbing element (81, 82) and a regeneration operation of regenerating the adsorbing element (81, 82) with a second air heated by the refrigerant in the refrigerant circuit (100), and one of the first air and the second air having passed through the adsorbing element (81, 82) is supplied into a room while the other is discharged to an outside. The refrigerant circuit (100) includes a regenerative heat exchanger (102) for heat exchange between the second air to be supplied to the adsorbing element (81, 82) and the refrigerant, a first heat exchanger (103) for heat exchange between the air to be supplied into the room and the refrigerant, and a second heat exchanger (104) for heat exchange between the air to be discharged to the outside and the refrigerant, and the regenerative heat exchanger (102) serves as a condenser while at least one of the first heat exchanger (103) and the second heat exchanger (104) serves as an evaporator.

A second solution of the present invention is based on the first solution, wherein the refrigerant circuit (100) can perform an operation in which one of the first heat exchanger (103) and the second heat exchanger (104) serves as an evaporator while the other is inactive.

A third solution of the present invention is based on the first solution, wherein the refrigerant circuit (100) can perform an operation in which one of the first heat exchanger (103) and the second heat exchanger (104) serves as an evaporator while the other is inactive, and an operation in which the first heat exchanger (103) and the second heat exchanger (104) both serve as an evaporator.

A fourth solution of the present invention is based on the first solution, wherein the refrigerant circuit (100) can perform an operation in which one of the first heat exchanger (103) and the second heat exchanger (104) serves as an evaporator while the other is inactive, an operation in which the first heat exchanger (103) and the second heat exchanger (104) both serve as an evaporator, and an operation in which one of the first heat exchanger (103) and the second heat exchanger (104) serves as an evaporator while the other serves as a condenser or a subcooler.

A fifth solution of the present invention is based on the first solution, wherein the refrigerant circuit (100) can perform an operation in which the first heat exchanger (103) and the second heat exchanger (104) both serve as an evaporator, and an operation in which one of the first heat exchanger (103) and the second heat exchanger (104) serves as an evaporator while the other serves as a condenser or a subcooler.

A sixth solution of the present invention is based on the second, third, fourth or fifth solution, wherein the humidity control apparatus can perform an operation in which the first heat exchanger (103) of the refrigerant circuit (100) serves as an evaporator when supplying the first air into the room while discharging the second air to the outside, and an operation in which the second heat exchanger (104) of the refrigerant circuit (100) serves as an evaporator when supplying the second air into the room while discharging the first air to the outside.

A seventh solution of the present invention is a humidity control apparatus, including an adsorbing element (81, 82) including an adsorbent for bringing the adsorbent into contact with an air, and a refrigerant circuit (100) including a refrigerant circulating therethrough to perform a refrigerating cycle, wherein: the humidity control apparatus performs an adsorption operation of adsorbing moisture in a first air onto the adsorbing element (81, 82) and a regeneration operation of regenerating the adsorbing element (81, 82) with a second air heated by the refrigerant in the refrigerant circuit (100), and the humidity control apparatus can perform a humidification operation in which the second air, selected from among the first air and the second air having passed through the adsorbing element (81, 82), is supplied into a room while the first air is discharged to an outside. The refrigerant circuit (100) includes a regenerative heat exchanger (102) for heat exchange between the second air to be supplied to the adsorbing element (81, 82) and the refrigerant, thus serving as a condenser, and an discharge-side heat exchanger (104) for heat exchange between the air to be discharged to the outside with the refrigerant, thus serving as an evaporator in the humidification mode.

An eighth solution of the present invention is based on the seventh solution, wherein: the humidity control apparatus can perform a dehumidification operation in which the first air, selected from among the first air and the second air having passed through the adsorbing element (81, 82), is supplied into the room while the second air is discharged to the outside; the refrigerant circuit (100) includes a first heat exchanger (103) for heat exchange between the air to be supplied into the room and the refrigerant, thus serving as an evaporator in the dehumidification mode; and the discharge-side heat exchanger (104) of the refrigerant circuit (100) forms a second heat exchanger (104).

A ninth solution of the present invention is based on the eighth solution, wherein the refrigerant circuit (100) can perform an operation in which one of the first heat exchanger (103) and the second heat exchanger (104) serves as an evaporator while the other is inactive.

A tenth solution of the present invention is based on the eighth solution, wherein the refrigerant circuit (100) can perform an operation in which one of the first heat exchanger (103) and the second heat exchanger (104) serves as an evaporator while the other is inactive, and an operation in which the first heat exchanger (103) and the second heat exchanger (104) both serve as an evaporator.

An eleventh solution of the present invention is based on the eighth solution, wherein the refrigerant circuit (100) can perform an operation in which one of the first heat exchanger (103) and the second heat exchanger (104) serves as an evaporator while the other is inactive, an operation in which the first heat exchanger (103) and the second heat exchanger (104) both serve as an evaporator, and an operation in which one of the first heat exchanger (103) and the second heat exchanger (104) serves as an evaporator while the other serves as a condenser or a subcooler.

A twelfth solution of the present invention is based on the eighth solution, wherein the refrigerant circuit (100) can perform an operation in which the first heat exchanger (103) and the second heat exchanger (104) both serve as an evaporator, and an operation in which one of the first heat exchanger (103) and the second heat exchanger (104) serves as an evaporator while the other serves as a condenser or a subcooler.

A thirteenth solution of the present invention is based on the third, fourth or fifth solution, wherein the humidity control apparatus can perform an operation in which the first heat exchanger (103) and the second heat exchanger (104) of the refrigerant circuit (100) each serve as an evaporator when supplying the first air into the room while discharging the second air to the outside.

A fourteenth solution of the present invention is based on the tenth, eleventh or twelfth solution, wherein the humidity control apparatus can perform an operation in which the first heat exchanger (103) and the second heat exchanger (104) of the refrigerant circuit (100) each serve as an evaporator when supplying the first air into the room while discharging the second air to the outside.

A fifteenth solution of the present invention is based on the third, fourth or fifth solution, wherein the humidity control apparatus can perform an operation in which the first heat exchanger (103) and the second heat exchanger (104) of the refrigerant circuit (100) each serve as an evaporator when supplying the second air into the room while discharging the first air to the outside.

A sixteenth solution of the present invention is based on the tenth, eleventh or twelfth solution, wherein the humidity control apparatus can perform an operation in which the first heat exchanger (103) and the second heat exchanger (104) of the refrigerant circuit (100) each serve as an evaporator when supplying the second air into the room while discharging the first air to the outside.

A seventeenth solution of the present invention is based on the fourth or fifth solution, wherein the humidity control apparatus can perform an operation in which the first heat exchanger (103) of the refrigerant circuit (100) serves as an evaporator while the second heat exchanger (104) serves as a condenser or a subcooler when supplying the first air into the room while discharging the second air to the outside.

An eighteenth solution of the present invention is based on the eleventh or twelfth solution, wherein the humidity control apparatus can perform an operation in which the first heat exchanger (103) of the refrigerant circuit (100) serves as an evaporator while the second heat exchanger (104) serves as a condenser or a subcooler when supplying the first air into the room while discharging the second air to the outside.

A nineteenth solution of the present invention is based on the fourth or fifth solution, wherein the humidity control apparatus can perform an operation in which the first heat exchanger (103) of the refrigerant circuit (100) serves as a condenser or a subcooler while the second heat exchanger (104) serves as an evaporator when supplying the second air into the room while discharging the first air to the outside.

A twentieth solution of the present invention is based on the eleventh or twelfth solution, wherein the humidity control apparatus can perform an operation in which the first heat exchanger (103) of the refrigerant circuit (100) serves as a condenser or a subcooler while the second heat exchanger (104) serves as an evaporator when supplying the second air into the room while discharging the first air to the outside.

A twenty-first solution of the present invention is based on the third, fourth or fifth solution, wherein in an operating mode in which the first heat exchanger (103) and the second heat exchanger (104) both serve as an evaporator, the refrigerant circuit (100) can perform an operation in which the first heat exchanger (103) and the second heat exchanger (104) are connected in series with each other while heat is exchanged between the refrigerant and an air by using only a portion of one of the first heat exchanger (103) and the second heat exchanger (104) that is located downstream of the other.

A twenty-second solution of the present invention is based on the tenth, eleventh or twelfth solution, wherein in an operating mode in which the first heat exchanger (103) and the second heat exchanger (104) both serve as an evaporator, the refrigerant circuit (100) can perform an operation in which the first heat exchanger (103) and the second heat exchanger (104) are connected in series with each other while heat is exchanged between the refrigerant and an air by using only a portion of one of the first heat exchanger (103) and the second heat exchanger (104) that is located downstream of the other.

A twenty-third solution of the present invention is based on the third, fourth or fifth solution, wherein in an operating mode in which the first heat exchanger (103) and the second heat exchanger (104) both serve as an evaporator, the refrigerant circuit (100) can perform an operation in which the first heat exchanger (103) and the second heat exchanger (104) are connected in series with each other while only a portion of the refrigerant from one of the first heat exchanger (103) and the second heat exchanger (104) that is located upstream of the other is supplied to one of the heat exchangers (103, 104) that is located downstream of the other.

A twenty-fourth solution of the present invention is based on the tenth, eleventh or twelfth solution, wherein in an operating mode in which the first heat exchanger (103) and the second heat exchanger (104) both serve as an evaporator, the refrigerant circuit (100) can perform an operation in which the first heat exchanger (103) and the second heat exchanger (104) are connected in series with each other while only a portion of the refrigerant from one of the first heat exchanger (103) and the second heat exchanger (104) that is located upstream of the other is supplied to one of the heat exchangers (103, 104) that is located downstream of the other.

A twenty-fifth solution of the present invention is based on the first solution, wherein the humidity control apparatus can perform an operation in which an outside air is taken in as the second air and passed to the regenerative heat exchanger (102) while a room air is taken in as the first air and passed to the adsorbing element (81, 82) when supplying the second air into the room while discharging the first air to the outside.

A twenty-sixth solution of the present invention is based on the seventh or eighth solution, wherein the humidity control apparatus can perform an operation in which an outside air is taken in as the second air and passed to the regenerative heat exchanger (102) while a room air is taken in as the first air and passed to the adsorbing element (81, 82) when supplying the second air into the room while discharging the first air to the outside.

A twenty-seventh solution of the present invention is based on the first solution, wherein the humidity control apparatus can perform an operation in which an outside air is taken in as the first air and passed to the adsorbing element (81, 82) while a room air is taken in as the second air and passed to the regenerative heat exchanger (102) when supplying the first air into the room while discharging the second air to the outside.

A twenty-eighth solution of the present invention is based on the eighth solution, wherein the humidity control apparatus can perform an operation in which an outside air is taken in as the first air and passed to the adsorbing element (81, 82) while a room air is taken in as the second air and passed to the regenerative heat exchanger (102) when supplying the first air into the room while discharging the second air to the outside.

Functions

According to the first solution, the humidity control apparatus performs an adsorption operation and a regeneration operation. In the adsorbing element (81, 82) during the adsorption operation, the first air is brought into contact with the adsorbent, whereby water vapor in the first air is adsorbed onto the adsorbent. In the adsorbing element (81, 82) during the regeneration operation, the heated second air is brought into contact with the adsorbent, whereby water vapor is desorbed from the adsorbent. Thus, the adsorbing element (81, 82) is regenerated. The water vapor desorbed from the adsorbent is given to the second air.

The humidity control apparatus of this solution supplies one of the first air and the second air from the adsorbing element (81, 82) into the room while discharging the other to the outside. Thus, where the first air dehumidified through the adsorbing element (81, 82) is supplied into the room, the second air having been used for the regeneration of the adsorbing element (81, 82) is discharged to the outside. Where the second air humidified through the adsorbing element (81, 82) is supplied into the room, the first air deprived of its moisture through the adsorbing element (81, 82) is discharged to the outside.

The refrigerant circuit (100) of the humidity control apparatus includes the regenerative heat exchanger (102), the first heat exchanger (103) and the second heat exchanger (104). In the refrigerant circuit (100), the regenerative heat exchanger (102) always serves as a condenser, and at least one of the first heat exchanger (103) and the second heat exchanger (104) serves as an evaporator. In the regenerative heat exchanger (102), the second air is heated by heat exchange with the refrigerant. The second air heated through the regenerative heat exchanger (102) is passed to the adsorbing element (81, 82) in the regeneration operation. Where the first heat exchanger (103) serves as an evaporator, the refrigerant is evaporated through the first heat exchanger (103) by exchanging heat with the first air or the second air to be supplied into the room. Where the second heat exchanger (104) serves as an evaporator, the refrigerant is evaporated through the second heat exchanger (104) by exchanging heat with the first air or the second air to be discharged to the outside.

According to the second solution, the refrigerant circuit (100) can perform an operation in which the first heat exchanger (103) serves as an evaporator while the refrigerant is not supplied to the second heat exchanger (104), and an operation in which the second heat exchanger (104) serves as an evaporator while the refrigerant is not supplied to the first heat exchanger (103).

According to the third solution, the refrigerant circuit (100) can perform an operation in which the first heat exchanger (103) serves as an evaporator while the refrigerant is not supplied to the second heat exchanger (104), and an operation in which the second heat exchanger (104) serves as an evaporator while the refrigerant is not supplied to the first heat exchanger (103). Moreover, the refrigerant circuit (100) of this solution can perform an operation in which the first heat exchanger (103) and the second heat exchanger (104) both serve as an evaporator.

According to the fourth solution, the refrigerant circuit (100) can perform an operation in which the first heat exchanger (103) serves as an evaporator while the refrigerant is not supplied to the second heat exchanger (104), and an operation in which the second heat exchanger (104) serves as an evaporator while the refrigerant is not supplied to the first heat exchanger (103). Moreover, the refrigerant circuit (100) of this solution can perform an operation in which the first heat exchanger (103) and the second heat exchanger (104) both serve as an evaporator. Moreover, the refrigerant circuit (100) of this solution can perform an operation in which the first heat exchanger (103) serves as an evaporator while the second heat exchanger (104) serves as a condenser or a subcooler, and an operation in which the second heat exchanger (104) serves as an evaporator while the first heat exchanger (103) serves as a condenser or a subcooler. The first heat exchanger (103) and the second heat exchanger (104) each serve as a condenser if the refrigerant supplied thereto is partially a high-pressure gas refrigerant and as a subcooler if the refrigerant is entirely a high-pressure liquid refrigerant.

According to the fifth solution, the refrigerant circuit (100) can perform an operation in which the first heat exchanger (103) and the second heat exchanger (104) both serve as an evaporator. Moreover, the refrigerant circuit (100) of this solution can perform an operation in which the first heat exchanger (103) serves as an evaporator while the second heat exchanger (104) serves as a condenser or a subcooler, and an operation in which the second heat exchanger (104) serves as an evaporator while the first heat exchanger (103) serves as a condenser or a subcooler. The first heat exchanger (103) and the second heat exchanger (104) each serve as a condenser if the refrigerant supplied thereto is partially a high-pressure gas refrigerant and as a subcooler if the refrigerant is entirely a high-pressure liquid refrigerant.

According to the sixth solution, the humidity control apparatus can perform an operation in which the first heat exchanger (103) of the refrigerant circuit (100) serves as an evaporator when the first air dehumidified in the adsorption operation is supplied into the room while the second air humidified by the regeneration operation is discharged to the outside. In this operating mode, the first air to be supplied into the room is cooled through the first heat exchanger (103). Thus, the first air is dehumidified through the adsorbing element (81, 82) and then cooled through the first heat exchanger (103) before it is supplied into the room.

Moreover, according to this solution, the humidity control apparatus can perform an operation in which the second heat exchanger (104) of the refrigerant circuit (100) serves as an evaporator when the second air humidified in the regeneration operation is supplied into the room while the first air dehumidified in the adsorption operation is discharged to the outside. In this operating mode, the refrigerant is evaporated through the second heat exchanger (104) by absorbing heat from the first air to be discharged to the outside. Thus, in the second heat exchanger (104), heat is collected from the first air to be discharged to the outside, and the collected heat is used for heating the second air in the regenerative heat exchanger (102).

According to the seventh solution, the humidity control apparatus performs an adsorption operation and a regeneration operation. In the adsorbing element (81, 82) during the adsorption operation, the first air is brought into contact with the adsorbent, whereby water vapor in the first air is adsorbed onto the adsorbent. In the adsorbing element (81, 82) during the regeneration operation, the heated second air is brought into contact with the adsorbent, whereby water vapor is desorbed from the adsorbent. Thus, the adsorbing element (81, 82) is regenerated. The water vapor desorbed from the adsorbent is given to the second air.

The humidity control apparatus of this solution at least has a humidification mode. In the humidification mode, the second air humidified through the adsorbing element (81, 82) is supplied into the room while the first air deprived of its moisture through the adsorbing element (81, 82) is discharged to the outside. The refrigerant circuit (100) of the humidity control apparatus includes the regenerative heat exchanger (102) and the discharge-side heat exchanger (104). In the humidification mode, the regenerative heat exchanger (102) serves as a condenser while the discharge-side heat exchanger (104) serves as an evaporator. Thus, in the regenerative heat exchanger (102), the second air is heated by heat exchange with the refrigerant. The second air heated through the regenerative heat exchanger (102) is passed to the adsorbing element (81, 82) in the regeneration operation. In the discharge-side heat exchanger (104), the refrigerant is evaporated by heat exchange with the first air to be discharged to the outside.

According to the eighth solution, the humidity control apparatus has not only a humidification mode but also a dehumidification mode. In the dehumidification mode, the first air dehumidified through the adsorbing element (81, 82) is supplied into the room, while the second air having been used for the regeneration of the adsorbing element (81, 82) is discharged to the outside.

The refrigerant circuit (100) of the humidity control apparatus includes the first heat exchanger (103), in addition to the regenerative heat exchanger (102) and the discharge-side heat exchanger (104). Moreover, in the refrigerant circuit (100), the discharge-side heat exchanger (104) forms the second heat exchanger (104). In the dehumidification mode, the regenerative heat exchanger (102) serves as a condenser while the first heat exchanger (103) serves as an evaporator. Thus, in the regenerative heat exchanger (102), the second air is heated by heat exchange with the refrigerant. The second air heated through the regenerative heat exchanger (102) is passed to the adsorbing element (81, 82) in the regeneration operation. In the first heat exchanger (103), the refrigerant is evaporated by heat exchange with the first air to be supplied into the room.

According to the ninth solution, the refrigerant circuit (100) can perform an operation in which the first heat exchanger (103) serves as an evaporator while the refrigerant is not supplied to the second heat exchanger (104), and an operation in which the second heat exchanger (104) serves as an evaporator while the refrigerant is not supplied to the first heat exchanger (103).

According to the tenth solution, the refrigerant circuit (100) can perform an operation in which the first heat exchanger (103) serves as an evaporator while the refrigerant is not supplied to the second heat exchanger (104), and an operation in which the second heat exchanger (104) serves as an evaporator while the refrigerant is not supplied to the first heat exchanger (103). Moreover, the refrigerant circuit (100) of this solution can perform an operation in which the first heat exchanger (103) and the second heat exchanger (104) both serve as an evaporator.

According to the eleventh solution, the refrigerant circuit (100) can perform an operation in which the first heat exchanger (103) serves as an evaporator while the refrigerant is not supplied to the second heat exchanger (104), and an operation in which the second heat exchanger (104) serves as an evaporator while the refrigerant is not supplied to the first heat exchanger (103). Moreover, the refrigerant circuit (100) of this solution can perform an operation in which the first heat exchanger (103) and the second heat exchanger (104) both serve as an evaporator. Moreover, the refrigerant circuit (100) of this solution can perform an operation in which the first heat exchanger (103) serves as an evaporator while the second heat exchanger (104) serves as a condenser or a subcooler, and an operation in which the second heat exchanger (104) serves as an evaporator while the first heat exchanger (103) serves as a condenser or a subcooler. The first heat exchanger (103) and the second heat exchanger (104) each serve as a condenser if the refrigerant supplied thereto is partially a high-pressure gas refrigerant and as a subcooler if the refrigerant is entirely a high-pressure liquid refrigerant.

According to the twelfth solution, the refrigerant circuit (100) can perform an operation in which the first heat exchanger (103) and the second heat exchanger (104) both serve as an evaporator. Moreover, the refrigerant circuit (100) of this solution can perform an operation in which the first heat exchanger (103) serves as an evaporator while the second heat exchanger (104) serves as a condenser or a subcooler, and an operation in which the second heat exchanger (104) serves as an evaporator while the first heat exchanger (103) serves as a condenser or a subcooler. The first heat exchanger (103) and the second heat exchanger (104) each serve as a condenser if the refrigerant supplied thereto is partially a high-pressure gas refrigerant and as a subcooler if the refrigerant is entirely a high-pressure liquid refrigerant.

According to the thirteenth and fourteenth solutions, the humidity control apparatus can perform an operation in which the first heat exchanger (103) and the second heat exchanger (104) of the refrigerant circuit (100) each serve as an evaporator when the first air dehumidified in the adsorption operation is supplied into the room while the second air humidified in the regeneration operation is discharged to the outside. In this operating mode, the first air to be supplied into the room is cooled in the first heat exchanger (103), while the refrigerant absorbs heat from the second air to be discharged to the outside in the second heat exchanger (104). Thus, the first air is dehumidified through the adsorbing element (81, 82) and then cooled through the first heat exchanger (103) before it is supplied into the room. Moreover, in the second heat exchanger (104), heat is collected from the second air to be discharged to the outside, and the collected heat is used for heating the second air in the regenerative heat exchanger (102).

According to the fifteenth and sixteenth solutions, the humidity control apparatus can perform an operation in which the first heat exchanger (103) and the second heat exchanger (104) of the refrigerant circuit (100) each serve as an evaporator when the second air humidified in the regeneration operation is supplied into the room while the first air dehumidified in the adsorption operation is discharged to the outside. In this operating mode, the second air to be supplied into the room is cooled in the first heat exchanger (103), while the refrigerant absorbs heat from the first air to be discharged to the outside in the second heat exchanger (104). Thus, the second air is humidified through the adsorbing element (81, 82) and then cooled through the first heat exchanger (103) before it is supplied into the room. Moreover, in the second heat exchanger (104), heat is collected from the first air to be discharged to the outside, and the collected heat is used for heating the second air in the regenerative heat exchanger (102).

According to the seventeenth and eighteenth solutions, the humidity control apparatus can perform an operation in which the first heat exchanger (103) of the refrigerant circuit (100) serves as an evaporator while the second heat exchanger (104) serves as a condenser or a subcooler when the first air dehumidified in the adsorption operation is supplied into the room while the second air humidified in the regeneration operation is discharged to the outside. In this operating mode, the first air to be supplied into the room is cooled in the first heat exchanger (103), while the refrigerant radiates heat into the second air to be discharged to the outside in the second heat exchanger (104). Thus, the first air is dehumidified through the adsorbing element (81, 82) and then cooled through the first heat exchanger (103) before it is supplied into the room. Moreover, the refrigerant of the refrigerant circuit (100) radiates heat into the second air not only in the regenerative heat exchanger (102) but also in the second heat exchanger (104).

According to the nineteenth and twentieth solutions, the humidity control apparatus can perform an operation in which the first heat exchanger (103) of the refrigerant circuit (100) serves as a condenser or a subcooler while the second heat exchanger (104) serves as an evaporator when the second air humidified in the regeneration operation is supplied into the room while the first air dehumidified in the adsorption operation is discharged to the outside. In this operating mode, the second air to be supplied into the room is heated in the first heat exchanger (103), while the refrigerant is evaporated by absorbing heat from the first air to be discharged to the outside in the second heat exchanger (104). Thus, the second air is humidified through the adsorbing element (81, 82) and then heated through the first heat exchanger (103) before it is supplied into the room. Moreover, in the second heat exchanger (104), heat is collected from the first air to be discharged to the outside, and the collected heat is used for heating the second air in the regenerative heat exchanger (102).

According to the twenty-first, twenty-second, twenty-third and twenty-fourth solutions, the refrigerant circuit (100) is configured so that the first heat exchanger (103) and the second heat exchanger (104) are connected in series with each other in an operating mode in which the first heat exchanger (103) and the second heat exchanger (104) both serve as an evaporator. For example, where the first heat exchanger (103) is on the upstream side and the second heat exchanger (104) is on the downstream side, the refrigerant exchanges heat with the air through the first heat exchanger (103) and is then passed into the second heat exchanger (104).

The refrigerant circuit (100) of the twenty-first and twenty-second solutions can perform an operation in which heat is exchanged between the refrigerant and the air by using only a portion of one of the first heat exchanger (103) and the second heat exchanger (104), which are arranged in series with each other, that is located downstream of the other. In this operation, as compared with a case where heat is exchanged between the refrigerant and the air by using the entirety of one of the heat exchangers (103, 104) that is located downstream of the other, the amount of heat absorbed by the refrigerant through that heat exchanger (103, 104) is smaller.

Moreover, the refrigerant circuit (100) of the twenty-third and twenty-fourth solutions can perform an operation of supplying only a portion of the refrigerant from one of the first heat exchanger (103) and the second heat exchanger (104), which are arranged in series with each other, that is located upstream of the other. In this operation, as compared with a case where the entire refrigerant supplied to one of the heat exchangers (103, 104) that is located downstream of the other, the amount of heat absorbed by the refrigerant through that heat exchanger (103, 104) is smaller.

According to the twenty-fifth and twenty-sixth solutions, the outside air is taken into the humidity control apparatus as the second air. The second air, being the outside air, is heated through the regenerative heat exchanger (102) and then further humidified through the adsorbing element (81, 82) before it is supplied into the room. In this case, the room air is taken into the humidity control apparatus as the first air. The first air, being the room air, is deprived of its moisture through the adsorbing element (81, 82) and is then discharged to the outside.

According to the twenty-seventh and twenty-eighth solutions, the outside air is taken in as the first air. The first air, being the outside air, is dehumidified through the adsorbing element (81, 82) and then supplied into the room. In this case, the room air is taken into the humidity control apparatus as the second air. The second air, being the room air, is heated through the regenerative heat exchanger (102) and then further used for the regeneration of the adsorbing element (81, 82) before it is discharged to the outside.

Effects

With the humidity control apparatus of the present invention, in an operating mode in which the humidified second air is supplied into the room while the first air deprived of its moisture is discharged to the outside, the refrigerant can exchange heat with the first air through the heat exchanger (104) serving as an evaporator. Therefore, the humidified second air to be supplied into the room is cooled by heat exchange with the refrigerant, whereby it is possible to prevent water vapor in the second air from being condensed and lost. Therefore, according to the present invention, it is possible to maintain a high humidification capacity in a humidity control apparatus capable of supplying the humidified second air into the room.

Moreover, the first and eighth solutions also provide the following effect, which will now be described below.

First, a humidity control apparatus using a rotor-shaped adsorbing element has been know in the art, as disclosed in Japanese Laid-Open Patent Publication No. 11-241837. The humidity control apparatus is switched between the dehumidification mode in which a dehumidified air is supplied into the room and the humidification mode in which a humidified air is supplied into the room. The adsorbing element is accommodated in a casing and is rotated about its central axis. Moreover, the adsorbing-side air passes through a portion of the adsorbing element and the regenerating-side air heated by an electric heater passes through the remaining portion of the adsorbing element.

In the dehumidification mode of this conventional humidity control apparatus, the adsorbing-side air deprived of its moisture by the adsorbing element is supplied into the room. Then, the adsorbing element is regenerated by the heated regenerating-side air, and the regenerating-side air having passed through the adsorbing element is discharged to the outside. In the humidification mode, the regenerating-side air having been given the moisture desorbed from the adsorbing element is supplied into the room. Then, the adsorbing-side air deprived of its moisture by the adsorbing element is discharged to the outside.

While the conventional humidity control apparatus uses an electric heater as the heat source for heating the regenerating-side air, the heat source may alternatively be a heat pump. Normally, a refrigerant circuit forming a heat pump includes two heat exchangers, one of which serves as an evaporator and the other as a condenser. In the heat exchanger serving as a condenser, the regenerating-side air is heated by heat exchange with the refrigerant. In the heat exchanger serving as an evaporator, the adsorbing-side air having passed through the adsorbing element exchanges heat with the refrigerant.

In the conventional humidity control apparatus, however, the path of the adsorbing-side air from the adsorbing element needs to be switched from one to another for the switching between the dehumidification mode and the humidification mode. Therefore, if a heat pump is to be used in this humidity control apparatus, the heat exchanger serving as an evaporator needs to be placed upstream of the position where the flow direction of the adsorbing-side air is switched between roomward and outward. Therefore, there will be limitations on the layout of the components, such as the heat exchanger serving as an evaporator, thus significantly decreasing the design freedom of the humidity control apparatus. Moreover, due to the limitations on the layout of the heat exchanger, etc., air passageways may become complicated to increase the size of the humidity control apparatus.

In contrast, in the humidity control apparatus of the first or eighth solution, the refrigerant circuit (100) includes the first heat exchanger (103) where heat can be exchanged between the air going into the room and the refrigerant, and the second heat exchanger (104) where heat is exchanged between the air going to the outside and the refrigerant, with at least one of the first heat exchanger (103) and the second heat exchanger (104) serving as an evaporator. Therefore, the first heat exchanger (103) and the second heat exchanger (104) can be placed downstream of the position where the flow direction of the first air or the second air is switched between roomward and outward.

Therefore, according to the first and eighth solutions, it is possible to reduce the limitations on the layout of the components of the humidity control apparatus, particularly, the first heat exchanger (103) and the second heat exchanger (104), which may each serve as an evaporator. Thus, it is possible to reliably avoid problems that may occur due to the limitations on the layout of the components, i.e., a decrease in the design freedom of the humidity control apparatus, or the air passageways becoming complicated to increase the size of the humidity control apparatus.

In the second to fifth and ninth to twelfth solutions, the refrigerant circuit (100) is configured to perform various operations. Therefore, these solutions make possible various operations of the refrigerant circuit (100), thereby increasing the functionality of the humidity control apparatus.

According to the sixth solution, it is possible to perform an operation in which the first air is dehumidified and then further cooled before it is supplied into the room. Therefore, with this operation, it is possible not only to control the humidity of, but also to cool, the air in the room. Moreover, with this solution, it is possible to perform an operation in which heat collected from the first air to be discharged is used for heating the second air in the regenerative heat exchanger (102). Therefore, with this operation, the internal energy of the first air to be discharged can be efficiently used for the operation of the humidity control apparatus.

According to the thirteenth and fourteenth solutions, it is possible to perform an operation in which the first air is dehumidified and then further cooled before it is supplied into the room, while heat collected from the second air to be discharged is reused for heating the second air in the regenerative heat exchanger (102). Therefore, with this operation, it is possible not only to control the humidity of, but also to cool, the air in the room, while the internal energy of the second air to be discharged can be efficiently used for the operation of the humidity control apparatus.

According to the fifteenth and sixteenth solutions, it is possible to perform an operation in which the second air is humidified and then further cooled before it is supplied into the room, while heat collected from the first air to be discharged is used for heating the second air in the regenerative heat exchanger (102). Therefore, with this operation, it is possible to perform an operation that is suitable for a case where the user wishes to humidify the air in the room without increasing the temperature thereof, and the internal energy of the first air to be discharged can be efficiently used for the operation of the humidity control apparatus.

According to the seventeenth and eighteenth solutions, it is possible to perform an operation in which the first air is dehumidified and then further cooled before it is supplied into the room, while the refrigerant radiates heat into the second air both in the regenerative heat exchanger (102) and in the second heat exchanger (104). Therefore, with this operation, it is possible not only to control the humidity of, but also to cool, the air in the room. Moreover, the enthalpy of the refrigerant passed to the first heat exchanger (103) serving as an evaporator can be reduced, whereby the amount of heat absorbed by the refrigerant through the first heat exchanger (103) can be increased, thus improving the cooling capacity.

According to the nineteenth and twentieth solutions, it is possible to perform an operation in which the second air is humidified and then further heated before it is supplied into the room, while heat collected from the first air to be discharged is used for heating the second air in the regenerative heat exchanger (102) or the first heat exchanger (103). Therefore, with this operation, it is possible not only to control the humidity of, but also to heat, the air in the room, while the internal energy of the first air to be discharged can be efficiently used for the operation of the humidity control apparatus.

According to the twenty-first to twenty-fourth solutions, in an operation where the first heat exchanger (103) and the second heat exchanger (104), which are arranged in series with each other, both serve as an evaporator, it is possible to reduce the amount of heat absorbed by the refrigerant through one of the heat exchangers (103, 104) that is located downstream of the other. Thus, the amount of heat absorbed by the refrigerant through the first and second heat exchangers (103, 104) both serving as an evaporator can be kept in balance with the amount of heat radiated from the refrigerant through the regenerative heat exchanger (102) serving as a condenser, whereby it is possible to perform a stable refrigerating cycle in the refrigerant circuit (100).

According to the twenty-fifth and twenty-sixth solutions, it is possible to perform an operation in which the outside air, taken in as the second air, is supplied into the room after being humidified, while the room air, taken in as the first air, is discharged to the outside after being dehumidified. Moreover, according to the twenty-seventh and twenty-eighth solutions, it is possible to perform an operation in which the outside air, taken in as the first air, is supplied into the room after being dehumidified, while the room air, taken in as the second air, is discharged to the outside after being humidified. Therefore, according to the twenty-fifth to twenty-eighth solutions, it is possible not only to control the humidity of the air to be supplied into the room, but also to ventilate the room.

BEST MODE FOR CARRYING OUT THE INVENTION

Figure 1:
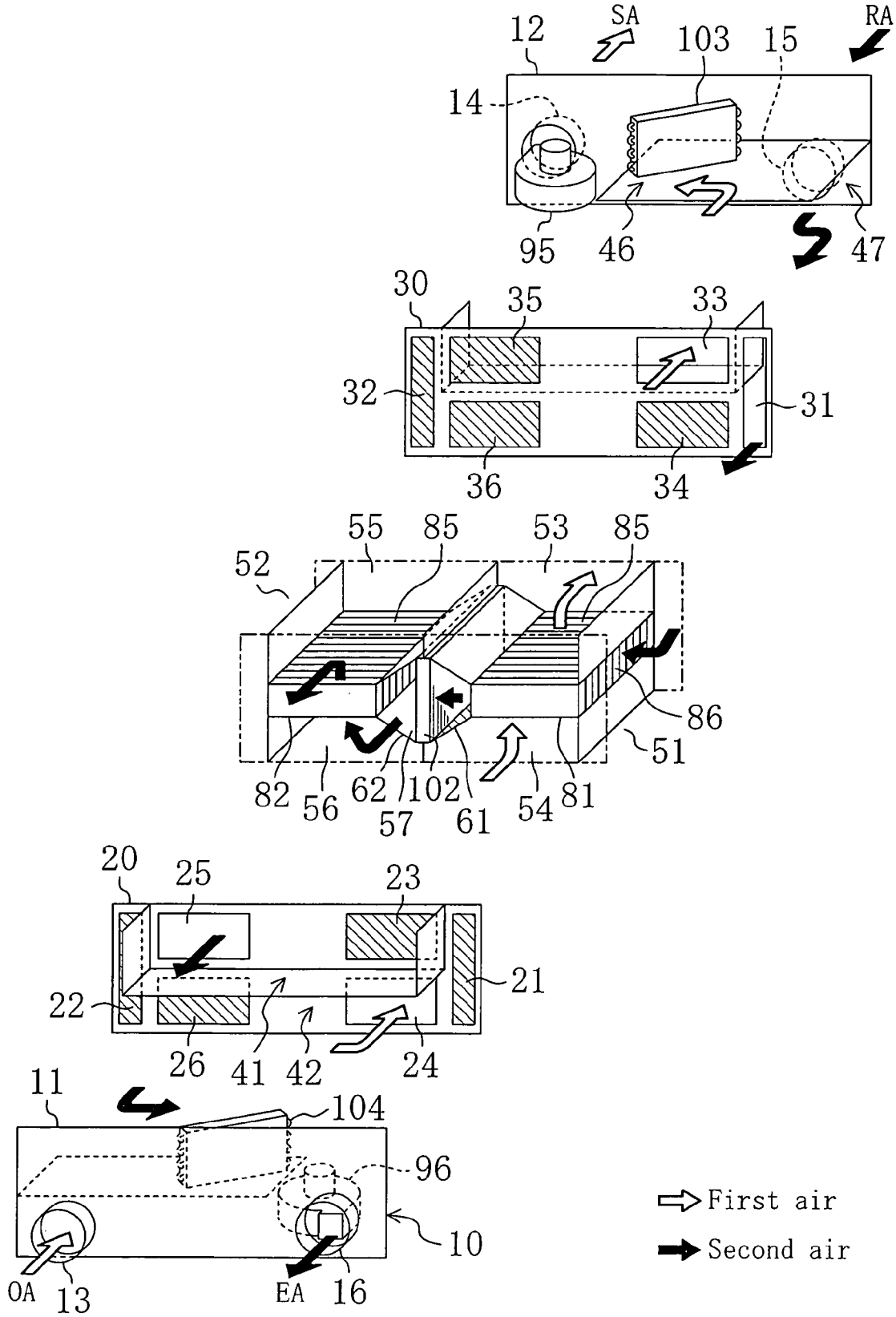
FIG. 1 is an exploded perspective view illustrating the configuration of a humidity control apparatus according to Embodiment 1, and the first operation of the dehumidification mode thereof.

Embodiments of the present invention will now be described with reference to the drawings. In the following description, "upward", "downward", "leftward", "rightward", "forward", "backward", "frontward" and "rearward" directions are defined with respect to the drawing sheet being referred to.

Embodiment 1

A humidity control apparatus according to the present embodiment is switched between the dehumidification mode in which a dehumidified air is supplied into the room and the humidification mode in which a humidified air is supplied into the room. Moreover, the humidity control apparatus includes a refrigerant circuit (100) and two adsorbing elements (81, 82), and performs a so-called "batch" operation. The configuration of the humidity control apparatus according to the present embodiment will now be described with reference to FIG. 1, FIG. 5, FIG. 6 and FIG. 7.

General Configuration of Humidity Control Apparatus

As illustrated in FIG. 1 and FIG. 5, the humidity control apparatus includes a casing (10) having a somewhat flattened, rectangular parallelepiped shape. The casing (10) accommodates the two adsorbing elements (81, 82) and the refrigerant circuit (100). The refrigerant circuit (100) includes a regenerative heat exchanger (102), a first heat exchanger (103) and a second heat exchanger (104). Note that the refrigerant circuit (100) will later be described in detail.

Figure 6:
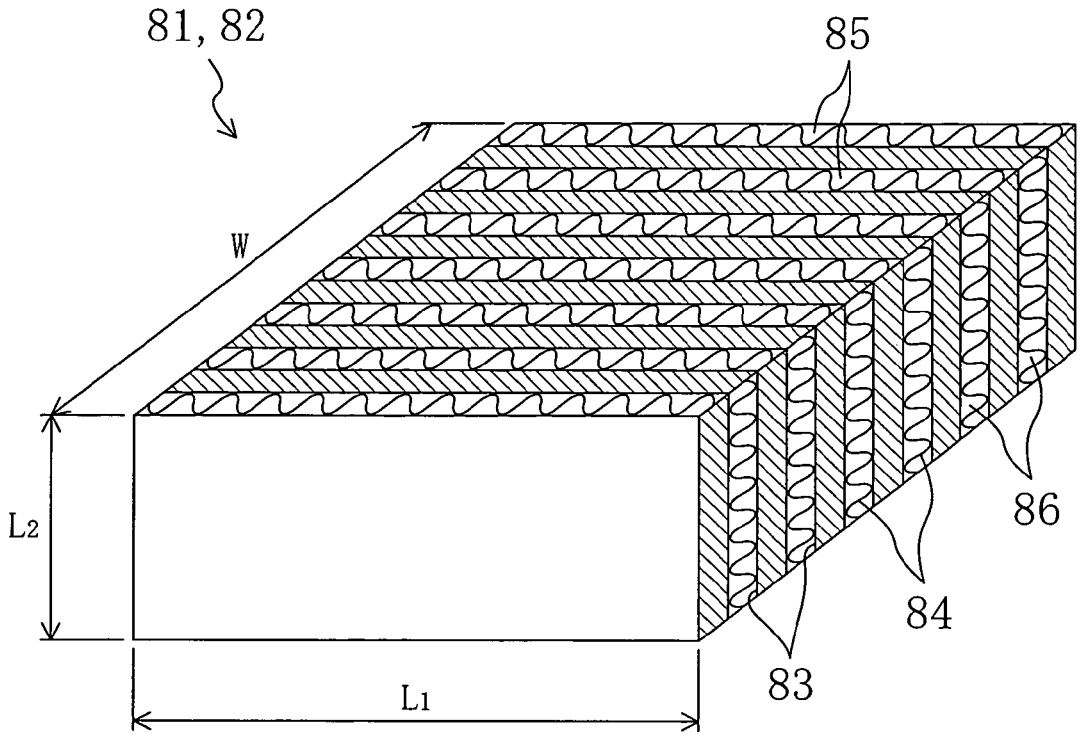
FIG. 6 is a schematic perspective view illustrating an adsorbing element of the humidity control apparatus according to Embodiment 1.

As illustrated in FIG. 6, the adsorbing element (81, 82) includes flat members (83) having a flat shape and corrugated members (84) having a corrugated shape, which are stacked on one another. The flat member (83) is formed in a rectangular shape such that the length $L_1$ of the long side is 2.5 times the length $L_2$ of the short side. Thus, in the flat member (83), $L_1/L_2=2.5$. Note that the numerical values mentioned herein are exemplary. The corrugated members (84) are stacked together in an orientation such that the ridgeline directions of adjacent corrugated members (84) are at 90° with respect to each other. The adsorbing element (81, 82) as a whole is formed in a rectangular parallelepiped shape or a square pole shape.

In the adsorbing element (81, 82), humidity control passageways (85) and cooling passageways (86) are formed alternating with each other, with the flat members (83) interposed therebetween, in the direction in which the flat members (83) and the corrugated members (84) are stacked together. In the adsorbing element (81, 82), the humidity control passageways (85) are exposed on the side surface that is extending along the long side of the flat members (83), and the cooling passageways (86) are exposed on the side surface that is extending along the short side of the flat members (83). Moreover, in the adsorbing element (81, 82), the front and rear end surfaces as shown in the figure are closed surfaces on which neither the humidity control passageways (85) nor the cooling passageways (86) are exposed.

In the adsorbing element (81, 82), an adsorbent for adsorbing water vapor is applied on the surface of the flat members (83) facing the humidity control passageways (85) and on the surface of the corrugated members (84) provided in the humidity control passageways (85). The adsorbent of this type may be, for example, a silica gel, a zeolite, an ion exchange resin, etc.

As illustrated in FIG. 1, the casing (10) includes an outdoor-side panel (11) provided at the most frontward position, and a room-side panel (12) provided at the most rearward position. The outdoor-side panel (11) includes an outdoor-side inlet (13) formed near the left end thereof, and an outdoor-side outlet (16) formed near the right end thereof. The room-side panel (12) includes a room-side outlet (14) formed near the left end thereof, and a room-side inlet (15) near the right end thereof.

Inside the casing (10), a first partition (20) and a second partition (30) are provided in this order from the front side to the rear side. The internal space of the casing (10) is divided by the first and second partitions (20, 30) into sections arranged in the forward-backward direction.

The space between the outdoor-side panel (11) and the first partition (20) is divided into an outdoor-side upper channel (41) on the upper side and an outdoor-side lower channel (42) on the lower side. The outdoor-side upper channel (41) is communicated with the outside space through the outdoor-side outlet (16). The outdoor-side lower channel (42) is communicated with the outside space through the outdoor-side inlet (13).

In the space between the outdoor-side panel (11) and the first partition (20), an air-discharging fan (96) is provided near the right end thereof. Moreover, the second heat exchanger (104) is provided along the outdoor-side upper channel (41). The second heat exchanger (104) is a so-called "cross fin" type fin-and-tube heat exchanger, and is configured so that the air flowing through the outdoor-side upper channel (41) toward the air-discharging fan (96) exchanges heat with the refrigerant in the refrigerant circuit (100). Thus, the second heat exchanger (104) is for heat exchange between the air to be discharged to the outside and the refrigerant, and is an discharge-side heat exchanger.

The first partition (20) has formed therein a first right-side opening (21), a first left-side opening (22), a first upper-right opening (23), a first lower-right opening (24), a first upper-left opening (25) and a first lower-left opening (26). Each of these openings (21, 22, . . . ) includes an open-close shutter so that it can be opened/closed.

Each of the first right-side opening (21) and the first left-side opening (22) is a rectangular opening elongated in the vertical direction. The first right-side opening (21) is provided in the vicinity of the right end of the first partition (20). The first left-side opening (22) is provided in the vicinity of the left end of the first partition (20). Each of the first upper-right opening (23), the first lower-right opening (24), the first upper-left opening (25) and the first lower-left opening (26) is a rectangular opening elongated in the horizontal direction. The first upper-right opening (23) is provided in an upper portion of the first partition (20) and on the left of the first right-side opening (21). The first lower-right opening (24) is provided in a lower portion of the first partition (20) and on the left of the first right-side opening (21). The first upper-left opening (25) is provided in an upper portion of the first partition (20) and on the right of the first left-side opening (22). The first lower-left opening (26)

is provided in a lower portion of the first partition (20) on the right of the first left-side opening (22).

The two adsorbing elements (81, 82) are provided between the first partition (20) and the second partition (30). The adsorbing elements (81, 82) are arranged next to each other in the left-right direction with a predetermined interval therebetween. Specifically, the first adsorbing element (81) is provided on the right side, and the second adsorbing element (82) is provided on the left side.

The first and second adsorbing elements (81, 82) are arranged in an orientation such that the direction in which the fiat members (83) and the corrugated members (84) are stacked together in each adsorbing element is aligned with the longitudinal direction of the casing (10) (the front-rear direction in FIG. 1), and such that the direction in which the flat members (83), etc., are stacked together in one adsorbing element is parallel to that in the other absorbing element. Moreover, each of the adsorbing elements (81, 82) is arranged in an orientation such that the left and right side surfaces thereof are generally parallel to the side plates of the casing (10), the upper and lower surfaces to the top plate and the bottom plate of the casing (10), and the front and rear end surfaces to the outdoor-side panel (11) and the room-side panel (12).

Moreover, each adsorbing element (81, 82) provided in the casing (10) has its cooling passageways (86) exposed on the left and right side surfaces. Thus, one of the side surfaces of the first adsorbing element (81) on which the cooling passageways (86) are exposed and one of the side surfaces of the second adsorbing element (82) on which the cooling passageways (86) are exposed are facing each other.

The space between the first partition (20) and the second partition (30) is divided into a right-side channel (51), a left-side channel (52), an upper-right channel (53), a lower-right channel (54), an upper-left channel (55), a lower-left channel (56) and a center channel (57).

The right-side channel (51) is formed on the right of the first adsorbing element (81), and is communicated with the cooling passageways (86) of the first adsorbing element (81). The left-side channel (52) is formed on the left of the second adsorbing element (82), and is communicated with the cooling passageways (86) of the second adsorbing element (82).

The upper-right channel (53) is formed over the first adsorbing element (81), and is communicated with the humidity control passageways (85) of the first adsorbing element (81). The lower-right channel (54) is formed under the first adsorbing element (81), and is communicated with the humidity control passageways (85) of the first adsorbing element (81). The upper-left channel (55) is formed over the second adsorbing element (82), and is communicated with the humidity control passageways (85) of the second adsorbing element (82). The lower-left channel (56) is formed under the second adsorbing element (82), and is communicated with the humidity control passageways (85) of the second adsorbing element (82).

The center channel (57) is formed between the first adsorbing element (81) and the second adsorbing element (82), and is communicated with the cooling passageways (86) of both adsorbing elements (81, 82). The center channel (57) has an octagonal cross section as seen in FIG. 1 and FIG. 5.

The regenerative heat exchanger (102) is a so-called "cross fin" type fin-and-tube heat exchanger, and is configured so that the air flowing through the center channel (57) exchanges heat with the refrigerant in the refrigerant circuit (100). The regenerative heat exchanger (102) is provided along the center channel (57). Thus, the regenerative heat exchanger (102) is provided between the first adsorbing element (81) and the second adsorbing element (82), which are arranged next to each other in the left-right direction. Moreover, the regenerative heat exchanger (102) is provided in a generally upright position so as to divide the center channel (57) into left and right sections.

A right shutter (61) is provided between the first adsorbing element (81) and the regenerative heat exchanger (102). The right shutter (61) is for separating the right-side portion of the regenerative heat exchanger (102) in the center channel (57) from the lower-right channel (54), and is configured so that it can be opened/closed. A left shutter (62) is provided between the second adsorbing element (82) and the regenerative heat exchanger (102). The left shutter (62) is for separating the left-side portion of the regenerative heat exchanger (102) in the center channel (57) from the lower-left channel (56), and is configured so that it can be opened/closed.

The connection between the channels (41, 42) between the outdoor-side panel (11) and the first partition (20) and the channels (51, 52, . . . ) between the first partition (20) and the second partition (30) is switched between the communicated state and the blocked state by open-close shutters provided in the openings (21, 22, . . . ) in the first partition (20). Specifically, with the first right-side opening (21) being in the open state, the right-side channel (51) and the outdoor-side lower channel (42) are communicated with each other. With the first left-side opening (22) being in the open state, the left-side channel (52) and the outdoor-side lower channel (42) are communicated with each other. With the first upper-right opening (23) being in the open state, the upper-right channel (53) and the outdoor-side upper channel (41) are communicated with each other. With the first lower-right opening (24) being in the open state, the lower-right channel (54) and the outdoor-side lower channel (42) are communicated with each other. With the first upper-left opening (25) being in the open state, the upper-left channel (55) and the outdoor-side upper channel (41) are communicated with each other. With the first lower-left opening (26) being in the open state, the lower-left channel (56) and the outdoor-side lower channel (42) are communicated with each other.

The second partition (30) has formed therein a second right-side opening (31), a second left-side opening (32), a second upper-right opening (33), a second lower-right opening (34), a second upper-left opening (35) and a second lower-left opening (36). Each of these openings (31, 32, . . . ) includes an open-close shutter so that it can be opened/closed.

Each of the second right-side opening (31) and the second left-side opening (32) is a rectangular opening elongated in the vertical direction. The second right-side opening (31) is provided in the vicinity of the right end of the second partition (30). The second left-side opening (32) is provided in the vicinity of the left end of the second partition (30). Each of the second upper-right opening (33), the second lower-right opening (34), the second upper-left opening (35) and the second lower-left opening (36) is a rectangular opening elongated in the horizontal direction. The second upper-right opening (33) is provided in an upper portion of the second partition (30) and on the left of the second right-side opening (31). The second lower-right opening (34) is provided in a lower portion of the second partition (30) and on the left of the second right-side opening (31). The second upper-left opening (35) is provided in an upper portion of the second partition (30) and on the right of the second left-side opening (32). The second lower-left opening (36) is provided in a lower portion of the second partition (30) on the right of the second left-side opening (32).

The space between the room-side panel (12) and the second partition (30) is divided into a room-side upper channel (46) on the upper side and a room-side lower channel (47) on the lower side. The room-side upper channel (46) is communicated with the room space through the room-side outlet (14). The room-side lower channel (47) is communicated with the room space through the room-side inlet (15).

In the space between the room-side panel (12) and the second partition (30), an air-supplying fan (95) is provided near the left end thereof. Moreover, the first heat exchanger (103) is provided along the room-side upper channel (46). The first heat exchanger (103) is a so-called "cross fin" type fin-and-tube heat exchanger, and is configured so that the air flowing through the room-side upper channel (46) toward the air-supplying fan (95) exchanges heat with the refrigerant in the refrigerant circuit (100). Thus, the first heat exchanger (103) is for heat exchange between the air to be supplied into the room and the refrigerant.

The connection between the channels between the first partition (20) and the second partition (30) and the channels between the second partition (30) and the outdoor-side panel (11) is switched between the communicated state and the blocked state by open-close shutters provided in the openings in the second partition (30). Specifically, with the second right-side opening (31) being in the open state, the right-side channel (51) and the room-side lower channel (47) are communicated with each other. With the second left-side opening (32) being in the open state, the left-side channel (52) and the room-side lower channel (47) are communicated with each other. With the second upper-right opening (33) being in the open state, the upper-right channel (53) and the room-side upper channel (46) are communicated with each other. With the second lower-right opening (34) being in the open state, the lower-right channel (54) and the room-side lower channel (47) are communicated with each other. With the second upper-left opening (35) being in the open state, the upper-left channel (55) and the room-side upper channel (46) are communicated with each other. With the second lower-left opening (36) being in the open state, the lower-left channel (56) and the room-side lower channel (47) are communicated with each other.

Configuration of Refrigerant Circuit

Figure 7:
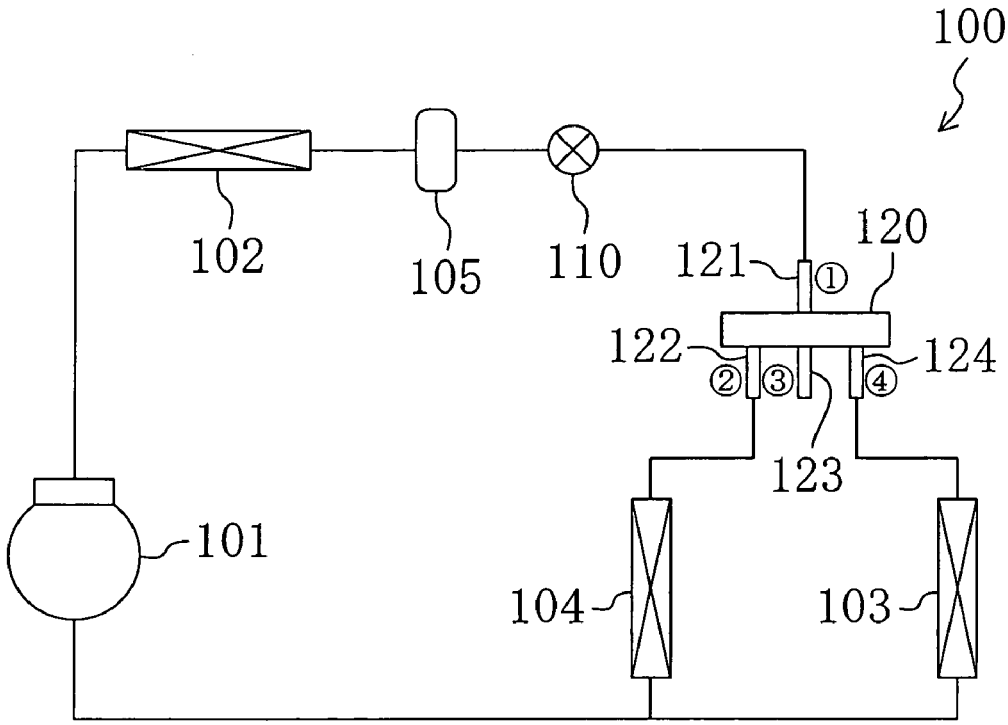
FIG. 7 is a pipe system diagram illustrating the configuration of the refrigerant circuit according to Embodiment 1.

As illustrated in FIG. 7, the refrigerant circuit (100) is a closed circuit filled with a refrigerant. The refrigerant circuit (100) includes a compressor (101), the regenerative heat exchanger (102), the first heat exchanger (103), the second heat exchanger (104), a receiver (105), a four-way selector valve (120) and an electrically-operated expansion valve (110). In the refrigerant circuit (100), a vapor-compression refrigerating cycle is performed by circulating the refrigerant therethrough.

In the refrigerant circuit (100), the discharge side of the compressor (101) is connected to one end of the regenerative heat exchanger (102). The other end of the regenerative heat exchanger (102) is connected to one end of the electrically-operated expansion valve (110) via the receiver (105). The other end of the electrically-operated expansion valve (110) is connected to a first port (121) of the four-way selector valve (120). The four-way selector valve (120) has a second port (122) connected to one end of the second heat exchanger (104), and a fourth port (124) connected to one end of the first heat exchanger (103). Moreover, a third port (123) of the four-way selector valve (120) is sealed. The other end of the first heat exchanger (103) and the other end of the second heat exchanger (104) are connected to the intake side of the compressor (101).

The four-way selector valve (120) can be switched between a position where the first port (121) and the second port (122) are communicated with each other while the third port (123) and the fourth port (124) are communicated with each other, and another position where the first port (121) and the fourth port (124) are communicated with each other while the second port (122) and the third port (123) are communicated with each other. As stated above, the third port (123) of the four-way selector valve (120) is closed. Thus, in the refrigerant circuit (100) of the present embodiment, the four-way selector valve (120) is used as a three-way valve. Therefore, in this refrigerant circuit (100), the four-way selector valve (120) may be replaced with a three-way valve.

Operating Modes

The operating modes of the humidity control apparatus will now be described. The humidity control apparatus can be switched between a dehumidification mode and a humidification mode. Moreover, the humidity control apparatus performs the dehumidification mode operation or the humidification mode operation by alternately repeating a first operation and a second operation.

Dehumidification Mode

Figure 2:
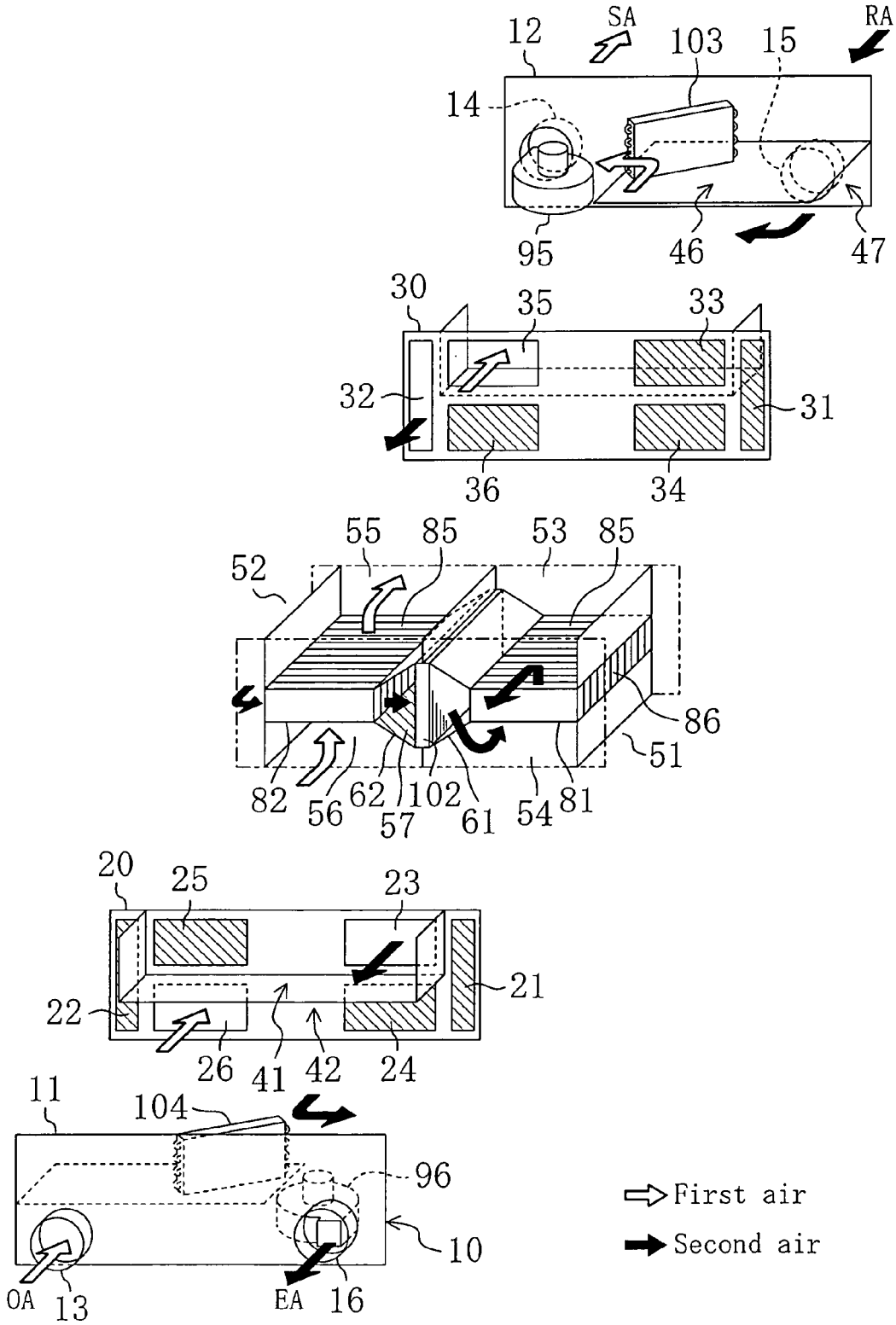
FIG. 2 is an exploded perspective view illustrating the second operation of the dehumidification mode of the humidity control apparatus according to Embodiment 1.

As illustrated in FIG. 1 and FIG. 2, in the dehumidification mode, as the air-supplying fan (95) is operated, the outside air is taken into the casing (10) through the outdoor-side inlet (13). The outside air flows into the outdoor-side lower channel (42) as a first air. As the air-discharging fan (96) is operated, the room air is taken into the casing (10) through the room-side inlet (15). The room air flows into the room-side lower channel (47) as a second air.

In the dehumidification mode, the regenerative heat exchanger (102) in the refrigerant circuit (100) serves as a condenser and the first heat exchanger (103) as an evaporator, while the second heat exchanger (104) is inactive. The operation of the refrigerant circuit (100) will be described later.

The first operation of the dehumidification mode will be described with reference to FIG. 1 and FIG. 5. In the first operation, an adsorption operation for the first adsorbing element (81) and a regeneration operation for the second adsorbing element (82) are performed. Thus, in the first operation, the air is dehumidified through the first adsorbing element (81) while regenerating the adsorbent of the second adsorbing element (82).

As illustrated in FIG. 1, in the first partition (20), the first lower-right opening (24) and the first upper-left opening (25) are in the communicated state, while the remaining openings (21, 22, 23, 26) are in the blocked state. In this state, the outdoor-side lower channel (42) and the lower-right channel (54) are communicated with each other through the first lower-right opening (24), and the upper-left channel (55) and the outdoor-side upper channel (41) are communicated with each other through the first upper-left opening (25).

In the second partition (30), the second right-side opening (31) and the second upper-right opening (33) are in the communicated state, while the remaining openings (32, 34, 35, 36) are in the blocked state. In this state, the room-side lower channel (47) and the right-side channel (51) are communicated with each other through the second right-side opening (31), and the upper-right channel (53) and the room-side upper channel (46) are communicated with each other through the second upper-right opening (33).

The right shutter (61) is in the closed state, and the left shutter (62) is in the open state. In this state, a portion of the center channel (57) on the left of the regenerative heat exchanger (102) is communicated with the lower-left channel (56) via the left shutter (62).

The first air taken into the casing (10) flows from the outdoor-side lower channel (42) into the lower-right channel (54) through the first lower-right opening (24). The second air taken into the casing (10) flows from the room-side lower channel (47)-into the right-side channel (51) through the second right-side opening (31).

Figure 5A:
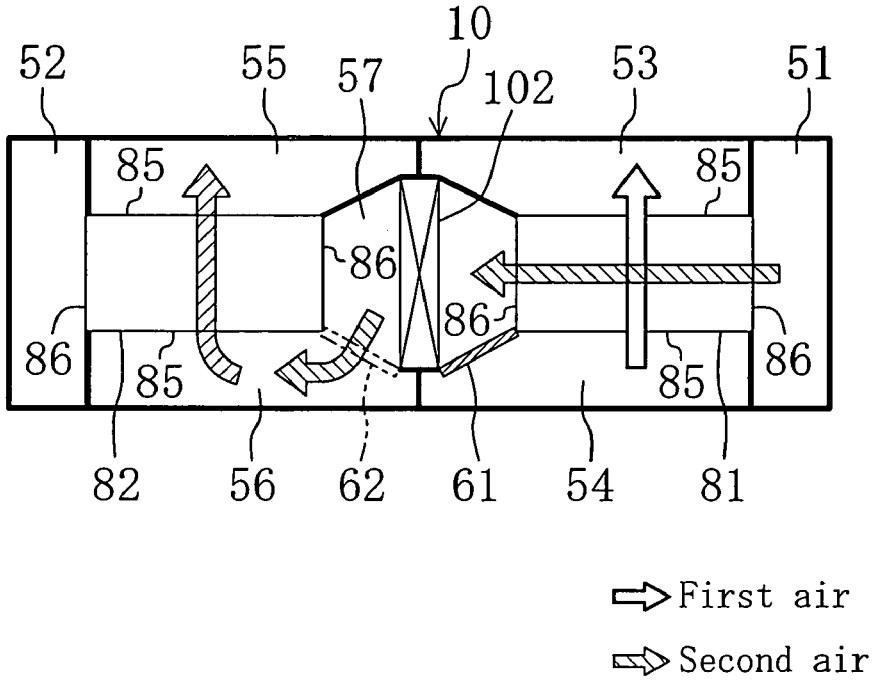
FIGS. 5A and 5B are schematic views illustrating an important part of the humidity control apparatus according to Embodiment 1.

As illustrated also in FIG. 5A, the first air in the lower-right channel (54) flows into the humidity control passageways (85) of the first adsorbing element (81). While the first air flows through the humidity control passageways (85), the water vapor contained therein is adsorbed by the adsorbent. The first air dehumidified through the first adsorbing element (81) flows into the upper-right channel (53).

The second air in the right-side channel (51) flows into the cooling passageways (86) of the first adsorbing element (81). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-left channel (56).

The second air heated through the first adsorbing element (81) and the regenerative heat exchanger (102) is introduced into the humidity control passageways (85) of the second adsorbing element (82). In the humidity control passageways (85), the adsorbent is heated by the second air, whereby water vapor is desorbed from the adsorbent. Thus, the second adsorbing element (82) is regenerated. The water vapor desorbed from the adsorbent flows into the upper-left channel (55) together with the second air.

As illustrated in FIG. 1, the dehumidified first air having flown into the upper-right channel (53) is passed into the room-side upper channel (46) through the second upper-right opening (33). While flowing through the room-side upper channel (46), the first air passes through the first heat exchanger (103), where it is cooled by heat exchange with the refrigerant. Then, the dehumidified and cooled first air is supplied into the room through the room-side outlet (14).

The second air having flown into the upper-left channel (55) flows into the outdoor-side upper channel (41) through the first upper-left opening (25). While flowing through the outdoor-side upper channel (41), the second air passes through the second heat exchanger (104). At this point, the second heat exchanger (104) is inactive, and the second air is neither heated nor cooled. Then, the second air having been used for the cooling of the first adsorbing element (81) and the regeneration of the second adsorbing element (82) is discharged to the outside through the outdoor-side outlet (16).

The second operation of the dehumidification mode will be described with reference to FIG. 2 and FIG. 5. In the second operation, contrary to the first operation, an adsorption operation for the second adsorbing element (82) and a regeneration operation for the first adsorbing element (81) are performed. Thus, in the second operation, the air is dehumidified through the second adsorbing element (82) while regenerating the adsorbent of the first adsorbing element (81).

As illustrated in FIG. 2, in the first partition (20), the first upper-right opening (23) and the first lower-left opening (26) are in the communicated state, while the remaining openings (21, 22, 24, 25) are in the blocked state. In this state, the upper-right channel (53) and the outdoor-side upper channel (41) are communicated with each other through the first upper-right opening (23), and the outdoor-side lower channel (42) and the lower-left channel (56) are communicated with each other through the first lower-left opening (26).

In the second partition (30), the second left-side opening (32) and the second upper-left opening (35) are in the communicated state, while the remaining openings (31, 33, 34, 36) are in the blocked state. In this state, the room-side lower channel (47) and the left-side channel (52) are communicated with each other through the second left-side opening (32), and the upper-left channel (55) and the room-side upper channel (46) are communicated with each other through the second upper-left opening (35).

The left shutter (62) is in the closed state, and the right shutter (61) is in the open state. In this state, a portion of the center channel (57) on the right of the regenerative heat exchanger (102) is communicated with the lower-right channel (54) via the right shutter (61).

The first air taken into the casing (10) flows from the outdoor-side lower channel (42) into the lower-left channel (56) through the first lower-left opening (26). The second air taken into the casing (10) flows from the room-side lower channel (47) into the left-side channel (52) through the second left-side opening (32).

Figure 5B:
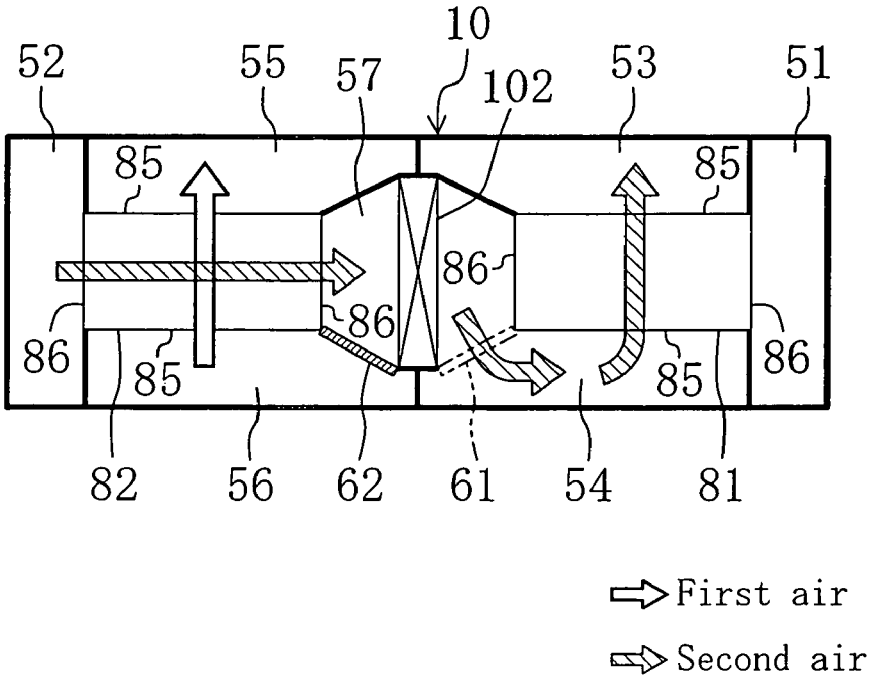

As illustrated also in FIG. 5B, the first air in the lower-left channel (56) flows into the humidity control passageways (85) of the second adsorbing element (82). While the first air flows through the humidity control passageways (85), the water vapor contained therein is adsorbed by the adsorbent. The first air dehumidified through the second adsorbing element (82) flows into the upper-left channel (55).

The second air in the left-side channel (52) flows into the cooling passageways (86) of the second adsorbing element (82). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-right channel (54).

The second air heated through the second adsorbing element (82) and the regenerative heat exchanger (102) is introduced into the humidity control passageways (85) of the first adsorbing element (81). In the humidity control passageways (85), the adsorbent is heated by the second air, whereby water vapor is desorbed from the adsorbent. Thus, the first adsorbing element (81) is regenerated. The water vapor desorbed from the adsorbent flows into the upper-right channel (53) together with the second air.

As illustrated in FIG. 2, the dehumidified first air having flown into the upper-left channel (55) is passed into the room-side upper channel (46) through the second upper-left opening (35). While flowing through the room-side upper channel (46), the first air passes through the first heat exchanger (103), where it is cooled by heat exchange with the refrigerant. Then, the dehumidified and cooled first air is supplied into the room through the room-side outlet (14).

The second air having flown into the upper-right channel (53) flows into the outdoor-side upper channel (41) through the first upper-right opening (23). While flowing through the outdoor-side upper channel (41), the second air passes through the second heat exchanger (104). At this point, the second heat exchanger (104) is inactive, and the second air is neither heated nor cooled. Then, the second air having been used for the cooling of the second adsorbing element (82) and the regeneration of the first adsorbing element (81) is discharged to the outside through the outdoor-side outlet (16).

Humidification Mode

Figure 3:
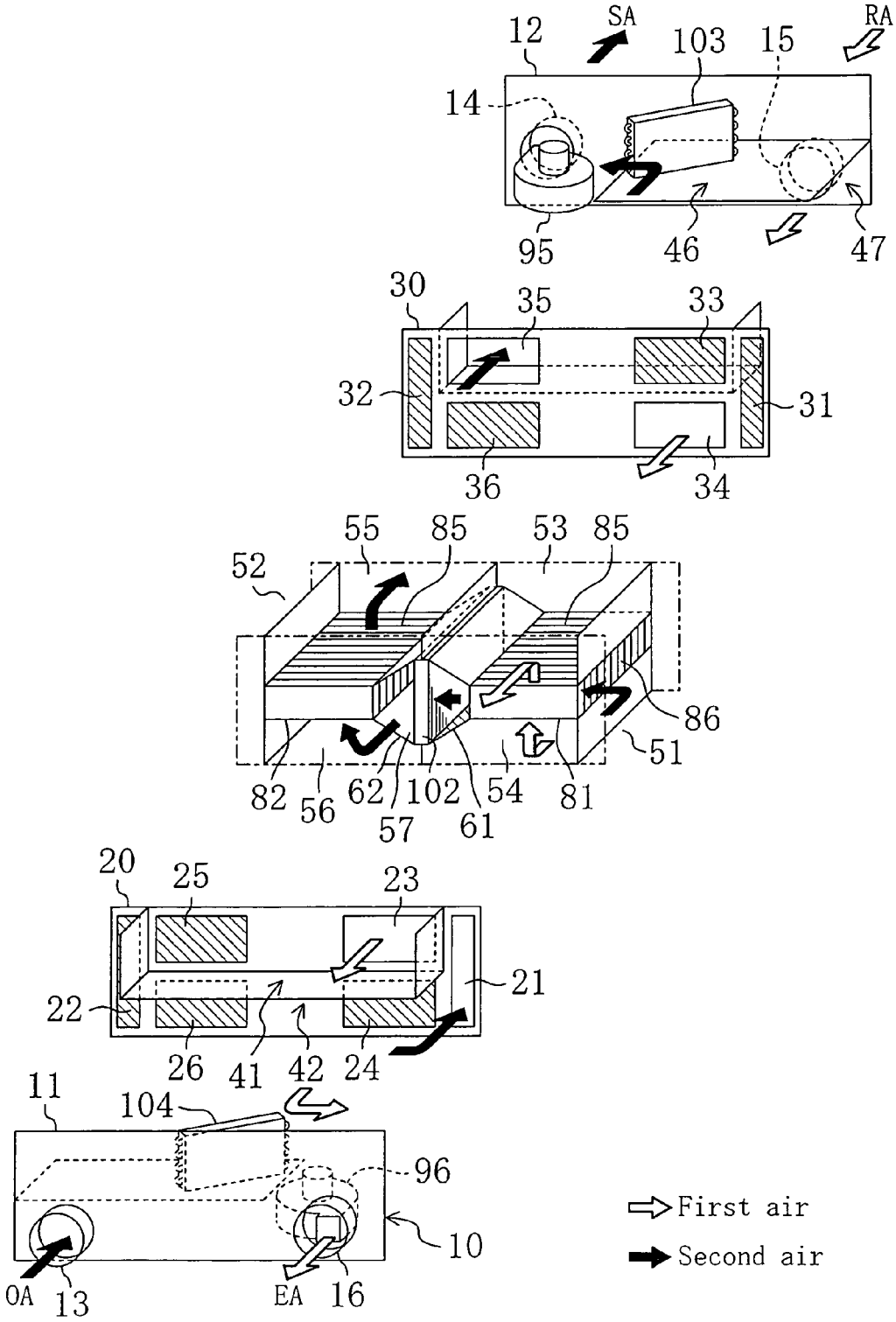
FIG. 3 is an exploded perspective view illustrating the first operation of the humidification mode of the humidity control apparatus according to Embodiment 1.
Figure 4:
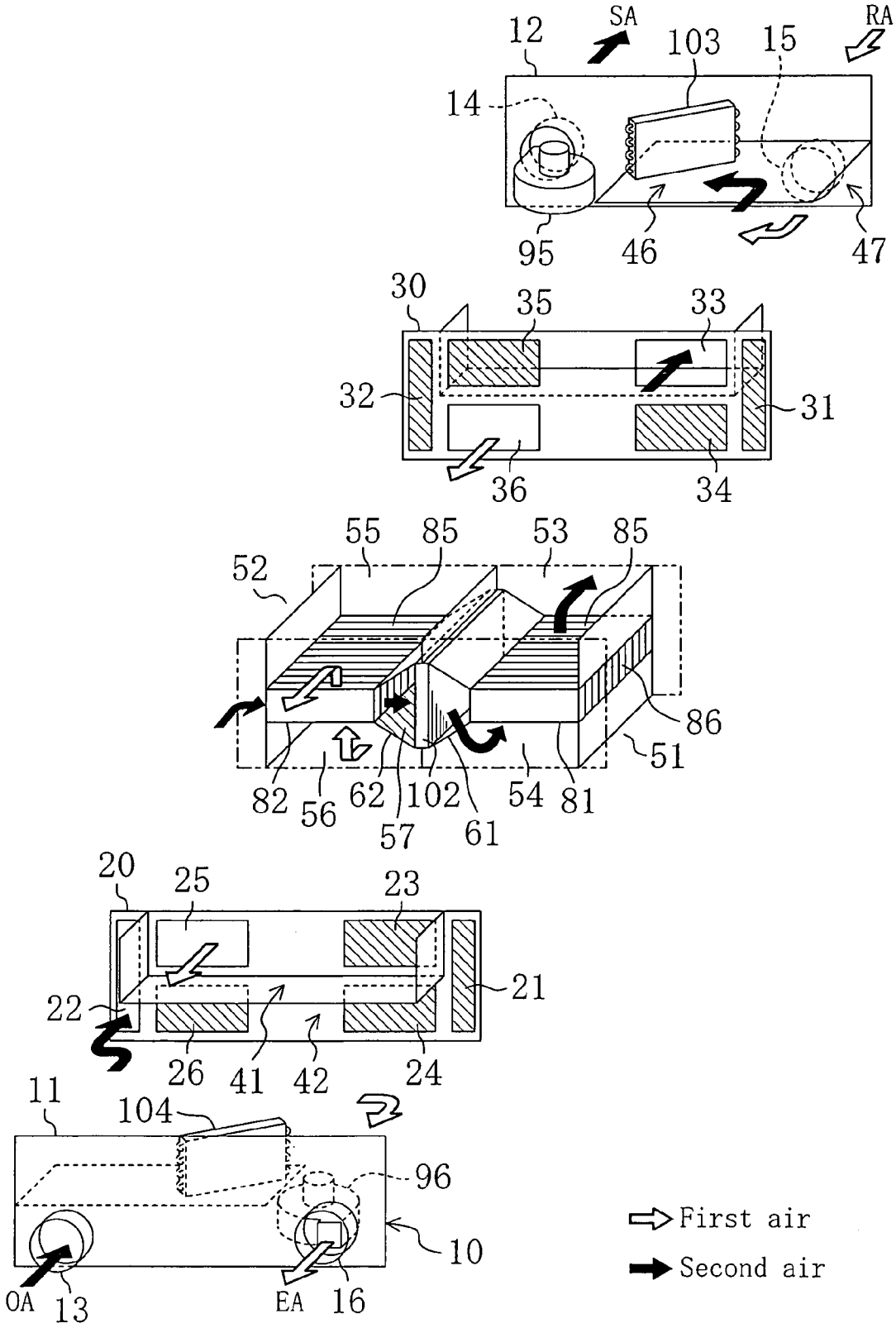
FIG. 4 is an exploded perspective view illustrating the second operation of the humidification mode of the humidity control apparatus according to Embodiment 1.

As illustrated in FIG. 3 and FIG. 4, in the humidification mode, as the air-supplying fan (95) is operated, the outside air is taken into the casing (10) through the outdoor-side inlet (13). The outside air flows into the outdoor-side lower channel (42) as a second air. As the air-discharging fan (96) is operated, the room air is taken into the casing (10) through the room-side inlet (15). The room air flows into the room-side lower channel (47) as a first air.

In the humidification mode, the regenerative heat exchanger (102) in the refrigerant circuit (100) serves as a condenser and the second heat exchanger (104) as an evaporator, while the first heat exchanger (103) is inactive. The operation of the refrigerant circuit (100) will be described later.

The first operation of the humidification mode will be described with reference to FIG. 3 and FIG. 5. In the first operation, an adsorption operation for the first adsorbing element (81) and a regeneration operation for the second adsorbing element (82) are performed. Thus, in the first operation, the air is humidified through the second adsorbing element (82) while adsorbing water vapor by the adsorbent of the first adsorbing element (81).

As illustrated in FIG. 3, in the first partition (20), the first right-side opening (21) and the first upper-right opening (23) are in the communicated state, while the remaining openings (22, 24, 25, 26) are in the blocked state. In this state, the outdoor-side lower channel (42) and the right-side channel (51) are communicated with each other through the first right-side opening (21), and the upper-right channel (53) and the outdoor-side upper channel (41) are communicated with each other through the first upper-right opening (23).

In the second partition (30), the second lower-right opening (34) and the second upper-left opening (35) are in the communicated state, while the remaining openings (31, 32, 33, 36) are in the blocked state. In this state, the room-side lower channel (47) and the lower-right channel (54) are communicated with each other through the second lower-right opening (34), and the upper-left channel (55) and the room-side upper channel (46) are communicated with each other through the second upper-left opening (35).

The right shutter (61) is in the closed state, and the left shutter (62) is in the open state. In this state, a portion of the center channel (57) on the left of the regenerative heat exchanger (102) is communicated with the lower-left channel (56) via the left shutter (62).

The first air taken into the casing (10) flows from the room-side lower channel (47) into the lower-right channel (54) through the second lower-right opening (34). The second air taken into the casing (10) flows from the outdoor-side lower channel (42) into the right-side channel (51) through the first right-side opening (21).

As illustrated also in FIG. 5A, the first air in the lower-right channel (54) flows into the humidity control passageways (85) of the first adsorbing element (81). While the first air flows through the humidity control passageways (85), the water vapor contained therein is adsorbed by the adsorbent. The first air deprived of its moisture through the first adsorbing element (81) flows into the upper-right channel (53).

The second air in the right-side channel (51) flows into the cooling passageways (86) of the first adsorbing element (81). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-left channel (56).

The second air heated through the first adsorbing element (81) and the regenerative heat exchanger (102) is introduced into the humidity control passageways (85) of the second adsorbing element (82). In the humidity control passageways (85), the adsorbent is heated by the second air, whereby water vapor is desorbed from the adsorbent. Thus, the second adsorbing element (82) is regenerated. The water vapor desorbed from the adsorbent is given to the second air, thereby humidifying the second air. The second air humidified through the second adsorbing element (82) then flows into the upper-left channel (55).

As illustrated in FIG. 3, the second air having flown into the upper-left channel (55) flows into the room-side upper channel (46) through the second upper-left opening (35). While flowing through the room-side upper channel (46), the second air passes through the first heat exchanger (103). At this point, the first heat exchanger (103) is inactive, and the first air is neither heated nor cooled. Then, the humidified second air is supplied into the room through the room-side outlet (14).

The first air having flown into the upper-right channel (53) is passed into the outdoor-side upper channel (41) through the first upper-right opening (23). While flowing through the outdoor-side upper channel (41), the first air passes through the second heat exchanger (104), where it is cooled by heat exchange with the refrigerant. Then, the first air deprived of its moisture and heat is discharged to the outside through the outdoor-side outlet (16).

The second operation of the humidification mode will be described with reference to FIG. 4 and FIG. 5. In the second operation, contrary to the first operation, an adsorption operation for the second adsorbing element (82) and a regeneration operation for the first adsorbing element (81) are performed. Thus, in the second operation, the air is humidified through the first adsorbing element (81) while adsorbing water vapor by the adsorbent of the second adsorbing element (82).

As illustrated in FIG. 4, in the first partition (20), the first left-side opening (22) and the first upper-left opening (25) are in the communicated state, while the remaining openings (21, 23, 24, 26) are in the blocked state. In this state, the outdoor-side lower channel (42) and the left-side channel (52) are communicated with each other through the first left-side opening (22), and the upper-left channel (55) and the outdoor-side upper channel (41) are communicated with each other through the first upper-left opening (25).

In the second partition (30), the second upper-right opening (33) and the second lower-left opening (36) are in the communicated state, while the remaining openings (31, 32, 34, 35) are in the blocked state. In this state, the upper-right channel (53) and the room-side upper channel (46) are communicated with each other through the second upper-right opening (33), and the room-side lower channel (47) and the lower-left channel (56) are communicated with each other through the second lower-left opening (36).

The left shutter (62) is in the closed state, and the right shutter (61) is in the open state. In this state, a portion of the center channel (57) on the right of the regenerative heat exchanger (102) is communicated with the lower-right channel (54) via the right shutter (61).

The first air taken into the casing (10) flows from the room-side lower channel (47) into the lower-left channel (56) through the second lower-left opening (36). The second air taken into the casing (10) flows from the outdoor-side lower channel (42) into the left-side channel (52) through the first left-side opening (22).

As illustrated also in FIG. 5B, the first air in the lower-left channel (56) flows into the humidity control passageways (85) of the second adsorbing element (82). While the first air flows through the humidity control passageways (85), the water vapor contained therein is adsorbed by the adsorbent. The first air deprived of its moisture through the second adsorbing element (82) flows into the upper-left channel (55).

The second air in the left-side channel (52) flows into the cooling passageways (86) of the second adsorbing element (82). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-right channel (54).

The first air heated through the second adsorbing element (82) and the regenerative heat exchanger (102) is introduced into the humidity control passageways (85) of the first adsorbing element (81). In the humidity control passageways (85), the adsorbent is heated by the second air, whereby water vapor is desorbed from the adsorbent. Thus, the first adsorbing element (81) is regenerated. The water vapor desorbed from the adsorbent is given to the second air, thereby humidifying the second air. The second air humidified through the first adsorbing element (81) then flows into the upper-right channel (53).

As illustrated in FIG. 4, the second air having flown into the upper-right channel (53) flows into the room-side upper channel (46) through the second upper-right opening (33). While flowing through the room-side upper channel (46), the second air passes through the first heat exchanger (103). At this point, the first heat exchanger (103) is inactive, and the second air is neither heated nor cooled. Then, the humidified second air is supplied into the room through the room-side outlet (14).

The first air having flown into the upper-left channel (55) is passed into the outdoor-side upper channel (41) through the first upper-left opening (25). While flowing through the outdoor-side upper channel (41), the first air passes through the second heat exchanger (104), where it is cooled by heat exchange with the refrigerant. Then, the first air deprived of its moisture and heat is discharged to the outside through the outdoor-side outlet (16).

Operation of Refrigerant Circuit

Figure 8A:
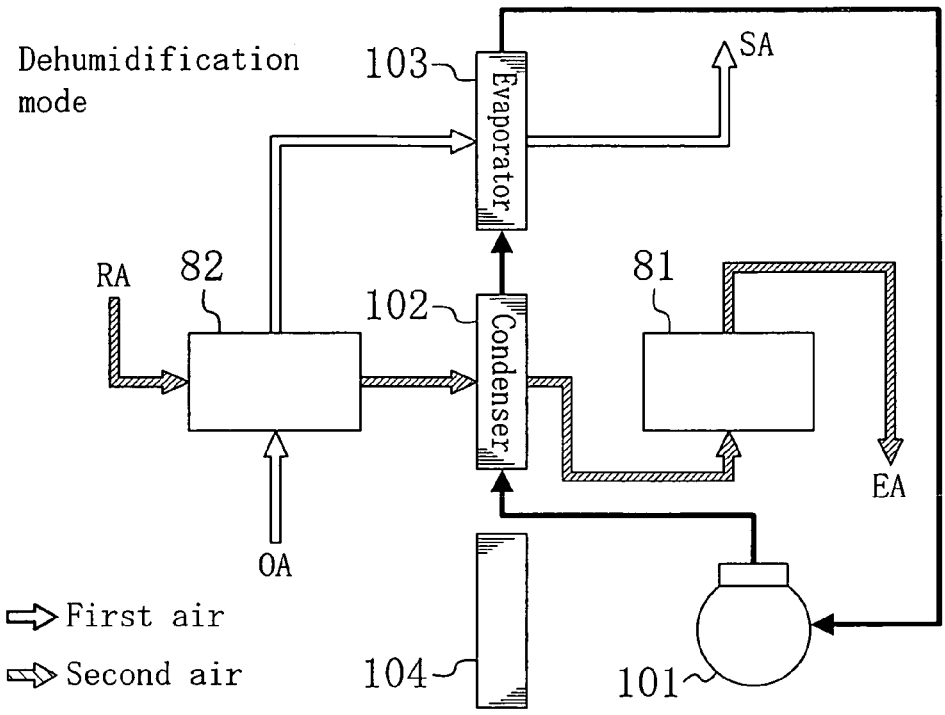
FIGS. 8A and 8B are conceptual diagrams illustrating operating modes of a humidity control apparatus according to Embodiments 1, 2 and 3.
Figure 8B:
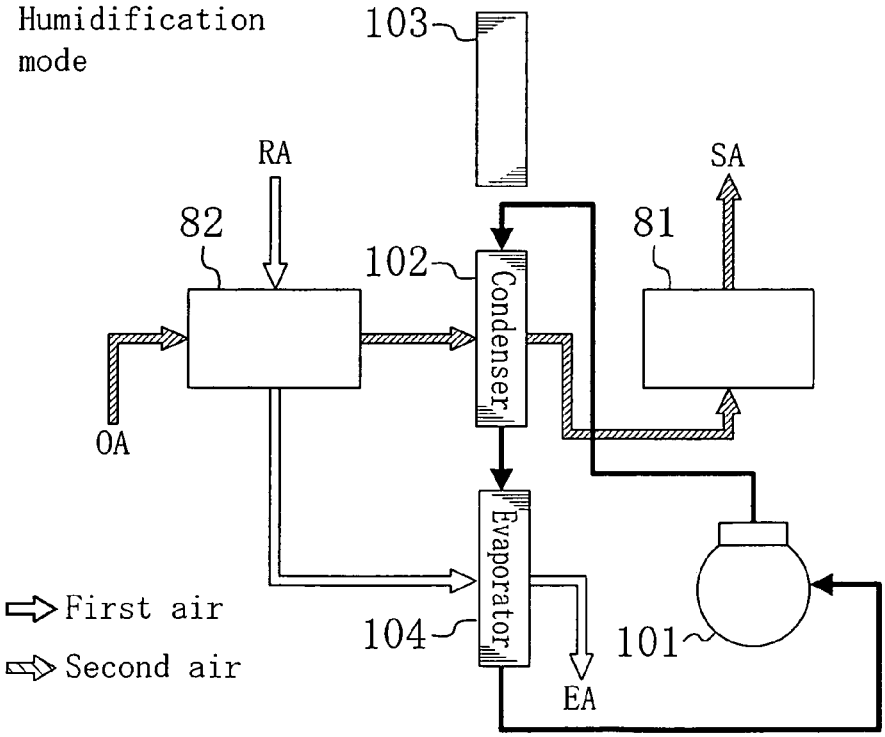

The operation of the refrigerant circuit (100) will be described with reference to FIG. 7 and FIG. 8. Note that the flow of the first air and the flow of the second air illustrated in FIG. 8 are those in the second operation.

The operation in the dehumidification mode will be described. In the dehumidification mode, the four-way selector valve (120) is positioned so that the first port (121) and the fourth port (124) are communicated with each other while the second port (122) and the third port (123) are communicated with each other. Moreover, the degree of opening of the electrically-operated expansion valve (110) is appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser and the first heat exchanger (103) as an evaporator, while the second heat exchanger (104) is inactive (see FIG. 8(*a*)).

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the electrically-operated expansion valve (110) through the receiver (105). The refrigerant is depressurized while passing through the electrically-operated expansion valve (110). The refrigerant depressurized through the electrically-operated expansion valve (110) is passed to the first heat exchanger (103) through the four-way selector valve (120). The refrigerant having flown into the first heat exchanger (103) exchanges heat with the first air, and absorbs heat from the first air to be evaporated. The refrigerant evaporated through the first heat exchanger (103) is taken into, and pressurized in, the compressor (101), and is then discharged from the compressor (101).

The operation in the humidification mode will be described. In humidification mode, the four-way selector valve (120) is positioned so that the first port (121) and the second port (122) are communicated with each other while the third port (123) and the fourth port (124) are communicated with each other. Moreover, the degree of opening of the electrically-operated expansion valve (110) is appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser and the second heat exchanger (104) as an evaporator, while the first heat exchanger (103) is inactive (see FIG. 8B).

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the electrically-operated expansion valve (110) through the receiver (105). The refrigerant is depressurized while passing through the electrically-operated expansion valve (110). The refrigerant depressurized through the electrically-operated expansion valve (110) is passed to the second heat exchanger (104) through the four-way selector valve (120). The refrigerant having flown into the second heat exchanger (104) exchanges heat with the first air, and absorbs heat from the first air to be evaporated. The refrigerant evaporated through the second heat exchanger (104) is taken into, and pressurized in, the compressor (101), and is then discharged from the compressor (101).

Thus, in the humidification mode, the refrigerant circulating through the refrigerant circuit (100) absorbs heat from the first air in the second heat exchanger (104) and radiates heat into the second air in the regenerative heat exchanger (102). In other words, heat is collected in the second heat exchanger (104) from the first air to be discharged to the outside, and the heat collected in the second heat exchanger (104) is used for heating the second air in the regenerative heat exchanger (102).

Effects of Embodiment 1

With the humidity control apparatus of the present embodiment, in the humidification mode in which the humidified second air is supplied into the room while discharging the first air deprived of its moisture to the outside, the refrigerant can exchange heat with the first air in the second heat exchanger (104) serving as an evaporator. Thus, it is possible to avoid a situation where the humidified second air to be supplied into the room is cooled by heat exchange with the refrigerant, whereby the water vapor in the second air is condensed and lost. Therefore, according to the present embodiment, it is possible to maintain a high humidification capacity in a humidity control apparatus capable of supplying the humidified second air into the room.

Moreover, in the humidity control apparatus of the present embodiment, the refrigerant circuit (100) includes the first heat exchanger (103) where heat is exchanged between the air going into the room and the refrigerant, and the second heat exchanger (104) where heat is exchanged between the air going to the outside and the refrigerant, and the humidity control apparatus is switched between a mode in which the first heat exchanger (103) serves as an evaporator and another mode in which the second heat exchanger (104) serves as an evaporator. Therefore, the first heat exchanger (103) and the second heat exchanger (104) can be placed downstream of the position where the flow direction of the first air or the second air is switched between roomward and outward.

Therefore, according to the present embodiment, it is possible to reduce the limitations on the layout of the components of the humidity control apparatus, particularly, the first heat exchanger (103) and the second heat exchanger (104), which may each serve as an evaporator. Thus, it is possible to reliably avoid problems that may occur due to the limitations on the layout of the components, i.e., a decrease in the design freedom of the humidity control apparatus, or the air channels becoming complicated to increase the size of the humidity control apparatus.

The humidity control apparatus of the present embodiment includes a plurality of adsorbing elements (81, 82), and alternately performs the first operation and the second operation. In the first operation, the first air is supplied to the first adsorbing element (81) to perform an adsorption operation while the second air is supplied to the second adsorbing element (82) to perform a regeneration operation. In the second operation, the first air is supplied to the second adsorbing element (82) to perform an adsorption operation while the second air is supplied to the first adsorbing element (81) to perform a regeneration operation.

Where a humidity control apparatus performing such a batch-type operation is provided with only one heat exchanger serving as an evaporator, it will need to be configured as follows. Specifically, it will be necessary to provide a heat exchanger serving as an evaporator along an air channel through which both of the first air from the first adsorbing element (81) and the first air from the second adsorbing element (82) flow, and to form an air channel such that the flow direction of the first air having passed through the heat exchanger can be switched between roomward and outward. Therefore, it is necessary to provide complicated air channels for placing the heat exchanger serving as an evaporator, which may increase the size of the humidity control apparatus.

In contrast, the humidity control apparatus of the present embodiment includes two heat exchangers (103, 104), which may each be an evaporator. Therefore, it is possible to employ a layout in which the first heat exchanger (103) is placed near the room-side outlet (14) in the casing (10) while the second heat exchanger (104) is placed near the outdoor-side outlet (16) in the casing (10). Therefore, according to the present embodiment, the air channels in the humidity control apparatus can be kept simple, and the casing (10) can be formed in a flattened shape.

Moreover, with the humidity control apparatus of the present embodiment, in the dehumidification mode, the first air can be dehumidified and then further cooled through the first heat exchanger (103) before it is supplied into the room. Therefore, the humidity control apparatus can not only control the humidity of, but also cool, the air in the room.

Moreover, with the humidity control apparatus of the present embodiment, in the humidification mode, heat collected from the first air discharged from the second heat exchanger (104) can be used for heating the second air in the regenerative heat exchanger (102). Therefore, with the humidity control apparatus, the internal energy of the first air to be discharged can be efficiently used for the operation of the humidity control apparatus.

The adsorbing element (81, 82) of the present embodiment includes the humidity control passageways (85) through which the air flow is in contact with the adsorbent, and the cooling passageways (86) through which a cooling fluid flows for taking the heat of adsorption generated in the humidity control passageways (85) during the adsorption operation. Moreover, in the humidity control apparatus of the present embodiment, the second air is supplied to, and heated through, the regenerative heat exchanger (102) after passing through the cooling passageways (86) of the adsorbing element (81, 82) as a cooling fluid.

Thus, in the present embodiment, the cooling passageways (86) is formed in the adsorbing element (81, 82), whereby the heat of adsorption generated during the adsorption operation is taken by the second air as a cooling fluid. Therefore, in the adsorbing element (81, 82) during the adsorption operation, it is possible to suppress an increase in the temperature of the first air due to the heat of adsorption generated in the humidity control passageways (85).

Thus, according to the present embodiment, it is possible to prevent an excessive decrease in the relative humidity of the first air flowing through the humidity control passageways (85) of the adsorbing element (81, 82), whereby it is possible to increase the amount of water vapor to be adsorbed by the adsorbing element (81, 82). By increasing the amount of moisture to be adsorbed by the adsorbing element (81, 82), it is possible to improve the capacity of the humidity control apparatus without increasing the size of the humidity control apparatus.

Moreover, in the present embodiment, the second air is first introduced into the cooling passageways (86) of the adsorbing element (81, 82) as a cooling fluid, and then the second air from the cooling passageways (86) is heated through the regenerative heat exchanger (102). Thus, the second air used for the regeneration of the adsorbing element (81, 82) is heated not only through the regenerative heat exchanger (102) but also through the cooling passageways (86) of the adsorbing element (81, 82). Therefore, according to the present embodiment, it is possible to reduce the amount of heat that needs to be given to the second air through the regenerative heat exchanger (102), whereby it is possible to reduce the energy that is required for operating the humidity control apparatus.

Embodiment 2

Embodiment 2 of the present invention is similar to Embodiment 1, except for changes to the configuration of the refrigerant circuit (100). The configuration of the humidity control apparatus of the present embodiment is similar to that of Embodiment 1 except for the refrigerant circuit (100).

Figure 9:
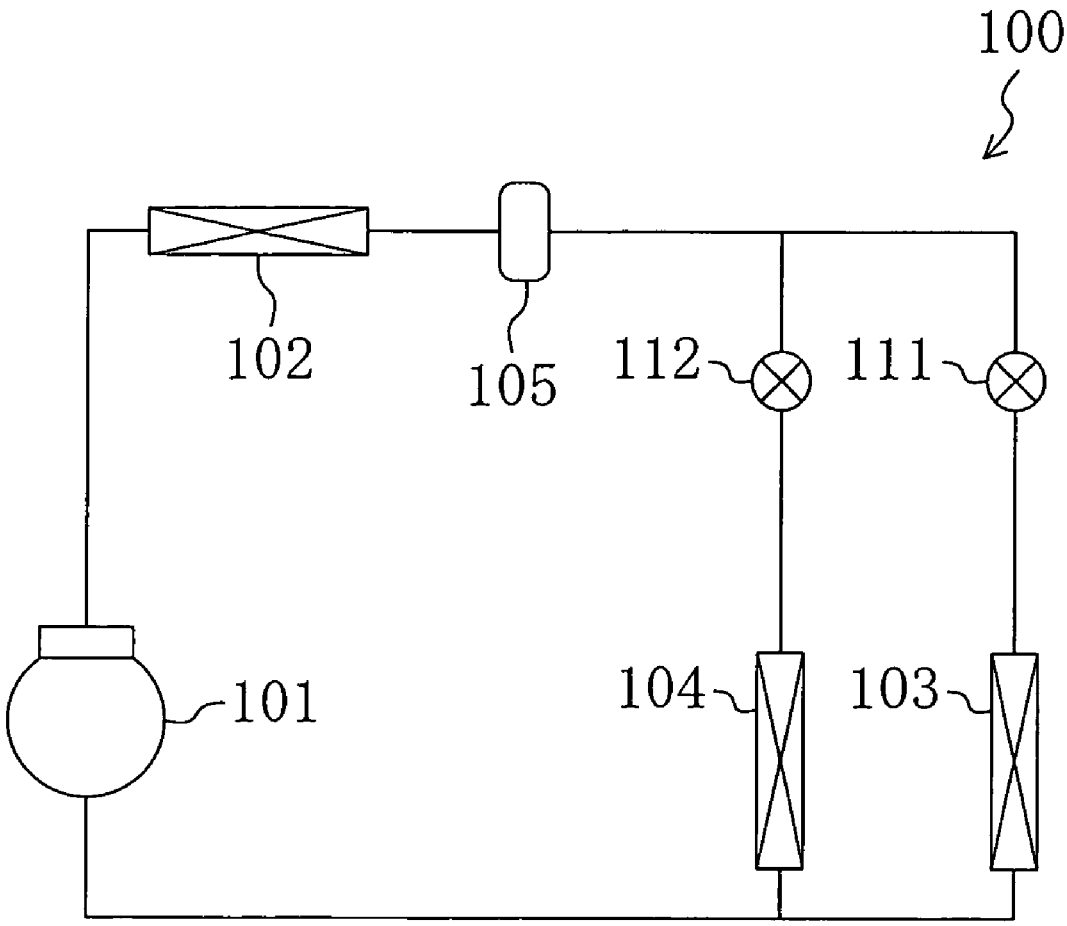
FIG. 9 is a pipe system diagram illustrating the configuration of the refrigerant circuit according to Embodiment 2.

As illustrated in FIG. 9, the refrigerant circuit (100) of the present embodiment is a closed circuit filled with a refrigerant. The refrigerant circuit (100) includes the compressor (101), the regenerative heat exchanger (102), the first heat exchanger (103), the second heat exchanger (104), the receiver (105), a first electrically-operated expansion valve (111) and a second electrically-operated expansion valve (112). In the refrigerant circuit (100), a vapor-compression refrigerating cycle is performed by circulating the refrigerant therethrough.

In the refrigerant circuit (100), the discharge side of the compressor (101) is connected to one end of the regenerative heat exchanger (102). The other end of the regenerative heat exchanger (102) is connected to one end of the first electrically-operated expansion valve (111) and one end of the second electrically-operated expansion valve (112) via the receiver (105). The other end of the first electrically-operated expansion valve (111) is connected to one end of the first heat exchanger (103). The other end of the second electrically-operated expansion valve (112) is connected to one end of the second heat exchanger (104). The other end of the first heat exchanger (103) and the other end of the second heat exchanger (104) are connected to the intake side of the compressor (101).

Operating Modes

The humidity control apparatus of the present embodiment can be switched between a dehumidification mode and a humidification mode. Moreover, the humidity control apparatus performs the dehumidification mode operation or the humidification mode operation by alternately repeating a first operation and a second operation.

Figure 10A:
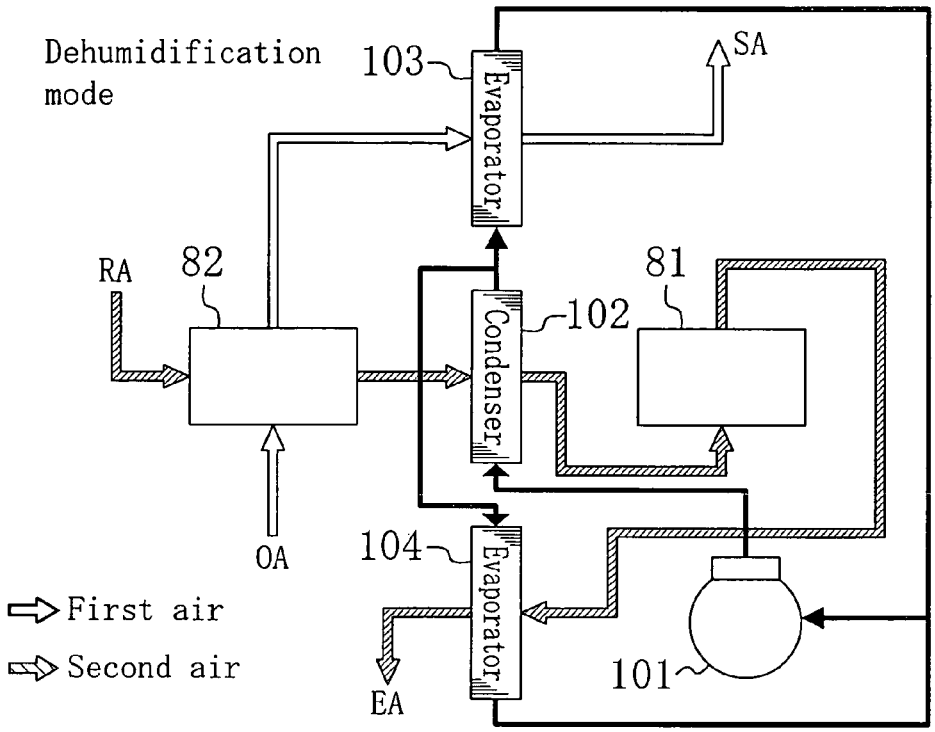
FIGS. 10A and 10B are conceptual diagrams illustrating operating modes of a humidity control apparatus according to Embodiments 2, 3 and 4.
Figure 10B:
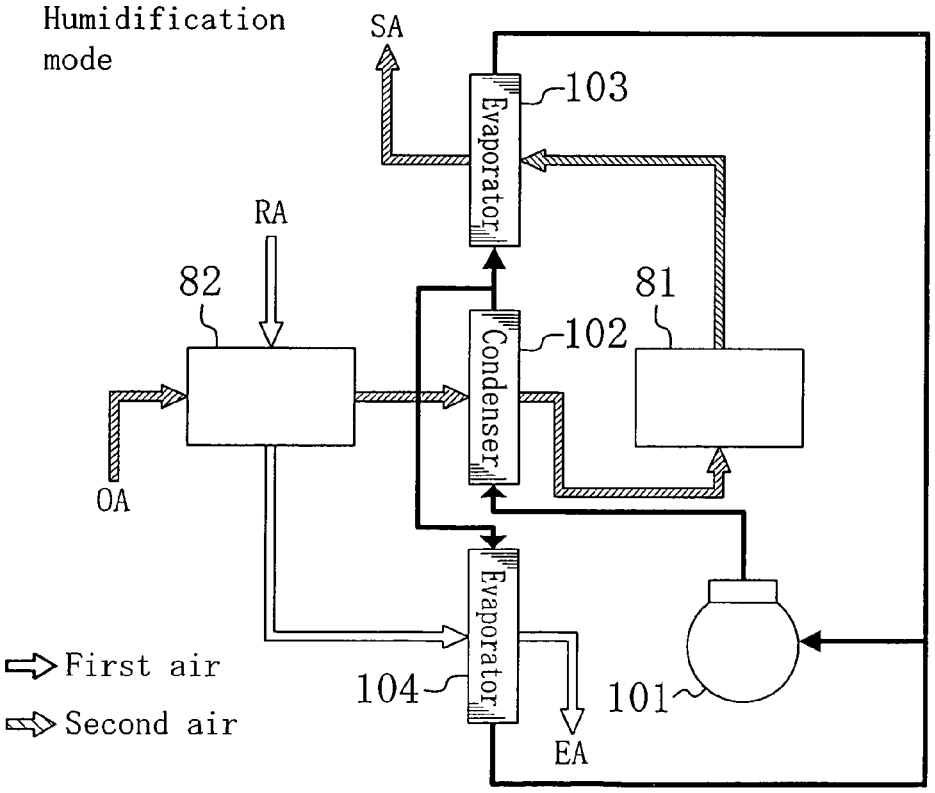

The operating modes of the humidity control apparatus are similar to those of Embodiment 1 except for the operation of the refrigerant circuit (100). The operation of the refrigerant circuit (100) of the present embodiment will now be described with reference to FIG. 8 to FIG. 10. Note that the flow of the first air and the flow of the second air illustrated in FIG. 8 and FIG. 10 are those in the second operation.

Dehumidification Mode

In the dehumidification mode, the refrigerant circuit (100) of the present embodiment can operate in two different operating modes. In the dehumidification mode, the two operating modes are selectively performed.

The first operating mode of the dehumidification mode will be described. In the first operating mode, the degree of opening of the first electrically-operated expansion valve (111) is appropriately adjusted according to the operating conditions. The second electrically-operated expansion valve (112) is in the fully closed state.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser and the first heat exchanger (103) as an evaporator, while the second heat exchanger (104) is inactive (see FIG. 8A). Thus, in the refrigerant circuit (100) in the first operating mode, an operation similar to that in the dehumidification mode of Embodiment 1 is performed.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the first electrically-operated expansion valve (111) through the receiver (105). The refrigerant is depressurized while passing through the first electrically-operated expansion valve (111). The refrigerant depressurized through the first electrically-operated expansion valve (111) is passed to the first heat exchanger (103). The refrigerant having flown into the first heat exchanger (103) exchanges heat with the first air, and absorbs heat from the first air to be evaporated. The refrigerant evaporated through the first heat exchanger (103) is taken into, and pressurized in, the compressor (101), and is then discharged from the compressor (101).

The second operating mode of the dehumidification mode will be described. In the second operating mode, the degree of opening of the first electrically-operated expansion valve (111) and that of the second electrically-operated expansion valve (112) are appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 10A). Moreover, the first heat exchanger (103) and the second heat exchanger (104) are in parallel to each other in the direction in which the refrigerant circulates. Thus, in the refrigerant circuit (100) in the second operating mode, heat is exchanged between the refrigerant and the second air through the second heat exchanger (104), unlike in the dehumidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) passes through the receiver (105), and is then split into two flows. One of the split refrigerant flows is passed to the first electrically-operated expansion valve (111), and the other to the second electrically-operated expansion valve (112).

The refrigerant passed to the first electrically-operated expansion valve (111) is depressurized while passing through the first electrically-operated expansion valve (111), and is then passed to the first heat exchanger (103). The refrigerant having flown into the first heat exchanger (103) exchanges heat with the first air, and absorbs heat from the first air to be evaporated. The refrigerant passed to the second electrically-operated expansion valve (112) is depressurized while passing through the second electrically-operated expansion valve (112), and is then passed to the second heat exchanger (104). The refrigerant having flown into the second heat exchanger (104) exchanges heat with the second air, and absorbs heat from the second air to be evaporated. The refrigerant evaporated through the first heat exchanger (103) and the refrigerant evaporated through the second heat exchanger (104) merge into one flow, which is taken into, and pressurized in, the compressor (101), and is then discharged from the compressor (101).

The refrigerant circulating through the refrigerant circuit (100) in the second operating mode absorbs heat from the second air in the second heat exchanger (104) and radiates heat into the second air in the regenerative heat exchanger (102). In other words, heat is collected in the second heat exchanger (104) from the second air to be discharged to the outside, and the heat collected in the second heat exchanger (104) is reused for heating the second air in the regenerative heat exchanger (102).

Humidification Mode

In the humidification mode, the refrigerant circuit (100) of the present embodiment can operate in two different operating modes. In the humidification mode, the two operating modes are selectively performed.

The first operating mode of the humidification mode will be described. In the first operating mode, the degree of opening of the second electrically-operated expansion valve (112) is appropriately adjusted according to the operating conditions. The first electrically-operated expansion valve (111) is in the fully closed state.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser and the second heat exchanger (104) as an evaporator, while the first heat exchanger (103) is inactive (see FIG. 8B). Thus, in the refrigerant circuit (100) in the first operating mode, an operation similar to that in the humidification mode of Embodiment 1 is performed.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the second electrically-operated expansion valve (112) through the receiver (105). The refrigerant is depressurized while passing through the second electrically-operated expansion valve (112). The refrigerant depressurized through the second electrically-operated expansion valve (112) is passed to the second heat exchanger (104). The refrigerant having flown into the second heat exchanger (104) exchanges heat with the first air, and absorbs heat from the first air to be evaporated. The refrigerant evaporated through the second heat exchanger (104) is taken into, and pressurized in, the compressor (101), and is then discharged from the compressor (101).

The second operating mode of the humidification mode will be described. In the second operating mode, the degree of opening of the first electrically-operated expansion valve (111) and that of the second electrically-operated expansion valve (112) are appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 10B). Moreover, the first heat exchanger (103) and the second heat exchanger (104) are in parallel to each other in the direction in which the refrigerant circulates. Thus, in the refrigerant circuit (100) in the second operating mode, heat is exchanged between the refrigerant and the second air through the first heat exchanger (103), unlike in the humidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) passes through the receiver (105), and is then split into two flows. One of the split refrigerant flows is passed to the first electrically-operated expansion valve (111), and the other to the second electrically-operated expansion valve (112).

The refrigerant passed to the first electrically-operated expansion valve (111) is depressurized while passing through the first electrically-operated expansion valve (111), and is then passed to the first heat exchanger (103). The refrigerant having flown into the first heat exchanger (103) exchanges heat with the second air, and absorbs heat from the second air to be evaporated. The refrigerant passed to the second electrically-operated expansion valve (112) is depressurized while passing through the second electrically-operated expansion valve (112), and is then passed to the second heat exchanger (104). The refrigerant having flown into the second heat exchanger (104) exchanges heat with the first air, and absorbs heat from the first air to be evaporated. The refrigerant evaporated through the first heat exchanger (103) and the refrigerant evaporated through the second heat exchanger (104) merge into a single flow, which is taken into, and pressurized in, the compressor (101), and is then discharged from the compressor (101).

In the second operating mode, the humidified second air is cooled through the first heat exchanger (103) and is then supplied into the room. At this point, it is preferred to prevent the moisture in the second air from forming dews in the first heat exchanger (103) and to prevent a decrease in the amount of humidification. Therefore, in the second operating mode, it is preferred that the refrigerant flow rate through the first heat exchanger (103) is set to be lower than the refrigerant flow rate through the second heat exchanger (104) to suppress the amount of heat absorbed by the refrigerant through the first heat exchanger (103).

Moreover, in the first and second operating modes of the humidification mode, the refrigerant circulating through the refrigerant circuit (100) absorbs heat from the first air in the second heat exchanger (104) and radiates heat into the second air in the regenerative heat exchanger (102). In other words, heat is collected in the second heat exchanger (104) from the first air to be discharged to the outside, and the heat collected in the second heat exchanger (104) is used for heating the second air in the regenerative heat exchanger (102).

Effects of Embodiment 2

According to the present embodiment, the following effects are realized in addition to those obtained in Embodiment 1.

Specifically, with the humidity control apparatus of the present embodiment, in the dehumidification mode, heat collected from the second air to be discharged can be reused for heating the second air in the regenerative heat exchanger (102). Therefore, with the humidity control apparatus, the internal energy of the second air to be discharged can be efficiently used for the operation of the humidity control apparatus.

Moreover, with the humidity control apparatus of the present embodiment, in the humidification mode, heat collected from the first air to be discharged can be used for heating the first air in the regenerative heat exchanger (102). Therefore, with the humidity control apparatus, the internal energy of the first air to be discharged can be efficiently used for the operation of the humidity control apparatus.

Moreover, with the humidity control apparatus of the present embodiment, in the second operating mode of the humidification mode, the second air can be humidified and then further cooled before it is supplied into the room. Therefore, the humidity control apparatus makes possible an operation that is suitable for a case where the user wishes to humidify the air in the room without increasing the temperature thereof.

Moreover, in the second operating mode of the humidification mode, both the first heat exchanger (103) and the second heat exchanger (104) function as an evaporator. Therefore, as compared with the first operating mode in which only the second heat exchanger (104) serves as an evaporator, the refrigerant evaporation temperature in the second heat exchanger (104) can be set to be high without reducing the amount of heat absorbed by the refrigerant in the refrigerating cycle. Thus, it is possible to prevent frosting on the second heat exchanger (104), and to prevent the humidification mode operation from being discontinued for defrosting, thereby improving the humidification capacity.

Embodiment 3

Embodiment 3 of the present invention is similar to Embodiment 1, except for changes to the configuration of the refrigerant circuit (100). The configuration of the humidity control apparatus of the present embodiment is similar to that of Embodiment 1 except for the refrigerant circuit (100).

Figure 11:
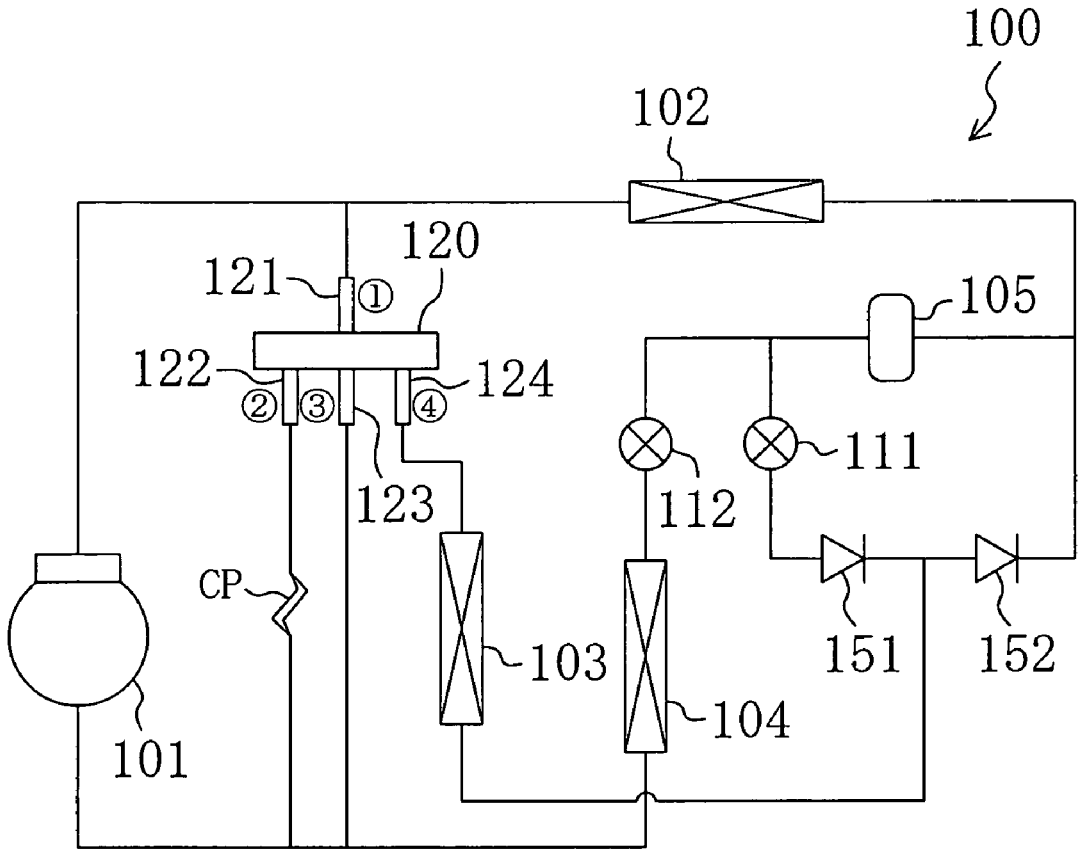
FIG. 11 is a pipe system diagram illustrating the configuration of the refrigerant circuit according to Embodiment 3.

As illustrated in FIG. 11, the refrigerant circuit (100) of the present embodiment is a closed circuit filled with a refrigerant. The refrigerant circuit (100) includes the compressor (101), the regenerative heat exchanger (102), the first heat exchanger (103), the second heat exchanger (104), the receiver (105) and the four-way selector valve (120). Moreover, the refrigerant circuit (100) includes two electrically-operated expansion valves (111, 112) and two check valves (151, 152). In the refrigerant circuit (100), a vapor-compression refrigerating cycle is performed by circulating the refrigerant therethrough.

In the refrigerant circuit (100), the discharge side of the compressor (101) is connected to one end of the regenerative heat exchanger (102) and to the first port (121) of the four-way selector valve (120). The other end of the regenerative heat exchanger (102) is connected to one end of the first electrically-operated expansion valve (111) and one end of the second electrically-operated expansion valve (112) via the receiver (105).

The other end of the first electrically-operated expansion valve (111) is connected to one end of the first heat exchanger (103) via the first check valve (151). The other end of the first heat exchanger (103) is connected to the fourth port (124) of the four-way selector valve (120). Moreover, the second check valve (152) is provided along a pipe connecting a point between the first check valve (151) and the first heat exchanger (103) with another point between the regenerative heat exchanger (102) and the receiver (105). The first check valve (151) is placed so as to only allow the refrigerant flow from the first electrically-operated expansion valve (111) toward the first heat exchanger (103). The second check valve (152) is placed so as to only allow the refrigerant flow from the first heat exchanger (103) toward the receiver (105).

The other end of the second electrically-operated expansion valve (112) is connected to one end of the second heat exchanger (104). The other end of the second heat exchanger (104) and the third port (123) of the four-way selector valve (120) are connected to the intake side of the compressor (101). Moreover, the second port (122) of the four-way selector valve (120) is connected to the intake side of the compressor (101) via a capillary tube (CP).

The four-way selector valve (120) can be switched between a position where the first port (121) and the second port (122) are communicated with each other while the third port (123) and the fourth port (124) are communicated with each other, and another position where the first port (121) and the fourth port (124) are communicated with each other while the second port (122) and the third port (123) are communicated with each other.

Note that while the second port (122) of the four-way selector valve (120) is connected to the intake side of the compressor (101) via the capillary tube (CP) in the refrigerant circuit (100), this is for the purpose of avoiding a liquid-sealed state. Specifically, the second port (122) of the four-way selector valve (120) is substantially closed, and the four-way selector valve (120) is used as a three-way valve in the refrigerant circuit (100). Therefore, in this refrigerant circuit (100), the four-way selector valve (120) may be replaced with a three-way valve.

Operating Modes

The humidity control apparatus of the present embodiment can be switched between a dehumidification mode and a humidification mode. Moreover, the humidity control apparatus performs the dehumidification mode operation or the humidification mode operation by alternately repeating a first operation and a second operation.

Figure 12:
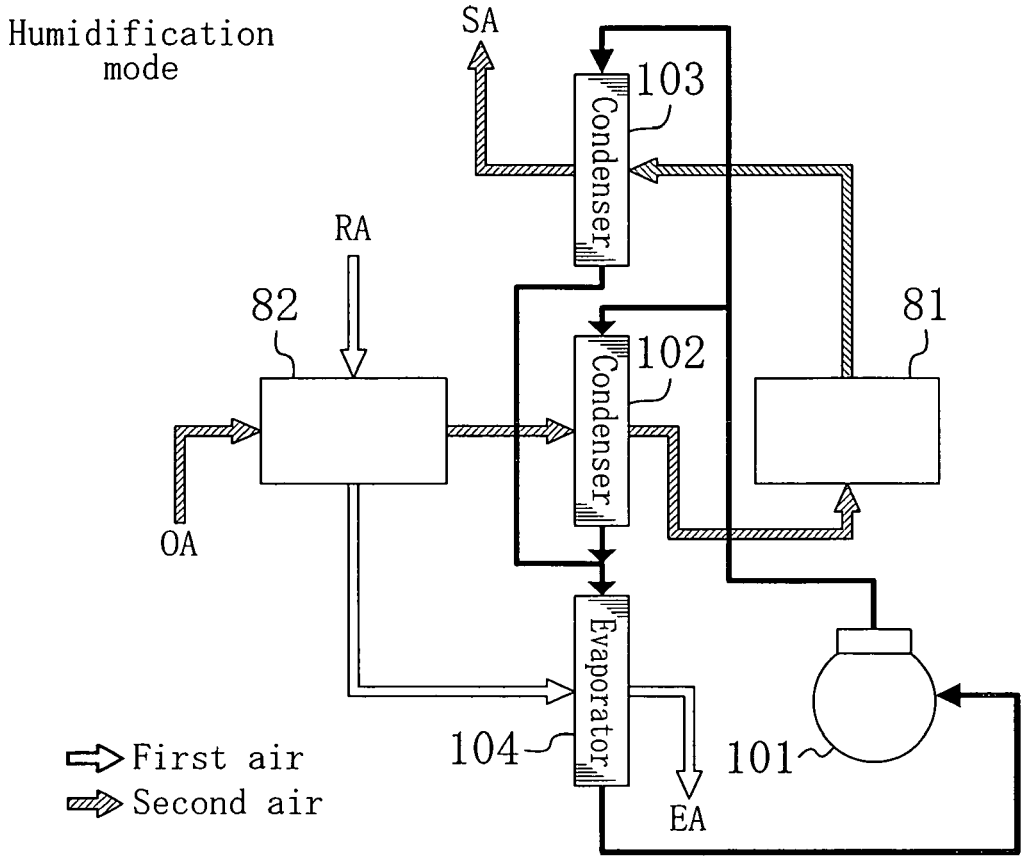
FIG. 12 is a conceptual diagram illustrating an operating mode of the humidity control apparatus according to Embodiment 3.

The operating modes of the humidity control apparatus are similar to those of Embodiment 1 except for the operation of the refrigerant circuit (100). The operation of the refrigerant circuit (100) of the present embodiment will now be described with reference to FIG. 8 and FIG. 10 to FIG. 12. Note that the flow of the first air and the flow of the second air illustrated in FIG. 8, FIG. 10 and FIG. 12 are those in the second operation.

Dehumidification Mode

In the dehumidification mode, the refrigerant circuit (100) of the present embodiment can operate in two different operating modes. In the dehumidification mode, the two operating modes are selectively performed.

The first operating mode of the dehumidification mode will be described. In the first operating mode, the four-way selector valve (120) is positioned so that the first port (121) and the second port (122) are communicated with each other while the third port (123) and the fourth port (124) are communicated with each other. Moreover, the degree of opening of the first electrically-operated expansion valve (111) is appropriately adjusted according to the operating conditions, and the second electrically-operated expansion valve (112) is in the fully closed state.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser and the first heat exchanger (103) as an evaporator, while the second heat exchanger (104) is inactive (see FIG. 8A). Thus, in the refrigerant circuit (100) in the first operating mode, an operation similar to that in the dehumidification mode of Embodiment 1 is performed.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the first electrically-operated expansion valve (111) through the receiver (105). The refrigerant is depressurized while passing through the first electrically-operated expansion valve (111), and is then passed to the first heat exchanger (103) through the first check valve (151). The refrigerant having flown into the first heat exchanger (103) exchanges heat with the first air, and absorbs heat from the first air to be evaporated. The refrigerant evaporated through the first heat exchanger (103) is taken into the compressor (101) through the four-way selector valve (120). The refrigerant taken into the compressor (101) is pressurized and then discharged therefrom.

The second operating mode of the dehumidification mode will be described. In the second operating mode, the first port (121) and the second port (122) are communicated with each other while the third port (123) and the fourth port (124) are communicated with each other. Moreover, the degree of opening of the first electrically-operated expansion valve (111) and that of the second electrically-operated expansion valve (112) are appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 10A). Moreover, the first heat exchanger (103) and the second heat exchanger (104) are in parallel to each other in the direction in which the refrigerant circulates. Thus, in the refrigerant circuit (100) in the second operating mode, heat is exchanged between the refrigerant and the second air through the second heat exchanger (104), unlike in the dehumidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) passes through the receiver (105), and is then split into two flows. One of the split refrigerant flows is passed to the first electrically-operated expansion valve (111), and the other to the second electrically-operated expansion valve (112).

The refrigerant passed to the first electrically-operated expansion valve (111) is depressurized while passing through the first electrically-operated expansion valve (111), and is then passed to the first heat exchanger (103) through the first check valve (151). The refrigerant having flown into the first heat exchanger (103) exchanges heat with the first air, and absorbs heat from the first air to be evaporated. The refrigerant evaporated through the first heat exchanger (103) is taken into the compressor (101) through the four-way selector valve (120).

The refrigerant passed to the second electrically-operated expansion valve (112) is depressurized while passing through the second electrically-operated expansion valve (112), and is then passed to the second heat exchanger (104). The refrigerant having flown into the second heat exchanger (104) exchanges heat with the second air, and absorbs heat from the second air to be evaporated. The refrigerant evaporated through the second heat exchanger (104) merges with the refrigerant evaporated through the first heat exchanger (103) into a single flow, which is then taken into the compressor (101). The refrigerant taken into the compressor (101) is pressurized and then discharged therefrom.

The refrigerant circulating through the refrigerant circuit (100) in the second operating mode absorbs heat from the second air in the second heat exchanger (104) and radiates heat into the second air in the regenerative heat exchanger (102). In other words, heat is collected in the second heat exchanger (104) from the second air to be discharged to the outside, and the heat collected in the second heat exchanger (104) is reused for heating the second air in the regenerative heat exchanger (102).

Humidification Mode

In the humidification mode, the refrigerant circuit (100) of the present embodiment can operate in three different operating modes. In the humidification mode, the three operating modes are selectively performed.

The first operating mode of the humidification mode will be described. In the first operating mode, the four-way selector valve (120) is positioned so that the first port (121) and the second port (122) are communicated with each other while the third port (123) and the fourth port (124) are communicated with each other. Moreover, the first electrically-operated expansion valve (111) is in the fully closed state, and the degree of opening of the second electrically-operated expansion valve (112) is appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser and the second heat exchanger (104) as an evaporator, while the first heat exchanger (103) is inactive (see FIG. 8B). Thus, in the refrigerant circuit (100) in the first operating mode, an operation similar to that in the humidification mode of Embodiment 1 is performed.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the second electrically-operated expansion valve (112) through the receiver (105). The refrigerant is depressurized while passing through the second electrically-operated expansion valve (112), and is then passed to the second heat exchanger (104). The refrigerant having flown into the second heat exchanger (104) exchanges heat with the first air, and absorbs heat from the first air to be evaporated. The refrigerant evaporated through the second heat exchanger (104) is taken into, and pressurized in, the compressor (101), and is then discharged from the compressor (101).

The second operating mode of the humidification mode will be described. In the second operating mode, the first port (121) and the second port (122) are communicated with each other while the third port (123) and the fourth port (124) are communicated with each other. Moreover, the degree of opening of the first electrically-operated expansion valve (111) and that of the second electrically-operated expansion valve (112) are appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 10B). Moreover, the first heat exchanger (103) and the second heat exchanger (104) are in parallel to each other in the direction in which the refrigerant circulates. Thus, in the refrigerant circuit (100) in the second operating mode, heat is exchanged between the refrigerant and the second air through the first heat exchanger (103), unlike in the humidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) passes through the receiver (105), and is then split into two flows. One of the split refrigerant flows is passed to the first electrically-operated expansion valve (111), and the other to the second electrically-operated expansion valve (112).

The refrigerant passed to the first electrically-operated expansion valve (111) is depressurized while passing through the first electrically-operated expansion valve (111), and is then passed to the first heat exchanger (103) through the first check valve (151). The refrigerant having flown into the first heat exchanger (103) exchanges heat with the second air, and absorbs heat from the second air to be evaporated. The refrigerant evaporated through the first heat exchanger (103) is taken into the compressor (101) through the four-way selector valve (120).

The refrigerant passed to the second electrically-operated expansion valve (112) is depressurized while passing through the second electrically-operated expansion valve (112), and is then passed to the second heat exchanger (104). The refrigerant having flown into the second heat exchanger (104) exchanges heat with the first air, and absorbs heat from the first air to be evaporated. The refrigerant evaporated through the second heat exchanger (104) merges with the refrigerant evaporated through the first heat exchanger (103) into a single flow, which is then taken into the compressor (101). The refrigerant taken into the compressor (101) is pressurized and then discharged therefrom.

In the second operating mode, the humidified second air is cooled through the first heat exchanger (103) and is then supplied into the room. At this point, it is preferred to prevent the moisture in the second air from forming dews in the first heat exchanger (103) and to prevent a decrease in the amount of humidification. Therefore, in the second operating mode, it is preferred that the refrigerant flow rate through the first heat exchanger (103) is set to be lower than the refrigerant flow rate through the second heat exchanger (104) to suppress the amount of heat absorbed by the refrigerant through the first heat exchanger (103).

The third operating mode of the humidification mode will be described. In the third operating mode, the four-way selector valve (120) is positioned so that the first port (121) and the fourth port (124) are communicated with each other while the second port (122) and the third port (123) are communicated with each other. Moreover, the first electrically-operated expansion valve (111) is in the fully closed state, and the degree of opening of the second electrically-operated expansion valve (112) is appropriately adjusted according to the operating conditions.

As the compressor (101) is operated in this state, the refrigerant circulates through the refrigerant circuit (100), thus performing a refrigerating cycle. Then, in the refrigerant circuit (100), the regenerative heat exchanger (102) and the first heat exchanger (103) both serve as a condenser and the second heat exchanger (104) as an evaporator (see FIG. 12). Moreover, the regenerative heat exchanger (102) and the first heat exchanger (103) are in parallel to each other in the direction in which the refrigerant circulates. Thus, in the refrigerant circuit (100) in the second operating mode, heat is exchanged between the refrigerant and the second air through the first heat exchanger (103), unlike in the humidification mode of Embodiment 1.

Specifically, the refrigerant discharged from the compressor (101) is split into two flows. One of the split refrigerant flows is passed to the regenerative heat exchanger (102), and the other to the first heat exchanger (103) through the four-way selector valve (120).

The refrigerant having flown into the regenerative heat exchanger (102) exchanges heat with the second air, and radiates heat into the second air to be condensed. The refrigerant condensed through the regenerative heat exchanger (102) flows into the receiver (105). The refrigerant having flown into the first heat exchanger (103) exchanges heat with the second air, and radiates heat into the second air to be condensed. The refrigerant condensed through the first heat exchanger (103) passes through the second check valve (152) and flows into the receiver (105) together with the refrigerant condensed through the regenerative heat exchanger (102).

The refrigerant flowing out of the receiver (105) is passed to the second electrically-operated expansion valve (112). The refrigerant is depressurized while passing through the second electrically-operated expansion valve (112), and is then passed to the second heat exchanger (104). The refrigerant having flown into the second heat exchanger (104) exchanges heat with the first air, and absorbs heat from the first air to be evaporated. The refrigerant evaporated through the second heat exchanger (104) is taken into, and pressurized in, the compressor (101), and is then discharged from the compressor (101).

In the third operating mode, the refrigerant radiates heat, in the first heat exchanger (103), into the second air having passed through the adsorbing elements (81, 82). Thus, the second air is humidified through the adsorbing elements (81, 82) and then further heated through the first heat exchanger (103) before it is supplied into the room.

In the first, second and third operating modes of the humidification mode, the refrigerant circulating through the refrigerant circuit (100) absorbs heat from the first air in the second heat exchanger (104) and radiates heat into the second air in the regenerative heat exchanger (102). In other words, heat is collected in the second heat exchanger (104) from the first air to be discharged to the outside, and the heat collected in the second heat exchanger (104) is used for heating the second air in the regenerative heat exchanger (102).

Effects of Embodiment 3

According to the present embodiment, the following effects are realized in addition to those obtained in Embodiments 1 and 2.

Specifically, with the humidity control apparatus of the present embodiment, in the third operating mode of the humidification mode, the second air can be humidified and then further heated before it is supplied into the room. Therefore, the humidity control apparatus can not only control the humidity of, but also heat, the air in the room. Moreover, in the refrigerant circuit (100) in this mode, the regenerative heat exchanger (102) and the first heat exchanger (103), which both serve as a condenser, are parallel to each other. Therefore, as compared with a case where the regenerative heat exchanger (102) and the first heat exchanger (103) both serving as a condenser are in series with each other, the amount of heat to be given from the refrigerant to the second air through the first heat exchanger (103) can be increased, thus ensuring a sufficient heating capacity.

Embodiment 4

Embodiment 4 of the present invention is similar to Embodiment 1, except for changes to the configuration of the refrigerant circuit (100). The configuration of the humidity control apparatus of the present embodiment is similar to that of Embodiment 1 except for the refrigerant circuit (100).

Figure 13:
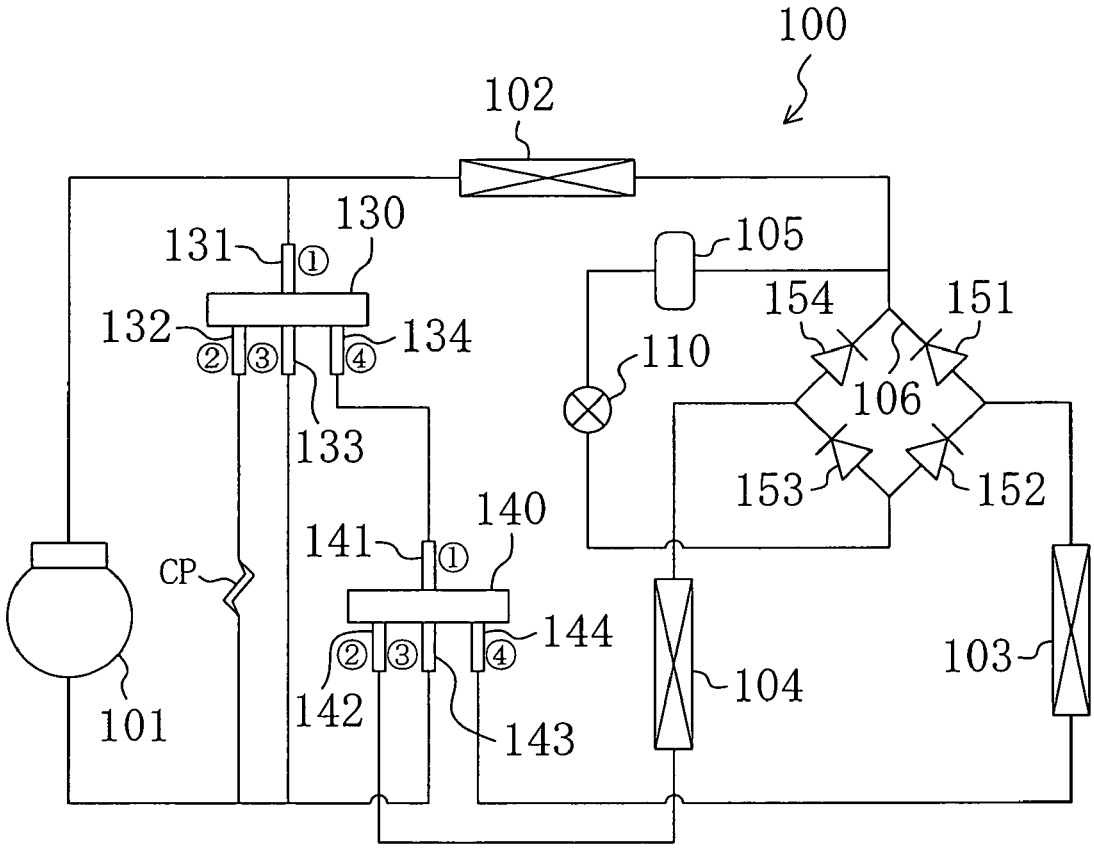
FIG. 13 is a pipe system diagram illustrating the configuration of the refrigerant circuit according to Embodiment 4.

As illustrated in FIG. 13, the refrigerant circuit (100) of the present embodiment is a closed circuit filled with a refrigerant. The refrigerant circuit (100) includes the compressor (101), the regenerative heat exchanger (102), the first heat exchanger (103), the second heat exchanger (104), the receiver (105) and a bridge circuit (106). Moreover, the refrigerant circuit (100) includes one electrically-operated expansion valve (110) and two four-way selector valves (130, 140). In the refrigerant circuit (100), a vapor-compression refrigerating cycle is performed by circulating the refrigerant therethrough.

In the refrigerant circuit (100), the discharge side of the compressor (101) is connected to one end of the regenerative heat exchanger (102) and a first port (131) of the first four-way selector valve (130). The other end of the regenerative heat exchanger (102) is connected to one end of the electrically-operated expansion valve (110) via the receiver (105). The other end of the electrically-operated expansion valve (110) is connected to one end of the first heat exchanger (103) and one end of the second heat exchanger (104) via the bridge circuit (106). Moreover, the bridge circuit (106) is connected to a pipe between the regenerative heat exchanger (102) and the receiver (105).

The other end of the first heat exchanger (103) is connected to a fourth port (144) of the second four-way selector valve (140). The other end of the second heat exchanger (104) is connected to a second port (142) of the second four-way selector valve (140). A first port (141) of the second four-way selector valve (140) is connected to a fourth port (134) of the first four-way selector valve (130). A third port (133) of the first four-way selector valve (130) and a third port (143) of the second four-way selector valve (140) are connected to the intake side of the compressor (101). Moreover, a second port (132) of the first four-way selector valve (130) is connected to the intake side of the compressor (101) via the capillary tube (CP).

The bridge circuit (106) includes four check valves (151-154) connected together in a bridge pattern. In the bridge circuit (106), the first heat exchanger (103) is connected between the first check valve (151) and the second check valve (152), the electrically-operated expansion valve (110) between the second check valve (152) and the third check valve (153), the second heat exchanger (104) between the third check valve (153) and the fourth check valve (154), and the receiver (105) between the fourth check valve (154) and the first check valve (151).

In the bridge circuit (106), the first check valve (151) is placed so as to only allow the refrigerant flow from the first heat exchanger (103) toward the receiver (105). The second check valve (152) is placed so as to only allow the refrigerant flow from the electrically-operated expansion valve (110) toward the first heat exchanger (103). The third check valve (153) is placed so as to only allow the refrigerant flow from the electrically-operated expansion valve (110) toward the second heat exchanger (104). The fourth check valve (154) is placed so as to only allow the refrigerant flow from the second heat exchanger (104) toward the receiver (105).

The first four-way selector valve (130) can be switched between a position where the first port (131) and the second port (132) are communicated with each other while the third port (133) and the fourth port (134) are communicated with each other, and another position where the first port (131) and the fourth port (134) are communicated with each other while the second port (132) and the third port (133) are communicated with each other. Moreover, the second four-way selector valve (140) can be switched between a position where the first port (141) and the second port (142) are communicated with each other while the third port (143) and the fourth port (144) are communicated with each other, and another position where the first port (141) and the fourth port (144) are communicated with each other while the second port (142) and the third port (143) are communicated with each other.

Note that while the second port (132) of the first four-way selector valve (130) is connected to the intake side of the compressor (101) via the capillary tube (CP) in the refrigerant circuit (100), this is for the purpose of avoiding a liquid-sealed state. Specifically, the second port (132) of the first four-way selector valve (130) is substantially closed, and the first four-way selector valve (130) is used as a three-way valve in the refrigerant circuit (100). Therefore, in this refrigerant circuit (100), the first four-way selector valve (130) may be replaced with a three-way valve.

Operating Modes

The humidity control apparatus of the present embodiment can be switched between a dehumidification mode and a humidification mode. Moreover, the humidity control apparatus performs the dehumidification mode operation or the humidification mode operation by alternately repeating a first operation and a second operation.

Figure 14A:
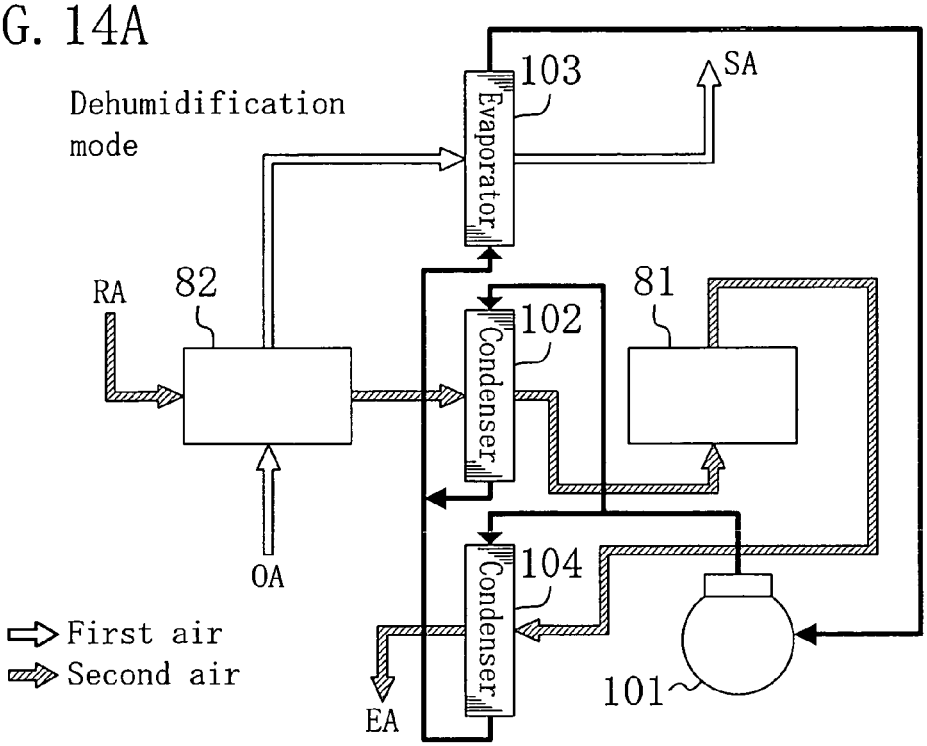
FIGS. 14A and 14B are conceptual diagrams illustrating operating modes of the humidity control apparatus according to Embodiment 4.
Figure 14B:
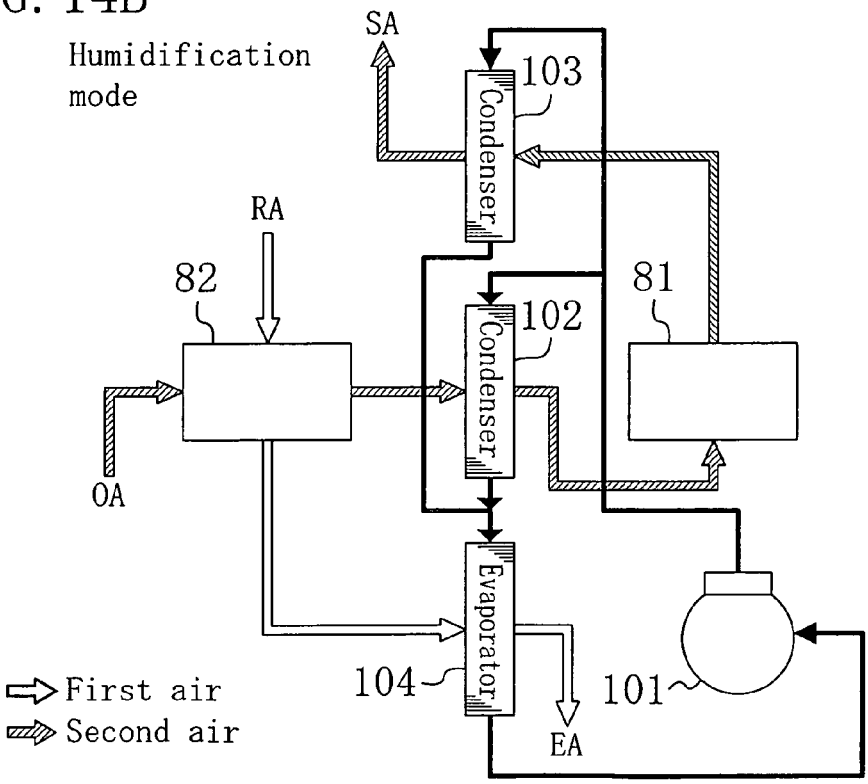

The operating modes of the humidity control apparatus are similar to those of Embodiment 1 except for the operation of the refrigerant circuit (100). The operation of the refrigerant circuit (100) of the present embodiment will now be described with reference to FIG. 10, FIG. 13 and FIG. 14. Note that the flow of the first air and the flow of the second air illustrated in FIG. 10 and FIG. 14 are those in the second operation.

Dehumidification Mode

In the dehumidification mode, the refrigerant circuit (100) of the present embodiment can operate in two different operating modes. In the dehumidification mode, the two operating modes are selectively performed.

The first operating mode of the dehumidification mode will be described. In the first operating mode, the first four-way selector valve (130) is positioned so that the first port (131) and the second port (132) are communicated with each other while the third port (133) and the fourth port (134) are communicated with each other, and the second four-way selector valve (140) is positioned so that the first port (141) and the fourth port (144) are communicated with each other while the second port (142) and the third port (143) are communicated with each other. Moreover, the degree of opening of the electrically-operated expansion valve (110) is appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 10A). Moreover, the first heat exchanger (103) and the second heat exchanger (104) are in parallel to each other in the direction in which the refrigerant circulates. Thus, in the refrigerant circuit (100) in the second operating mode, heat is exchanged between the refrigerant and the second air through the second heat exchanger (104), unlike in the dehumidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the electrically-operated expansion valve (110) through the receiver (105). The refrigerant is depressurized while passing through the electrically-operated expansion valve (110), and is then passed to the bridge circuit (106). The refrigerant having flown into the bridge circuit (106) is split into two flows. One of the split refrigerant flows is passed to the first heat exchanger (103) through the second check valve (152), and the other to the second heat exchanger (104) through the third check valve (153).

The refrigerant having flown into the first heat exchanger (103) exchanges heat with the first air, and absorbs heat from the first air to be evaporated. The refrigerant evaporated through the first heat exchanger (103) passes through the second four-way selector valve (140) from the fourth port (144) to the first port (141), and then passes through the first four-way selector valve (130) from the fourth port (134) to the third port (133), and the refrigerant is taken into the compressor (101). The refrigerant having flown into the second heat exchanger (104) exchanges heat with the second air, and absorbs heat from the second air to be evaporated. The refrigerant evaporated through the second heat exchanger (104) passes through the second four-way selector valve (140) from the second port (142) to the third port (143), and then merges with the refrigerant evaporated through the first heat exchanger (103) into a single flow, which is then taken into the compressor (101). The refrigerant taken into the compressor (101) is pressurized and then discharged therefrom.

The refrigerant circulating through the refrigerant circuit (100) in the first operating mode absorbs heat from the second air in the second heat exchanger (104) and radiates heat into the second air in the regenerative heat exchanger (102). In other words, heat is collected in the second heat exchanger (104) from the second air to be discharged to the outside, and the heat collected in the second heat exchanger (104) is reused for heating the second air in the regenerative heat exchanger (102).

Note that although the second four-way selector valve (140) is positioned so that the first port (141) and the fourth port (144) are communicated with each other while the second port (142) and the third port (143) are communicated with each other in the first operating mode, the same operation can be performed by positioning the second four-way selector valve (140) so that the first port (141) and the second port (142) are communicated with each other while the third port (143) and the fourth port (144) are communicated with each other. In this case, the refrigerant evaporated through the first heat exchanger (103) is taken into the compressor (101) after passing only through the second four-way selector valve (140), and the refrigerant evaporated through the second heat exchanger (104) is taken into the compressor (101) after passing through the second four-way selector valve (140) and then through the first four-way selector valve (130).

The second operating mode of the dehumidification mode will be described. In the second operating mode, the first four-way selector valve (130) is positioned so that the first port (131) and the fourth port (134) are communicated with each other while the second port (132) and the third port (133) are communicated with each other, and the second four-way selector valve (140) is positioned so that the first port (141) and the second port (142) are communicated with each other while the third port (143) and the fourth port (144) are communicated with each other. Moreover, the degree of opening of the electrically-operated expansion valve (110) is appropriately adjusted according to the operating conditions.

As the compressor (101) is operated in this state, the refrigerant circulates through the refrigerant circuit (100), thus performing a refrigerating cycle. Then, in the refrigerant circuit (100), the regenerative heat exchanger (102) and the second heat exchanger (104) both serve as a condenser and the first heat exchanger (103) as an evaporator (see FIG. 14A). Moreover, the regenerative heat exchanger (102) and the second heat exchanger (104) are in parallel to each other in the direction in which the refrigerant circulates. Thus, in the refrigerant circuit (100) in the second operating mode, heat is exchanged between the refrigerant and the second air through the second heat exchanger (104), unlike in the dehumidification mode of Embodiment 1.

Specifically, the refrigerant discharged from the compressor (101) is split into two flows. One of the split refrigerant flows is passed to the regenerative heat exchanger (102), and the other to the first four-way selector valve (130). Moreover, the refrigerant passed to the first four-way selector valve (130) passes through the first four-way selector valve (130) from the first port (131) to the fourth port (134) and further passes through the second four-way selector valve (140) from the first port (141) to the second port (142), and the refrigerant is passed to the second heat exchanger (104).

The refrigerant having flown into the regenerative heat exchanger (102) exchanges heat with the second air, and radiates heat into the second air to be condensed. The refrigerant condensed through the regenerative heat exchanger (102) flows into the receiver (105). The refrigerant having flown into the second heat exchanger (104) exchanges heat with the second air, and radiates heat into the second air to be condensed. The refrigerant condensed through the second heat exchanger (104) passes through the fourth check valve (154) of the bridge circuit (106) and flows into the receiver (105) together with the refrigerant condensed through the regenerative heat exchanger (102).

The refrigerant flowing out of the receiver (105) is passed to the electrically-operated expansion valve (110) and is depressurized while passing through the electrically-operated expansion valve (110). The refrigerant depressurized through the electrically-operated expansion valve (110) is passed to the first heat exchanger (103) through the second check valve (152) of the bridge circuit (106). The refrigerant having flown into the first heat exchanger (103) exchanges heat with the first air, and absorbs heat from the first air to be evaporated. The refrigerant evaporated through the first heat exchanger (103) passes through the second four-way selector valve (140) from the fourth port (144) to the third port (143) and is then taken into the compressor (101). The refrigerant taken into the compressor (101) is pressurized and then discharged therefrom.

Humidification Mode

In the humidification mode, the refrigerant circuit (100) of the present embodiment can operate in two different operating modes. In the humidification mode, the two operating modes are selectively performed.

The first operating mode of the humidification mode will be described. In the first operating mode, the first four-way selector valve (130) is positioned so that the first port (131) and the second port (132) are communicated with each other while the third port (133) and the fourth port (134) are communicated with each other, and the second four-way selector valve (140) is positioned so that the first port (141) and the fourth port (144) are communicated with each other while the second port (142) and the third port (143) are communicated with each other. Moreover, the degree of opening of the electrically-operated expansion valve (110) is appropriately adjusted according to the operating conditions.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 10(*b*)). Moreover, the first heat exchanger (103) and the second heat exchanger (104) are in parallel to each other in the direction in which the refrigerant circulates. Thus, in the refrigerant circuit (100) in the second operating mode, heat is exchanged between the refrigerant and the second air through the first heat exchanger (103), unlike in the humidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the electrically-operated expansion valve (110) through the receiver (105). The refrigerant is depressurized while passing through the electrically-operated expansion valve (110), and is then passed to the bridge circuit (106). The refrigerant having flown into the bridge circuit (106) is split into two flows. One of the split refrigerant flows is passed to the first heat exchanger (103) through the second check valve (152), and the other to the second heat exchanger (104) through the third check valve (153).

The refrigerant having flown into the first heat exchanger (103) exchanges heat with the second air, and absorbs heat from the second air to be evaporated. The refrigerant evaporated through the first heat exchanger (103) passes through the second four-way selector valve (140) from the fourth port (144) to the first port (141), and then passes through the first four-way selector valve (130) from the fourth port (134) to the third port (133), and the refrigerant is taken into the compressor (101).

The refrigerant having flown into the second heat exchanger (104) exchanges heat with the first air, and absorbs heat from the first air to be evaporated. The refrigerant evaporated through the second heat exchanger (104) passes through the second four-way selector valve (140) from the second port (142) to the third port (143), and then merges with the refrigerant evaporated through the first heat exchanger (103) into a single flow, which is then taken into the compressor (101). The refrigerant taken into the compressor (101) is pressurized and then discharged therefrom.

In the first operating mode, the refrigerant circulating through the refrigerant circuit (100) absorbs heat from the first air in the second heat exchanger (104) and radiates heat into the second air in the regenerative heat exchanger (102). In other words, heat is collected in the second heat exchanger (104) from the first air to be discharged to the outside, and the heat collected in the second heat exchanger (104) is used for heating the second air in the regenerative heat exchanger (102).

Note that although the second four-way selector valve (140) is positioned so that the first port (141) and the fourth port (144) are communicated with each other while the second port (142) and the third port (143) are communicated with each other in the first operating mode in the illustrated example, the same operation can be performed by positioning the second four-way selector valve (140) so that the first port (141) and the second port (142) are communicated with each other while the third port (143) and the fourth port (144) are communicated with each other. In this case, the refrigerant evaporated through the first heat exchanger (103) is taken into the compressor (101) after passing only through the second four-way selector valve (140), and the refrigerant evaporated through the second heat exchanger (104) is taken into the compressor (101) after passing through the second four-way selector valve (140) and then through the first four-way selector valve (130).

The second operating mode of the humidification mode will be described. In the second operating mode, the first four-way selector valve (130) and the second four-way selector valve (140) are both positioned so that the first ports (131, 141) and the fourth ports (134, 144) are communicated with each other while the second ports (132, 142) and the third ports (133, 143) are communicated with each other. Moreover, the degree of opening of the electrically-operated expansion valve (110) is appropriately adjusted according to the operating conditions.

As the compressor (101) is operated in this state, the refrigerant circulates through the refrigerant circuit (100), thus performing a refrigerating cycle. Then, in the refrigerant circuit (100), the regenerative heat exchanger (102) and the first heat exchanger (103) both serve as a condenser and the second heat exchanger (104) as an evaporator (see FIG. 14B). Moreover, the regenerative heat exchanger (102) and the first heat exchanger (103) are in parallel to each other in the direction in which the refrigerant circulates. Thus, in the refrigerant circuit (100) in the second operating mode, heat is exchanged between the refrigerant and the second air through the first heat exchanger (103), unlike in the humidification mode of Embodiment 1.

Specifically, the refrigerant discharged from the compressor (101) is split into two flows. One of the split refrigerant flows is passed to the regenerative heat exchanger (102), and the other to the first four-way selector valve (130). Moreover, the refrigerant passed to the first four-way selector valve (130) passes through the first four-way selector valve (130) from the first port (131) to the fourth port (134) and further passes through the second four-way selector valve (140) from the first port (141) to the fourth port (144), and the refrigerant is passed to the first heat exchanger (103).

The refrigerant having flown into the regenerative heat exchanger (102) exchanges heat with the second air, and radiates heat into the second air to be condensed. The refrigerant condensed through the regenerative heat exchanger (102) flows into the receiver (105). The refrigerant having flown into the first heat exchanger (103) exchanges heat with the second air, and radiates heat into the second air to be condensed. The refrigerant condensed through the first heat exchanger (103) passes through the first check valve (151) of the bridge circuit (106) and flows into the receiver (105) together with the refrigerant condensed through the regenerative heat exchanger (102).

The refrigerant flowing out of the receiver (105) is passed to the electrically-operated expansion valve (110) and is depressurized while passing through the electrically-operated expansion valve (110). The refrigerant depressurized through the electrically-operated expansion valve (110) is passed to the second heat exchanger (104) through the third check valve (153) of the bridge circuit (106). The refrigerant having flown into the second heat exchanger (104) exchanges heat with the first air, and absorbs heat from the first air to be evaporated. The refrigerant evaporated through the first heat exchanger (103) passes through the second four-way selector valve (140) from the second port (142) to the third port (143) and is then taken into the compressor (101). The refrigerant taken into the compressor (101) is pressurized and then discharged therefrom.

In the second operating mode, the refrigerant radiates heat, in the first heat exchanger (103), into the second air having passed through the adsorbing elements (81, 82). Thus, the second air is humidified through the adsorbing elements (81, 82) and then further heated through the first heat exchanger (103) before it is supplied into the room.

Moreover, in the first and second operating modes of the humidification mode, the refrigerant circulating through the refrigerant circuit (100) absorbs heat from the first air in the second heat exchanger (104) and radiates heat into the second air in the regenerative heat exchanger (102). In other words, heat is collected in the second heat exchanger (104) from the first air to be discharged to the outside, and the heat collected in the second heat exchanger (104) is used for heating the second air in the regenerative heat exchanger (102).

The humidity control apparatus of the present embodiment can operate in the operating modes described above. According to the present embodiment, effects similar to those of Embodiment 3 can be obtained.

Embodiment 5

Embodiment 5 of the present invention is similar to Embodiment 1, except for changes to the configuration of the refrigerant circuit (100). The configuration of the humidity control apparatus of the present embodiment is similar to that of Embodiment 1 except for the refrigerant circuit (100).

Figure 15:
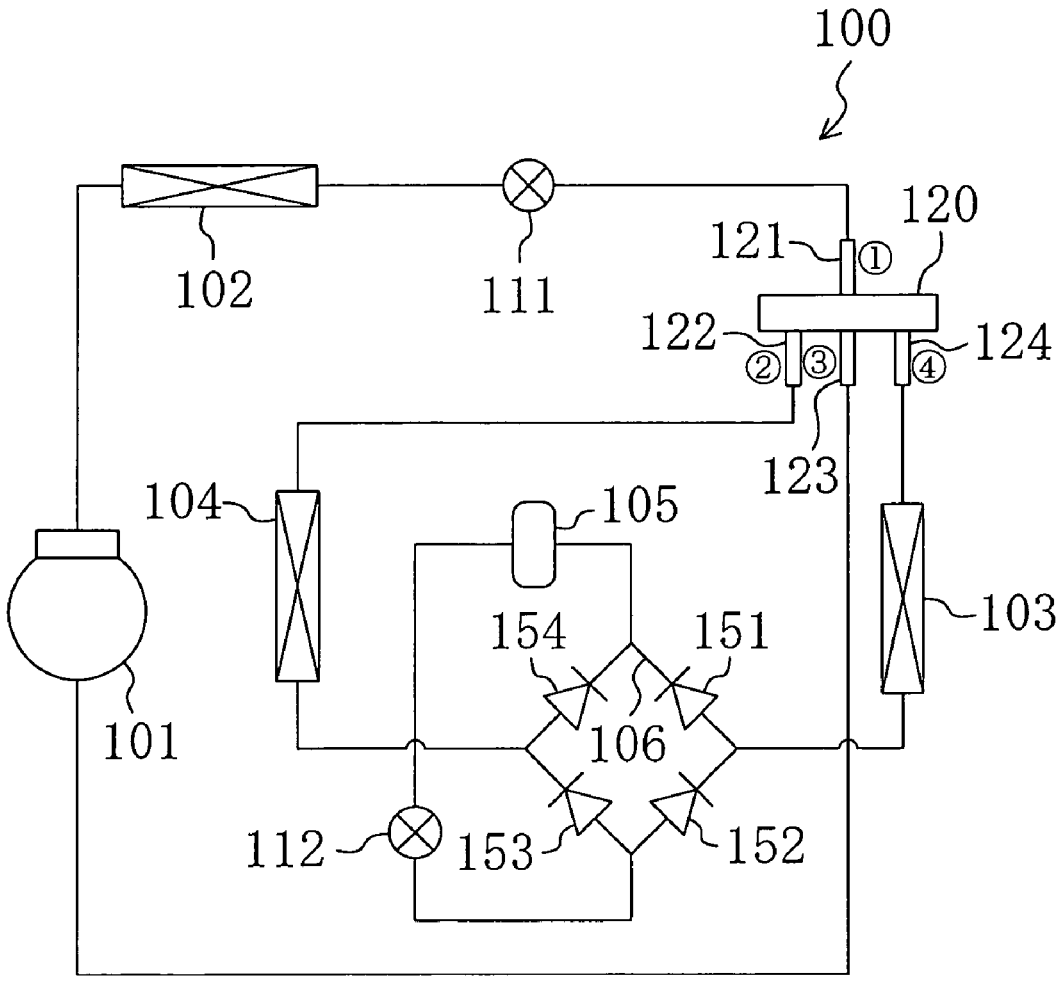
FIG. 15 is a pipe system diagram illustrating the configuration of the refrigerant circuit according to Embodiment 5.

As illustrated in FIG. 15, the refrigerant circuit (100) of the present embodiment is a closed circuit filled with a refrigerant. The refrigerant circuit (100) includes the compressor (101), the regenerative heat exchanger (102), the first heat exchanger (103), the second heat exchanger (104), the receiver (105) and the bridge circuit (106). Moreover, the refrigerant circuit (100) includes one four-way selector valve (120) and two electrically-operated expansion valves (111, 112). In the refrigerant circuit (100), a vapor-compression refrigerating cycle is performed by circulating the refrigerant therethrough.

In the refrigerant circuit (100), the discharge side of the compressor (101) is connected to one end of the regenerative heat exchanger (102). The other end of the regenerative heat exchanger (102) is connected to one end of the first electrically-operated expansion valve (111). The other end of the first electrically-operated expansion valve (111) is connected to the first port (121) of the four-way selector valve (120). In the four-way selector valve (120), the second port (122) is connected to one end of the second heat exchanger (104), the third port (123) to the intake side of the compressor (101), and the fourth port (124) to one end of the first heat exchanger (103).

The other end of the first heat exchanger (103) and the other end of the second heat exchanger (104) are connected to the bridge circuit (106). One end of the second electrically-operated expansion valve (112) is connected to the bridge circuit (106) via the receiver (105) and the other end directly to the bridge circuit (106).

The bridge circuit (106) includes four check valves (151-154) connected together in a bridge pattern. In the bridge circuit (106), the first heat exchanger (103) is connected between the first check valve (151) and the second check valve (152), the second electrically-operated expansion valve (112) between the second check valve (152) and the third check valve (153), the second heat exchanger (104) between the third check valve (153) and the fourth check valve (154), and the receiver (105) between the fourth check valve (154) and the first check valve (151).

In the bridge circuit (106), the first check valve (151) is placed so as to only allow the refrigerant flow from the first heat exchanger (103) toward the receiver (105). The second check valve (152) is placed so as to only allow the refrigerant flow from the second electrically-operated expansion valve (112) toward the first heat exchanger (103). The third check valve (153) is placed so as to only allow the refrigerant flow from the second electrically-operated expansion valve (112) toward the second heat exchanger (104). The fourth check valve (154) is placed so as to only allow the refrigerant flow from the second heat exchanger (104) toward the receiver (105).

The four-way selector valve (120) can be switched between a position where the first port (121) and the second port (122) are communicated with each other while the third port (123) and the fourth port (124) are communicated with each other, and another position where the first port (121) and the fourth port (124) are communicated with each other while the second port (122) and the third port (123) are communicated with each other.

Operating Modes

The humidity control apparatus of the present embodiment can be switched between a dehumidification mode and a humidification mode. Moreover, the humidity control apparatus performs the dehumidification mode operation or the humidification mode operation by alternately repeating a first operation and a second operation.

Figure 16A:
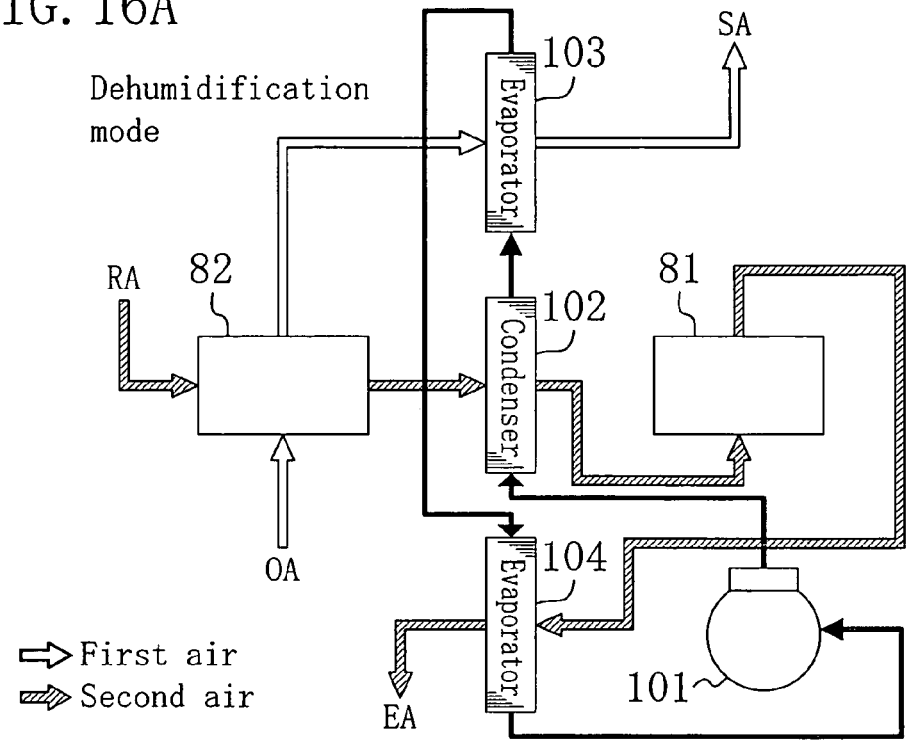
FIGS. 16A and 16B are conceptual diagrams illustrating operating modes of a humidity control apparatus according to Embodiment 5.
Figure 16B:
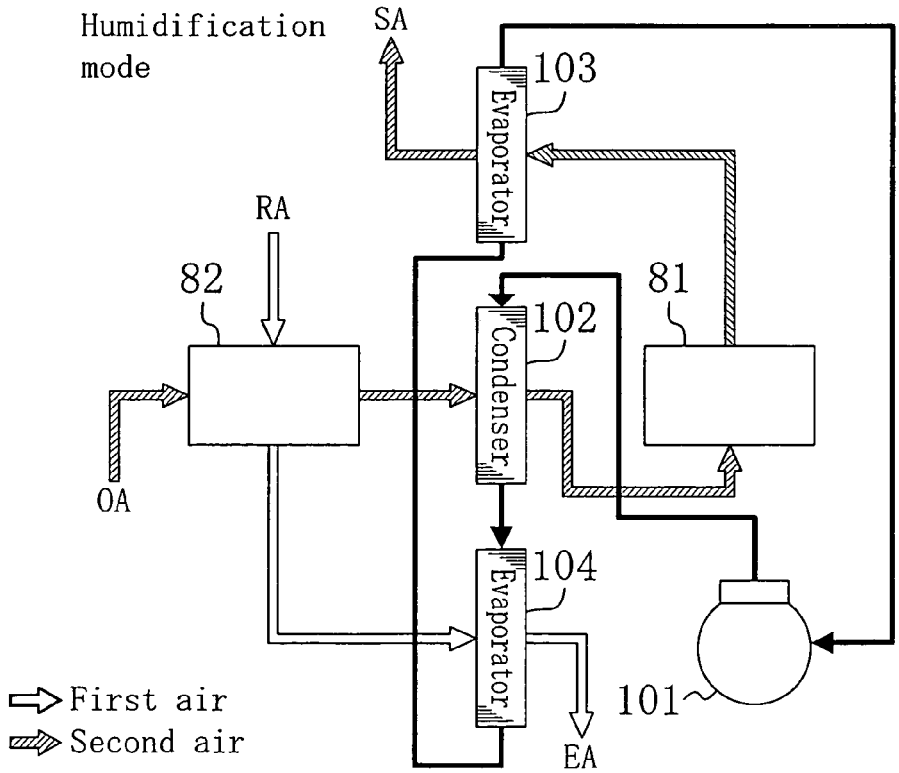
Figure 17A:
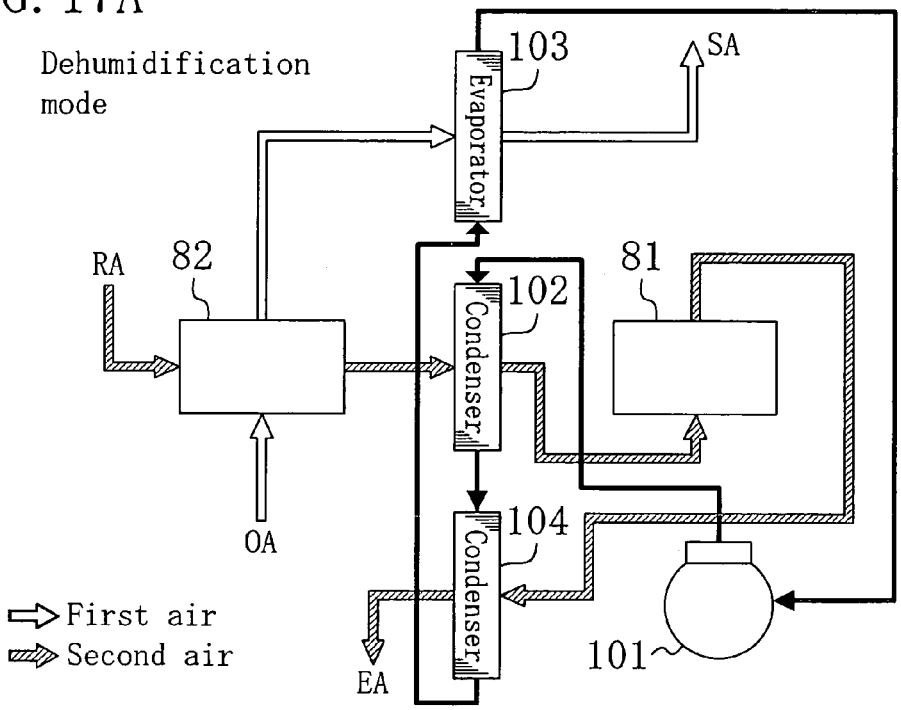
FIGS. 17A and 17B are conceptual diagrams illustrating operating modes of the humidity control apparatus according to Embodiment 5.
Figure 17B:
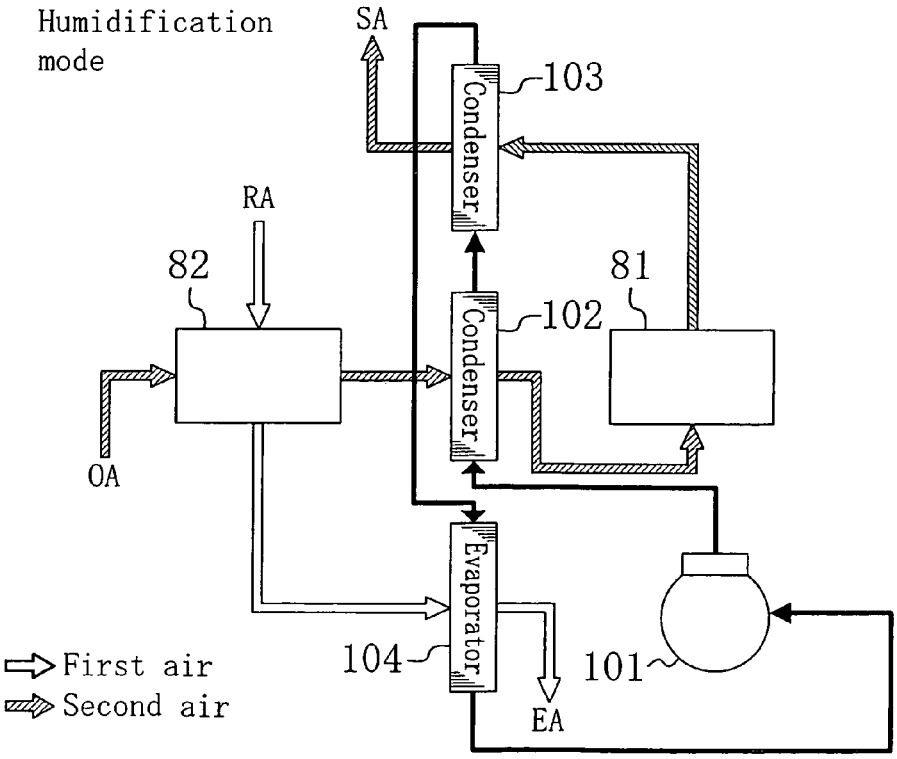

The operating modes of the humidity control apparatus are similar to those of Embodiment 1 except for the operation of the refrigerant circuit (100). The operation of the refrigerant circuit (100) of the present embodiment will now be described with reference to FIG. 15 to FIG. 17. Note that the flow of the first air and the flow of the second air illustrated in FIG. 16 and FIG. 17 are those in the second operation.

Dehumidification Mode

In the dehumidification mode, the refrigerant circuit (100) of the present embodiment can operate in two different operating modes. In the dehumidification mode, the two operating modes are selectively performed.

The first operating mode of the dehumidification mode will be described. In the first operating mode, the four-way selector valve (120) is positioned so that the first port (121) and the fourth port (124) are communicated with each other while the second port (122) and the third port (123) are communicated with each other. Moreover, the degree of opening of the first electrically-operated expansion valve (111) is appropriately adjusted according to the operating conditions, and the second electrically-operated expansion valve (112) is in the fully open state.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 16A). Moreover, the first heat exchanger (103) and the second heat exchanger (104) are in series with each other in the direction in which the refrigerant circulates. Thus, in the refrigerant circuit (100) in the second operating mode, heat is exchanged between the refrigerant and the second air through the second heat exchanger (104), unlike in the dehumidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the electrically-operated expansion valve (110). The refrigerant is depressurized while passing through the electrically-operated expansion valve (110), and is then passed to the first heat exchanger (103) through the four-way selector valve (120).

The refrigerant having flown into the first heat exchanger (103) exchanges heat with the first air, and absorbs heat from the first air to be partially evaporated. The refrigerant from the first heat exchanger (103) is passed to the second heat exchanger (104) through the first check valve (151) of the bridge circuit (106), the receiver (105), the second electrically-operated expansion valve (112) and then through the third check valve (153) of the bridge circuit (106). The refrigerant having flown into the second heat exchanger (104) exchanges heat with the second air, and absorbs heat from the second air to be evaporated. The refrigerant from the second heat exchanger (104) is taken into the compressor (101) through the four-way selector valve (120). The refrigerant taken into the compressor (101) is pressurized and then discharged therefrom.

The refrigerant circulating through the refrigerant circuit (100) in the first operating mode absorbs heat from the second air in the second heat exchanger (104) and radiates heat into the second air in the regenerative heat exchanger (102). In other words, heat is collected in the second heat exchanger (104) from the second air to be discharged to the outside, and the heat collected in the second heat exchanger (104) is reused for heating the second air in the regenerative heat exchanger (102).

The second operating mode of the dehumidification mode will be described. In the second operating mode, the four-way selector valve (120) is positioned so that the first port (121) and the second port (122) are communicated with each other while the third port (123) and the fourth port (124) are communicated with each other. Moreover, the first electrically-operated expansion valve (111) is in the fully open state, and the degree of opening of the second electrically-operated expansion valve (112) is appropriately adjusted according to the operating conditions.

As the compressor (101) is operated in this state, the refrigerant circulates through the refrigerant circuit (100), thus performing a refrigerating cycle. Then, in the refrigerant circuit (100), the regenerative heat exchanger (102) and the second heat exchanger (104) both serve as a condenser and the first heat exchanger (103) as an evaporator (see FIG. 17A). Moreover, the regenerative heat exchanger (102) and the second heat exchanger (104) are in series with each other in the direction in which the refrigerant circulates. Thus, in the refrigerant circuit (100) in the second operating mode, heat is exchanged between the refrigerant and the second air through the second heat exchanger (104), unlike in the dehumidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be partially condensed. The refrigerant from the regenerative heat exchanger (102) is passed to the second heat exchanger (104) through the first electrically-operated expansion valve (111) and then through the four-way selector valve (120). The refrigerant having flown into the second heat exchanger (104) exchanges heat with the second air, and radiates heat into the second air to be condensed.

The refrigerant from the second heat exchanger (104) is passed to the second electrically-operated expansion valve (112) through the fourth check valve (154) of the bridge circuit (106) and then through the receiver (105). The refrigerant is depressurized while passing through the second electrically-operated expansion valve (112), and is then passed to the first heat exchanger (103) through the second check valve (152) of the bridge circuit (106). The refrigerant having flown into the first heat exchanger (103) exchanges heat with the first air, and absorbs heat from the first air to be evaporated. The refrigerant evaporated through the first heat exchanger (103) is taken into the compressor (101) through the four-way selector valve (120). The refrigerant taken into the compressor (101) is pressurized and then discharged therefrom.

Note that although the regenerative heat exchanger (102) and the second heat exchanger (104) both serve as a condenser in the second operating mode in the illustrated example, the regenerative heat exchanger (102) may alternatively serve as a condenser and the second heat exchanger (104) as a subcooler. In this case, all of the incoming gas refrigerant is condensed through the regenerative heat exchanger (102), whereby only a liquid refrigerant is passed to the second heat exchanger (104). Then, in the second heat exchanger (104), the incoming liquid refrigerant radiates heat into the second air to be in a subcooled state.

In the second operating mode, the refrigerant circulating through the refrigerant circuit (100) radiates heat both in the regenerative heat exchanger (102) and in the second heat exchanger (104) before it is passed to the first heat exchanger (103). Therefore, a refrigerant having a lower enthalpy is passed into the first heat exchanger (103) serving as an evaporator.

Humidification Mode

In the humidification mode, the refrigerant circuit (100) of the present embodiment can operate in two different operating modes. In the humidification mode, the two operating modes are selectively performed.

The first operating mode of the humidification mode will be described. In the first operating mode, the four-way selector valve (120) is positioned so that the first port (121) and the second port (122) are communicated with each other while the third port (123) and the fourth port (124) are communicated with each other. Moreover, the degree of opening of the first electrically-operated expansion valve (111) is appropriately adjusted according to the operating conditions, and the second electrically-operated expansion valve (112) is in the fully open state.

As the compressor (101) is operated in this state, the refrigerant circulates through the refrigerant circuit (100), thus performing a refrigerating cycle. Then, the regenerative heat exchanger (102) in the refrigerant circuit (100) serves as a condenser, and the first heat exchanger (103) and the second heat exchanger (104) both serve as an evaporator (see FIG. 16B). Moreover, the second heat exchanger (104) and the first heat exchanger (103) are in series with each other in the direction in which the refrigerant circulates. Thus, in the refrigerant circuit (100) in the second operating mode, heat is exchanged between the refrigerant and the second air through the first heat exchanger (103), unlike in the humidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be condensed. The refrigerant condensed through the regenerative heat exchanger (102) is passed to the electrically-operated expansion valve (110). The refrigerant is depressurized while passing through the electrically-operated expansion valve (110), and is then passed to the second heat exchanger (104) through the four-way selector valve (120).

The refrigerant having flown into the second heat exchanger (104) exchanges heat with the first air, and absorbs heat from the first air to be partially evaporated. The refrigerant from the second heat exchanger (104) is passed to the first heat exchanger (103) through the fourth check valve (154) of the bridge circuit (106), the receiver (105), the second electrically-operated expansion valve (112) and then through the second check valve (152) of the bridge circuit (106). The refrigerant having flown into the first heat exchanger (103) exchanges heat with the second air, and absorbs heat from the second air to be evaporated. The refrigerant from the first heat exchanger (103) is taken into the compressor (101) through the four-way selector valve (120). The refrigerant taken into the compressor (101) is pressurized and then discharged therefrom.

In the first operating mode, the refrigerant circulating through the refrigerant circuit (100) absorbs heat from the first air in the second heat exchanger (104) and radiates heat into the second air in the regenerative heat exchanger (102). In other words, heat is collected in the second heat exchanger (104) from the first air to be discharged to the outside, and the heat collected in the second heat exchanger (104) is used for heating the second air in the regenerative heat exchanger (102).

In the first operating mode, in the first heat exchanger (103), the refrigerant radiates heat into the second air having passed through the adsorbing elements (81, 82). Thus, the second air is humidified through the adsorbing elements (81, 82) and then further cooled through the first heat exchanger (103) before it is supplied into the room. Therefore, the first operating mode is suitable for a case where the user wishes to humidify the air in the room without increasing the temperature thereof.

The second operating mode of the humidification mode will be described. In the second operating mode, the four-way selector valve (120) is positioned so that the first port (121) and the fourth port (124) are communicated with each other while the second port (122) and the third port (123) are communicated with each other. Moreover, the first electrically-operated expansion valve (111) is in the fully open state, and the degree of opening of the second electrically-operated expansion valve (112) is appropriately adjusted according to the operating conditions.

As the compressor (101) is operated in this state, the refrigerant circulates through the refrigerant circuit (100), thus performing a refrigerating cycle. Then, in the refrigerant circuit (100), the regenerative heat exchanger (102) and the first heat exchanger (103) both serve as a condenser and the second heat exchanger (104) as an evaporator (see FIG. 17B). Moreover, the regenerative heat exchanger (102) and the first heat exchanger (103) are in series with each other in the direction in which the refrigerant circulates. Thus, in the refrigerant circuit (100) in the second operating mode, heat is exchanged between the refrigerant and the second air through the first heat exchanger (103), unlike in the humidification mode of Embodiment 1.

Specifically, the refrigerant discharged from the compressor (101) is passed to the regenerative heat exchanger (102). The refrigerant having flown into the regenerative heat exchanger (102) exchanges heat with the second air, and radiates heat into the second air to be partially condensed. The refrigerant from the regenerative heat exchanger (102) is passed to the first heat exchanger (103) through the first electrically-operated expansion valve (111) and then through the four-way selector valve (120). The refrigerant having flown into the first heat exchanger (103) exchanges heat with the second air, and radiates heat into the second air to be condensed.

The refrigerant from the first heat exchanger (103) is passed to the second electrically-operated expansion valve (112) through the first check valve (151) of the bridge circuit (106) and then through the receiver (105). The refrigerant is depressurized while passing through the second electrically-operated expansion valve (112), and is then passed to the second heat exchanger (104) through the third check valve (153) of the bridge circuit (106). The refrigerant having flown into the second heat exchanger (104) exchanges heat with the first air, and absorbs heat from the first air to be evaporated. The refrigerant evaporated through the second heat exchanger (104) is taken into the compressor (101) through the four-way selector valve (120). The refrigerant taken into the compressor (101) is pressurized and then discharged therefrom.

Note that although the regenerative heat exchanger (102) and the second heat exchanger (103) both serve as a condenser in the second operating mode in the illustrated example, the regenerative heat exchanger (102) may alternatively serve as a condenser and the second heat exchanger (103) as a subcooler. In this case, all of the incoming gas refrigerant is condensed through the regenerative heat exchanger (102), whereby only a liquid refrigerant is passed to the first heat exchanger (103). Then, in the first heat exchanger (103), the incoming liquid refrigerant radiates heat into the first air to be in a subcooled state.

In the second operating mode, the refrigerant radiates heat, in the first heat exchanger (103), into the second air having passed through the adsorbing elements (81, 82). Thus, the second air is humidified through the adsorbing elements (81, 82) and then further heated through the first heat exchanger (103) before it is supplied into the room.

Moreover, in the second operating mode, the refrigerant circulating through the refrigerant circuit (100) radiates heat both in the regenerative heat exchanger (102) and in the first heat exchanger (103) before it is passed to the second heat exchanger (104). Therefore, a refrigerant having a lower enthalpy is passed into the second heat exchanger (104) serving as an evaporator.

Moreover, in the first and second operating modes of the humidification mode, the refrigerant circulating through the refrigerant circuit (100) absorbs heat from the first air in the second heat exchanger (104) and radiates heat into the second air in the regenerative heat exchanger (102). In other words, heat is collected in the second heat exchanger (104) from the first air to be discharged to the outside, and the heat collected in the second heat exchanger (104) is used for heating the second air in the regenerative heat exchanger (102).

Effects of Embodiment 5

According to Embodiment 5, the following effects are realized in addition to those obtained in Embodiment 3.

With the humidity control apparatus of the present embodiment, in the second operating mode of the dehumidification mode, the refrigerant radiates heat into the second air both in the regenerative heat exchanger (102) and in the second heat exchanger (104). Then, the second heat exchanger (104) may serve as a subcooler, in which case the refrigerant is in the subcooled state at the exit of the second heat exchanger (104).

Figure 18:
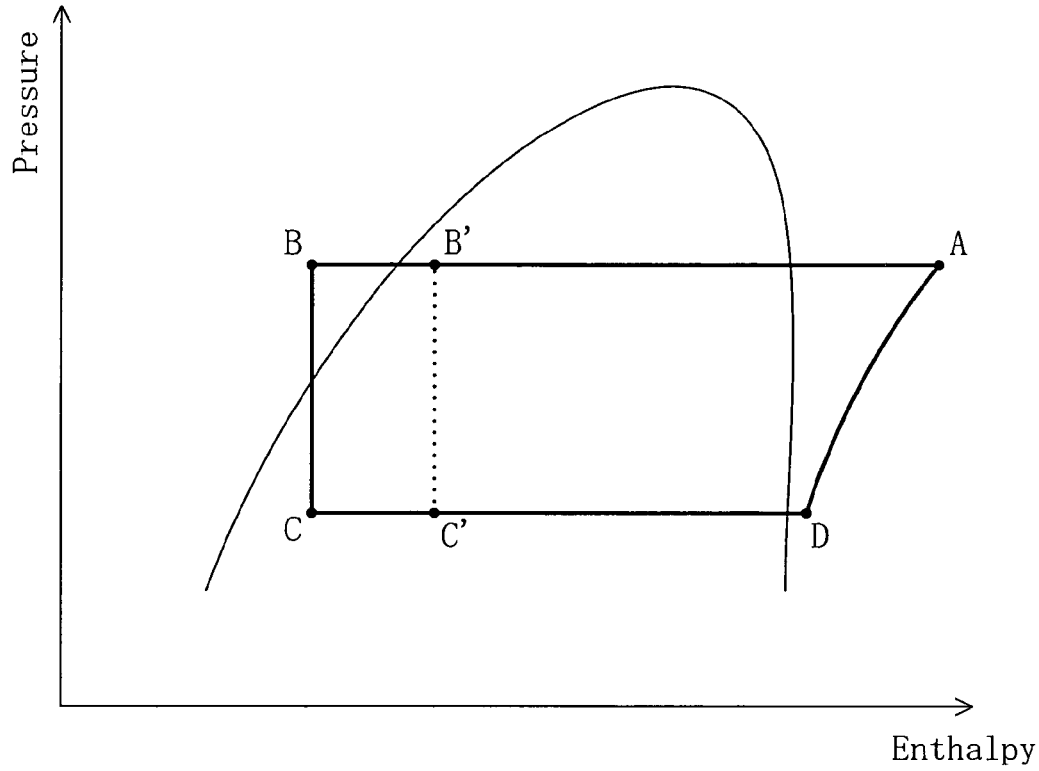
FIG. 18 is a Mollier diagram (pressure-enthalpy diagram) illustrating the refrigerating cycle performed in the refrigerant circuit of the humidity control apparatus according to Embodiment 5.

The refrigerating cycle in such a case will be described with reference to FIG. 18. The refrigerant discharged from the compressor (101) is in state A, and is in state B' after radiating heat into the second air in the regenerative heat exchanger (102). The refrigerant in state B' then radiates heat into the second air in the second heat exchanger (104) to be in state B. The refrigerant in state B is depressurized through the second electrically-operated expansion valve (112) to be in state C, and then flows into the first heat exchanger (103). In the first heat exchanger (103), the refrigerant absorbs heat from the first air and is evaporated, thereby transitioning from state C to state D. The refrigerant in state D is taken into, and pressurized in, the compressor (101) to be back in state A.

Thus, in the second operating mode of the dehumidification mode, the high-pressure refrigerant after radiating heat can be brought to state B where the enthalpy is lower than that in state B'. Moreover, the refrigerant passed to the first heat exchanger (103) serving as an evaporator can be brought to state C where the enthalpy is lower than that in state C'. Thus, with this operating mode, the enthalpy of the refrigerant passed to the first heat exchanger (103) serving as an evaporator can be reduced, and the amount of heat absorbed by the refrigerant through the first heat exchanger (103) can be increased, thus improving the cooling capacity.

Moreover, with the humidity control apparatus of the present embodiment, in the second operating mode of the humidification mode, the refrigerant radiates heat into the second air both in the regenerative heat exchanger (102) and in the first heat exchanger (103). Then, the first heat exchanger (103) may serve as a subcooler, in which case the refrigerant is in the subcooled state at the exit of the first heat exchanger (103).

The refrigerating cycle in such a case will be described with reference to FIG. 18. The refrigerant discharged from the compressor (101) is in state A, and is in state B' after radiating heat into the second air in the regenerative heat exchanger (102). The refrigerant in state B' then radiates heat into the second air in the first heat exchanger (103) to be in state B. The refrigerant in state B is depressurized through the second electrically-operated expansion valve (112) to be in state C, and then flows into the first heat exchanger (104). In the second heat exchanger (104), the refrigerant absorbs heat from the first air and is evaporated, thereby transitioning from state C to state D. The refrigerant in state D is taken into, and pressurized in, the compressor (101) to be back in state A.

Thus, in the second operating mode of the humidification mode, the high-pressure refrigerant after radiating heat can be brought to state B where the enthalpy is lower than that in state B'. Moreover, the refrigerant passed to the second heat exchanger (104) serving as an evaporator can be brought to state C where the enthalpy is lower than that in state C'.

Therefore, with this operating mode, it is possible to set a high refrigerant evaporation temperature in the second heat exchanger (104) without decreasing the amount of heat absorbed by the refrigerant through the second heat exchanger (104) serving as an evaporator. Thus, it is possible to prevent frosting on the second heat exchanger (104), and to prevent the humidification mode operation from being discontinued for defrosting, thereby improving the humidification capacity. Moreover, under operating conditions free of frosting, it is possible to reduce the enthalpy of the refrigerant passed to the second heat exchanger (104) serving as an evaporator to increase the amount of heat absorbed by the refrigerant through the second heat exchanger (104), thus increasing the amount of heat given to the second air in the regenerative heat exchanger (102) and the first heat exchanger (103).

Moreover, where the first heat exchanger (103) and the second heat exchanger (104) both serve as an evaporator, the refrigerant circuit (100) of the present embodiment can be switched between an operation in which the refrigerant flows from the first heat exchanger (103) to the second heat exchanger (104) and another operation in which the refrigerant flows from the second heat exchanger (104) to the first heat exchanger (103) (see FIG. 16). Therefore, in the dehumidification mode, a refrigerant having the lowest enthalpy can be supplied to the first heat exchanger (103) to ensure an amount of heat absorbed by the refrigerant through the first heat exchanger (103), whereby it is possible to sufficiently cool the first air. Moreover, in the humidification mode, the refrigerant having already absorbed heat through the second heat exchanger (104) can be supplied to the first heat exchanger (103), whereby it is possible to prevent the second air from forming dews in the second heat exchanger (104) and thus reducing the moisture therein.

Variation 1 of Embodiment 5

Where the first heat exchanger (103) and the second heat exchanger (104) both serve as an evaporator (i.e., in the first operating mode of the dehumidification mode or the humidification mode), the refrigerant circuit (100) of the present embodiment may operate to cut down the capacity of one of the heat exchangers (103, 104) that is located downstream of the other.

Specifically, the refrigerant circuit (100) of the present variation includes a pipe for bypassing one of the first and second heat exchangers (103, 104) that is downstream of the other, whereby only a portion of the refrigerant circulating through the refrigerant circuit (100) is supplied to the first or second heat exchanger (103, 104) that is downstream of the other. For example, the refrigerant circuit (100) in the first operating mode of the dehumidification mode, only a portion of the refrigerant from the first heat exchanger (103) is introduced into the second heat exchanger (104), and only this portion of the refrigerant absorbs heat from the second air through the second heat exchanger (104). In this operation, the amount of heat absorbed by the refrigerant through the second heat exchanger (104) on the downstream side is reduced, as compared with a case where all of the refrigerant from the first heat exchanger (103) is introduced into the second heat exchanger (104).

Moreover, the refrigerant circuit (100) of the present variation may be configured as follows. That is, where the first or second heat exchanger (103, 104) includes a plurality of paths among which the refrigerant is to be distributed, the refrigerant circuit (100) may be configured so that the refrigerant can be introduced into only some of the paths of the first or second heat exchanger (103, 104). For example, in the refrigerant circuit (100) in the first operating mode of the dehumidification mode, the refrigerant from the first heat exchanger (103) is introduced into only some of the paths of the second heat exchanger (104). In this state, heat exchange between the refrigerant and the second air occurs only in a portion of, but not the entirety of, the second heat exchanger (104). In this operation, the amount of heat absorbed by the refrigerant through the second heat exchanger (104) on the downstream side is reduced, as compared with a case where the refrigerant is introduced into all the paths of the second heat exchanger (104) so that the refrigerant exchanges heat with the air through the entirety of the second heat exchanger (104).

According to the present variation, in an operation where the first heat exchanger (103) and the second heat exchanger (104) both serve as an evaporator, it is possible to reduce the amount of heat absorbed by the refrigerant through one of the heat exchangers (103, 104) that is located downstream of the other. Thus, the amount of heat absorbed by the refrigerant through the first and second heat exchangers (103, 104) both serving as an evaporator can be kept in balance with the amount of heat radiated from the refrigerant through the regenerative heat exchanger (102) serving as a condenser, whereby it is possible to perform a stable refrigerating cycle in the refrigerant circuit (100).

Variation 2 of Embodiment 5

In the first operating mode of the humidification mode, the humidity control apparatus of the present embodiment may operate as follows. That is, in the first operating mode, the second electrically-operated expansion valve (112) can be set to a predetermined degree of opening instead of being in the fully open state. Where the refrigerant is depressurized through the second electrically-operated expansion valve (112), the refrigerant evaporation temperature in the first heat exchanger (103) differs from that in the second heat exchanger (104).

Figure 19:
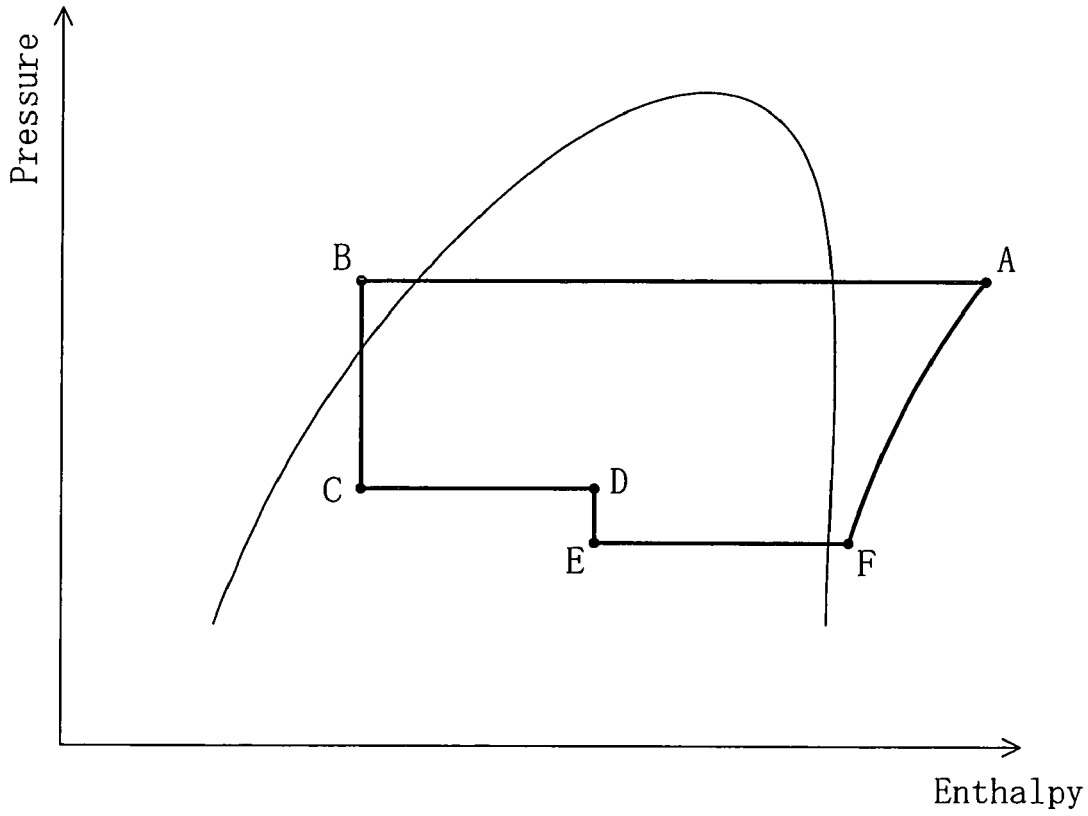
FIG. 19 is a Mollier diagram (pressure-enthalpy diagram) illustrating the refrigerating cycle performed in the refrigerant circuit of a humidity control apparatus according to Variation 2 of Embodiment 5.

The refrigerating cycle where the second electrically-operated expansion valve (112) is set to a predetermined degree of opening will be described with reference to FIG. 19. The refrigerant discharged from the compressor (101) is in state A, and is in state B after radiating heat into the second air in the regenerative heat exchanger (102). The refrigerant in state B is depressurized through the first electrically-operated expansion valve (111) to be in state C. The refrigerant in state C then absorbs heat from the first air and is evaporated in the second heat exchanger (104) to be in state D. The refrigerant in state D is depressurized through the second electrically-operated expansion valve (112) to be in state E. The refrigerant in state E then absorbs heat from the second air and is evaporated in the first heat exchanger (103) to be in state F. The refrigerant in state F is taken into, and pressurized in, the compressor (101) to be back in state A.

Thus, with the operating mode of the present variation, the refrigerant evaporation temperature in the first heat exchanger (103) and that in the second heat exchanger (104) can be set individually. Therefore, the refrigerant evaporation temperature in the second heat exchanger (104) can be set to a relatively high temperature to prevent frosting on the second heat exchanger (104). Note that it is preferred in such a case to take some measures to reduce the amount of heat absorbed by the refrigerant through the first heat exchanger (103), as in Variation 1.

Alternative Embodiments

The embodiments described above may be modified as follows.

First Variation

The humidity control apparatus of any embodiment described above may have a dehumidification/circulation mode and/or a humidification/circulation mode, in addition to the dehumidification mode and the humidification mode. In the dehumidification/circulation mode or the humidification/circulation mode, a first operation and a second operation are alternately repeated, as in the dehumidification mode or the humidification mode. The present variation as being applied to Embodiment 1 will be described below.

Dehumidification/Circulation Mode

Figure 20:
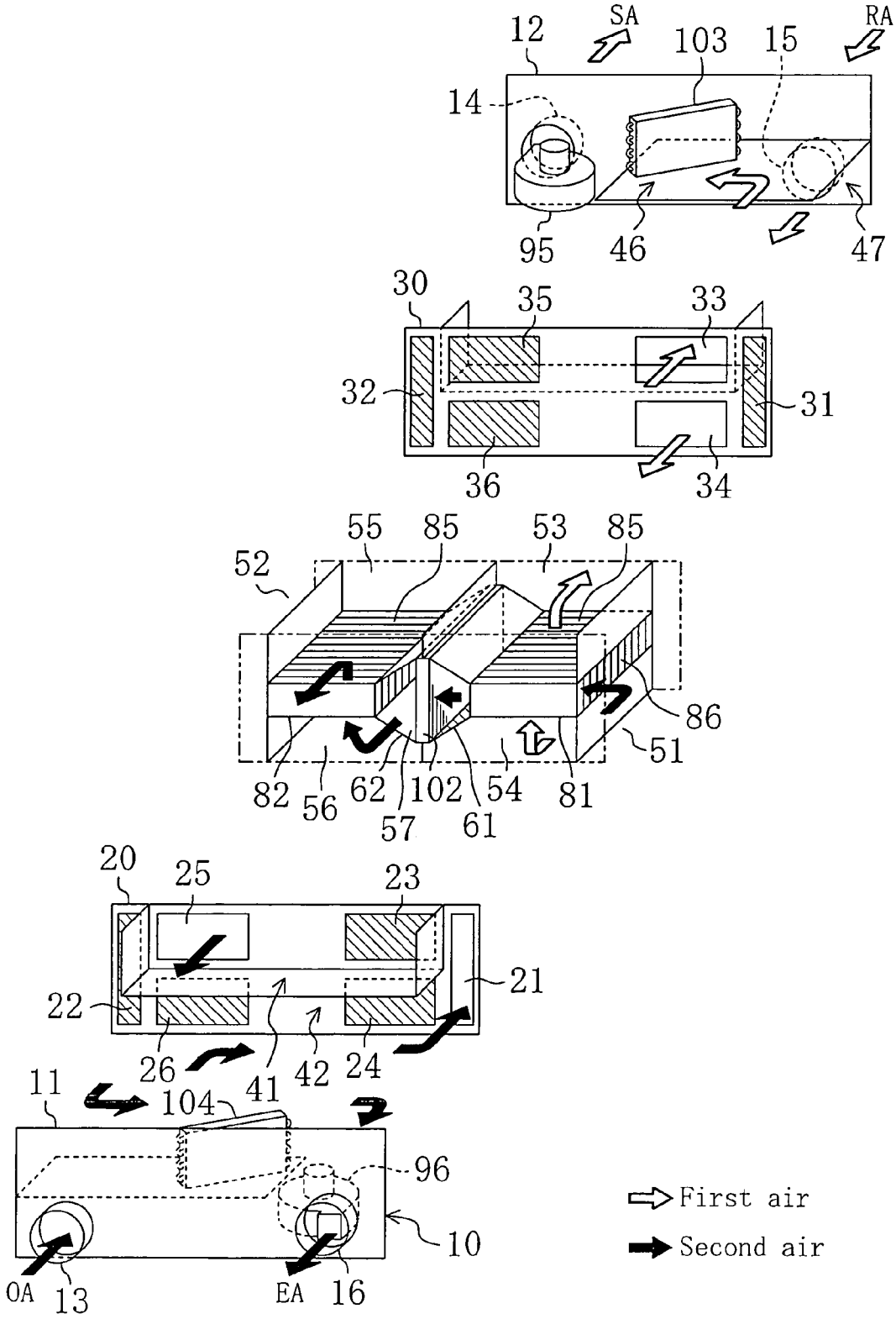
FIG. 20 is an exploded perspective view illustrating the first operation of the dehumidification/circulation mode of a humidity control apparatus according to the first variation of the alternative embodiments.
Figure 21:
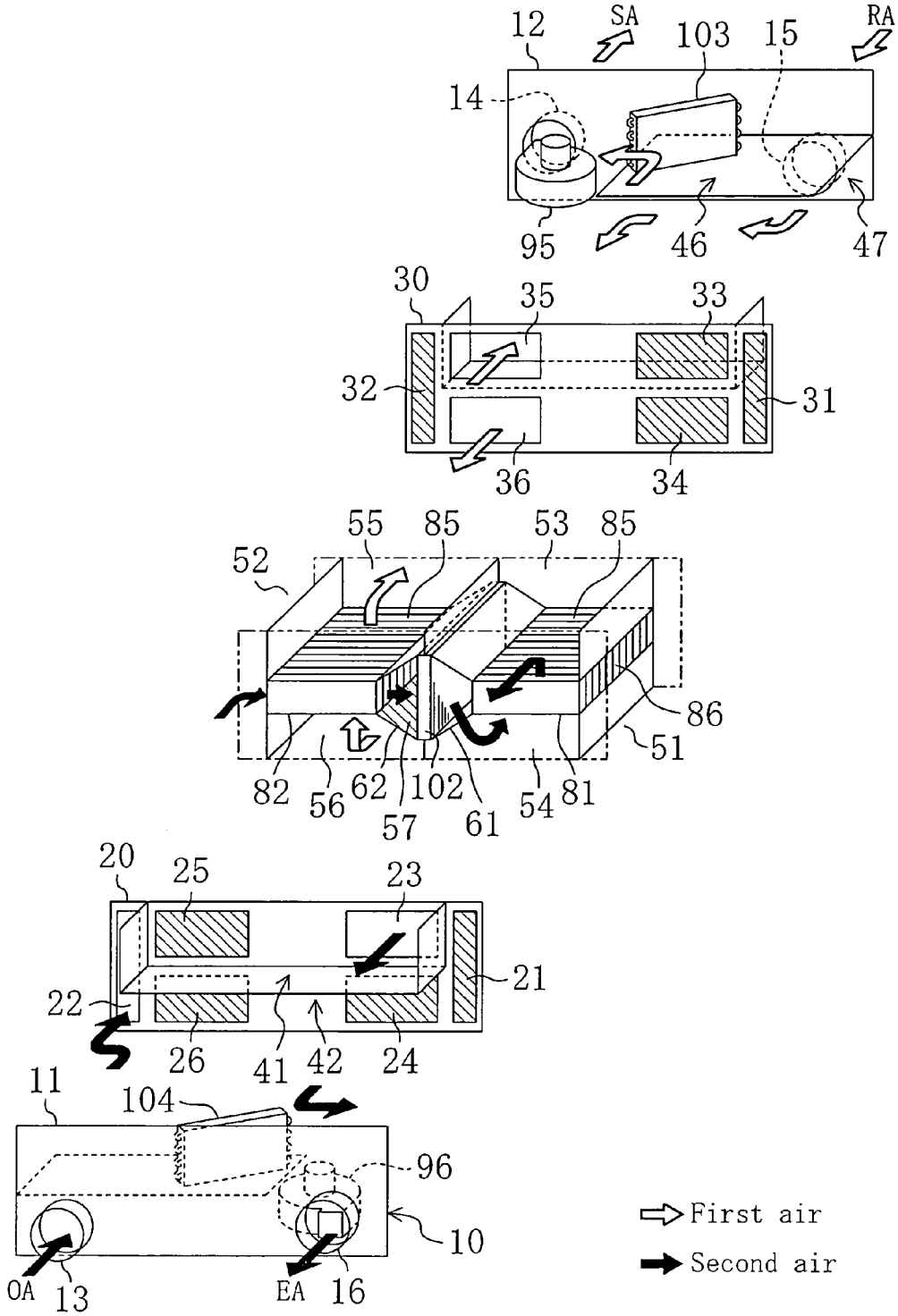
FIG. 21 is an exploded perspective view illustrating the second operation of the dehumidification/circulation mode of the humidity control apparatus according to the first variation of the alternative embodiments.

As illustrated in FIG. 20 and FIG. 21, as the air-supplying fan (95) is operated in the dehumidification/circulation mode, the room air is taken into the casing (10) through the room-side inlet (15). The room air flows into the room-side lower channel (47) as a first air. As the air-discharging fan (96) is operated, the outside air is taken into the casing (10) through the outdoor-side inlet (13). The outside air flows into the outdoor-side lower channel (42) as a second air.

The first operation of the dehumidification/circulation mode will be described with reference to FIG. 5 and FIG. 20. In the first operation, an adsorption operation for the first adsorbing element (81) and a regeneration operation for the second adsorbing element (82) are performed. Thus, in the first operation, the air is dehumidified through the first adsorbing element (81) while regenerating the adsorbent of the second adsorbing element (82).

As illustrated in FIG. 20, in the first partition (20), the first right-side opening (21) and the first upper-left opening (25) are in the communicated state, while the remaining openings (22, 23, 24, 26) are in the blocked state. In this state, the outdoor-side lower channel (42) and the right-side channel (51) are communicated with each other through the first right-side opening (21), and the upper-left channel (55) and the outdoor-side upper channel (41) are communicated with each other through the first upper-left opening (25).

In the second partition (30), the second upper-right opening (33) and the second lower-right opening (34) are in the communicated state, while the remaining openings (31, 32, 35, 36) are in the blocked state. In this state, the upper-right channel (53) and the room-side upper channel (46) are communicated with each other through the second upper-right opening (33), and the room-side lower channel (47) and the lower-right channel (54) are communicated with each other through the second lower-right opening (34).

The right shutter (61) is in the closed state, and the left shutter (62) is in the open state. In this state, a portion of the center channel (57) on the left of the regenerative heat exchanger (102) is communicated with the lower-left channel (56) via the left shutter (62).

The first air taken into the casing (10) flows from the room-side lower channel (47) into the lower-right channel (54) through the second lower-right opening (34). The second air taken into the casing (10) flows from the outdoor-side lower channel (42) into the right-side channel (51) through the first right-side opening (21).

As illustrated also in FIG. 5A, the first air in the lower-right channel (54) flows into the humidity control passageways (85) of the first adsorbing element (81). While the first air flows through the humidity control passageways (85), the water vapor contained therein is adsorbed by the adsorbent. The first air dehumidified through the first adsorbing element (81) flows into the upper-right channel (53).

The second air in the right-side channel (51) flows into the cooling passageways (86) of the first adsorbing element (81). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-left channel (56).

The second air heated through the first adsorbing element (81) and the regenerative heat exchanger (102) is introduced into the humidity control passageways (85) of the second adsorbing element (82). In the humidity control passageways (85), the adsorbent is heated by the second air, whereby water vapor is desorbed from the adsorbent. Thus, the second adsorbing element (82) is regenerated. The water vapor desorbed from the adsorbent flows into the upper-left channel (55) together with the second air.

As illustrated in FIG. 20, the dehumidified first air having flown into the upper-right channel (53) is passed into the room-side upper channel (46) through the second upper-right opening (33). While flowing through the room-side upper channel (46), the first air passes through the first heat exchanger (103), where it is cooled by heat exchange with the refrigerant. Then, the dehumidified and cooled first air is supplied into the room through the room-side outlet (14).

The second air having flown into the upper-left channel (55) flows into the outdoor-side upper channel (41) through the first upper-left opening (25). While flowing through the outdoor-side upper channel (41), the second air passes through the second heat exchanger (104). At this point, the second heat exchanger (104) is inactive, and the second air is neither heated nor cooled. Then, the second air having been used for the cooling of the first adsorbing element (81) and the regeneration of the second adsorbing element (82) is discharged to the outside through the outdoor-side outlet (16).

The second operation of the dehumidification/circulation mode will be described with reference to FIG. 5 and FIG. 21. In the second operation, contrary to the first operation, an adsorption operation for the second adsorbing element (82) and a regeneration operation for the first adsorbing element (81) are performed. Thus, in the second operation, the air is dehumidified through the second adsorbing element (82) while regenerating the adsorbent of the first adsorbing element (81).

As illustrated in FIG. 21, in the first partition (20), the first left-side opening (22) and the first upper-right opening (23) are in the communicated state, while the remaining openings (21, 24, 25, 26) are in the blocked state. In this state, the outdoor-side lower channel (42) and the left-side channel (52) are communicated with each other through the first left-side opening (22), and the upper-right channel (53) and the outdoor-side upper channel (41) are communicated with each other through the first upper-right opening (23).

In the second partition (30), the second upper-left opening (35) and the second lower-left opening (36) are in the communicated state, while the remaining openings (31, 32, 33, 34) are in the blocked state. In this state, the upper-left channel (55) and the room-side upper channel (46) are communicated with each other through the second upper-left opening (35), and the room-side lower channel (47) and the lower-left channel (56) are communicated with each other through the second lower-left opening (36).

The left shutter (62) is in the closed state, and the right shutter (61) is in the open state. In this state, a portion of the center channel (57) on the right of the regenerative heat exchanger (102) is communicated with the lower-right channel (54) via the right shutter (61).

The first air taken into the casing (10) flows from the room-side lower channel (47) into the lower-left channel (56) through the second lower-left opening (36). The second air taken into the casing (10) flows from the outdoor-side lower channel (42) into the left-side channel (52) through the first left-side opening (22).

As illustrated also in FIG. 5B, the first air in the lower-left channel (56) flows into the humidity control passageways (85) of the second adsorbing element (82). While the first air flows through the humidity control passageways (85), the water vapor contained therein is adsorbed by the adsorbent. The first air dehumidified through the second adsorbing element (82) flows into the upper-left channel (55).

The second air in the left-side channel (52) flows into the cooling passageways (86) of the second adsorbing element (82). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-right channel (54).

The first air heated through the second adsorbing element (82) and the regenerative heat exchanger (102) is introduced into the humidity control passageways (85) of the first adsorbing element (81). In the humidity control passageways (85), the adsorbent is heated by the second air, whereby water vapor is desorbed from the adsorbent. Thus, the first adsorbing element (81) is regenerated. The water vapor desorbed from the adsorbent flows into the upper-right channel (53) together with the second air.

As illustrated in FIG. 9, the dehumidified first air having flown into the upper-left channel (55) is passed into the room-side upper channel (46) through the second upper-left opening (35). While flowing through the room-side upper channel (46), the first air passes through the first heat exchanger (103), where it is cooled by heat exchange with the refrigerant. Then, the dehumidified and cooled first air is supplied into the room through the room-side outlet (14).

The second air having flown into the upper-right channel (53) flows into the outdoor-side upper channel (41) through the first upper-right opening (23). While flowing through the outdoor-side upper channel (41), the second air passes through the second heat exchanger (104). At this point, the second heat exchanger (104) is inactive, and the second air is neither heated nor cooled. Then, the first air having been used for the cooling of the second adsorbing element (82) and the regeneration of the first adsorbing element (81) is discharged to the outside through the outdoor-side outlet (16).

Humidification/Circulation Mode

Figure 22:
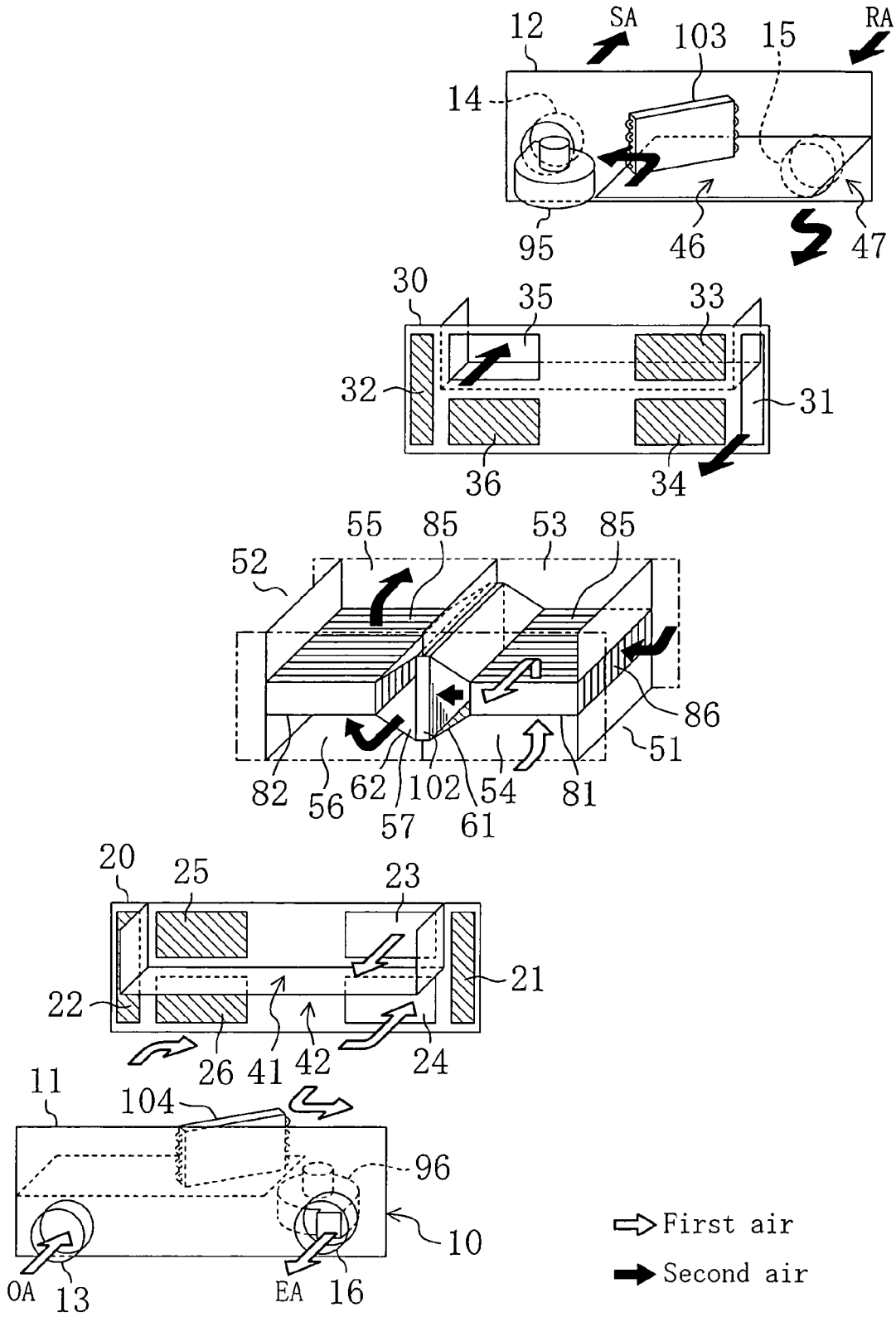
FIG. 22 is an exploded perspective view illustrating the first operation of the humidification/circulation mode of the humidity control apparatus according to the first variation of the alternative embodiments.
Figure 23:
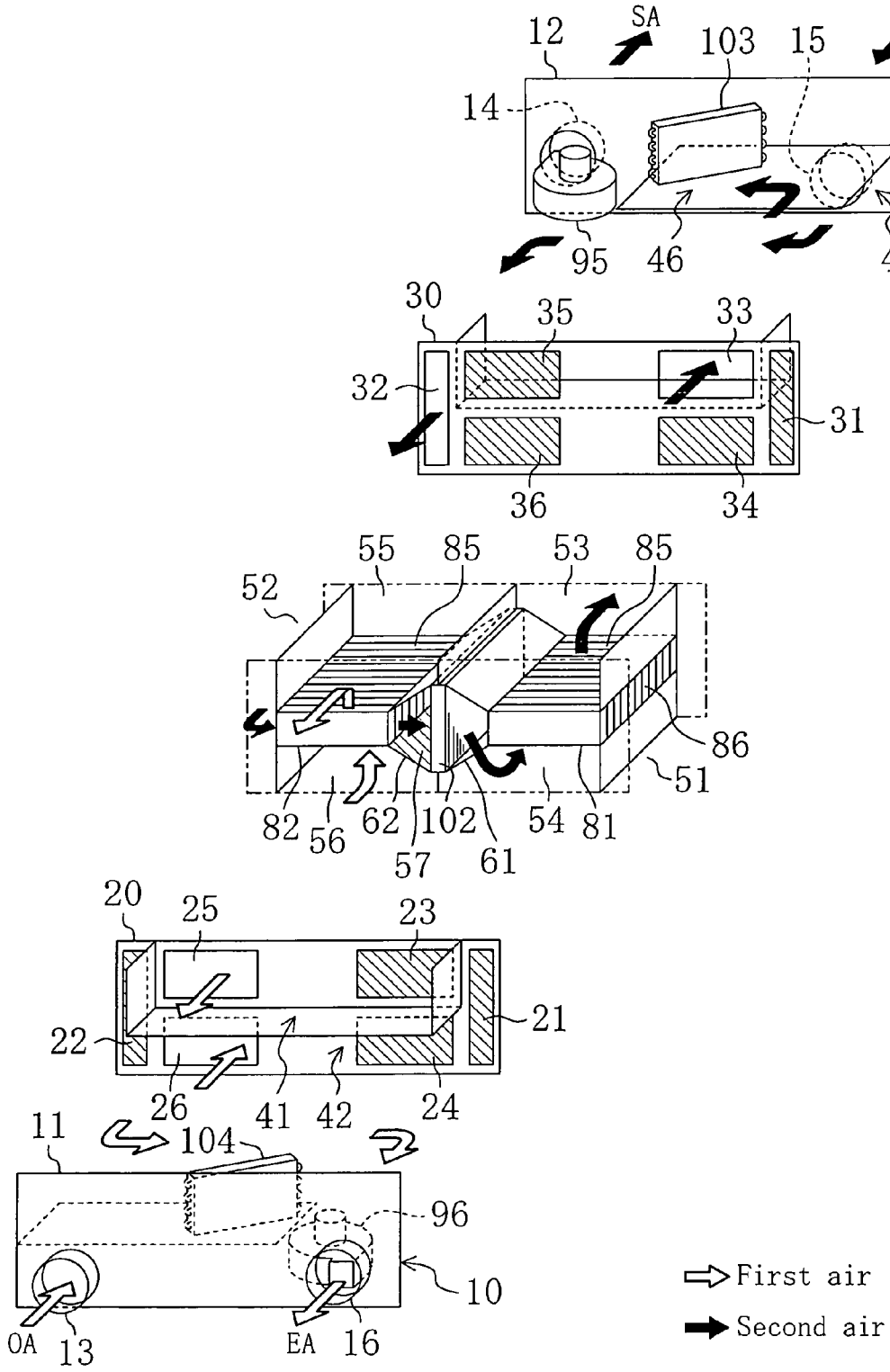
FIG. 23 is an exploded perspective view illustrating the second operation of the humidification/circulation mode of the humidity control apparatus according to the first variation of the alternative embodiments.

As illustrated in FIG. 22 and FIG. 23, as the air-supplying fan (95) is operated in the humidification/circulation mode, the room air is taken into the casing (10) through the room-side inlet (15). The room air flows into the room-side lower channel (47) as a second air. As the air-discharging fan (96) is operated, the outside air is taken into the casing (10) through the outdoor-side inlet (13). The outside air flows into the outdoor-side lower channel (42) as a first air.

The first operation of the humidification/circulation mode will be described with reference to FIG. 5 and FIG. 22. In the first operation, an adsorption operation for the first adsorbing element (81) and a regeneration operation for the second adsorbing element (82) are performed. Thus, in the first operation, the air is humidified through the second adsorbing element (82) while adsorbing water vapor by the adsorbent of the first adsorbing element (81).

As illustrated in FIG. 22, in the first partition (20), the first upper-right opening (23) and the first lower-right opening (24) are in the communicated state, while the remaining openings (21, 22, 25, 26) are in the blocked state. In this state, the upper-right channel (53) and the outdoor-side upper channel (41) are communicated with each other through the first upper-right opening (23), and the outdoor-side lower channel (42) and the lower-right channel (54) are communicated with each other through the first lower-right opening (24).

In the second partition (30), the second right-side opening (31) and the second upper-left opening (35) are in the communicated state, while the remaining openings (32, 33, 34, 36) are in the blocked state. In this state, the room-side lower channel (47) and the right-side channel (51) are communicated with each other through the second right-side opening (31), and the upper-left channel (55) and the room-side upper channel (46) are communicated with each other through the second upper-left opening (35).

The right shutter (61) is in the closed state, and the left shutter (62) is in the open state. In this state, a portion of the center channel (57) on the left of the regenerative heat exchanger (102) is communicated with the lower-left channel (56) via the left shutter (62).

The first air taken into the casing (10) flows from the outdoor-side lower channel (42) into the lower-right channel (54) through the first lower-right opening (24). The second air taken into the casing (10) flows from the room-side lower channel (47) into the right-side channel (51) through the second right-side opening (31).

As illustrated also in FIG. 5A, the first air in the lower-right channel (54) flows into the humidity control passageways (85) of the first adsorbing element (81). While the first air flows through the humidity control passageways (85), the water vapor contained therein is adsorbed by the adsorbent. The first air deprived of its moisture through the first adsorbing element (81) flows into the upper-right channel (53).

The second air in the right-side channel (51) flows into the cooling passageways (86) of the first adsorbing element (81). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-left channel (56).

The second air heated through the first adsorbing element (81) and the regenerative heat exchanger (102) is introduced into the humidity control passageways (85) of the second adsorbing element (82). In the humidity control passageways (85), the adsorbent is heated by the second air, whereby water vapor is desorbed from the adsorbent. Thus, the second adsorbing element (82) is regenerated. The water vapor desorbed from the adsorbent is given to the second air, thereby humidifying the second air. The second air humidified through the second adsorbing element (82) then flows into the upper-left channel (55).

As illustrated in FIG. 22, the second air having flown into the upper-left channel (55) flows into the room-side upper channel (46) through the second upper-left opening (35). While flowing through the room-side upper channel (46), the second air passes through the first heat exchanger (103). At this point, the first heat exchanger (103) is inactive, and the first air is neither heated nor cooled. Then, the humidified second air is supplied into the room through the room-side outlet (14).

The first air having flown into the upper-right channel (53) is passed into the outdoor-side upper channel (41) through the first upper-right opening (23). While flowing through the outdoor-side upper channel (41), the first air passes through the second heat exchanger (104), where it is cooled by heat exchange with the refrigerant. Then, the first air deprived of its moisture and heat is discharged to the outside through the outdoor-side outlet (16).

The second operation of the humidification/circulation mode will be described with reference to FIG. 5 and FIG. 23. In the second operation, contrary to the first operation, an adsorption operation for the second adsorbing element (82) and a regeneration operation for the first adsorbing element (81) are performed. Thus, in the second operation, the air is humidified through the first adsorbing element (81) while adsorbing water vapor by the adsorbent of the second adsorbing element (82).

As illustrated in FIG. 23, in the first partition (20), the first upper-left opening (25) and the first lower-left opening (26) are in the communicated state, while the remaining openings (21, 22, 23, 24) are in the blocked state. In this state, the upper-left channel (55) and the outdoor-side upper channel (41) are communicated with each other through the first upper-left opening (25), and the outdoor-side lower channel (42) and the lower-left channel (56) are communicated with each other through the first lower-left opening (26).

In the second partition (30), the second left-side opening (32) and the second upper-right opening (33) are in the communicated state, while the remaining openings (31, 34, 35, 36) are in the blocked state. In this state, the room-side lower channel (47) and the left-side channel (52) are communicated with each other through the second left-side opening (32), and the upper-right channel (53) and the room-side upper channel (46) are communicated with each other through the second upper-right opening (33).

The left shutter (62) is in the closed state, and the right shutter (61) is in the open state. In this state, a portion of the center channel (57) on the right of the regenerative heat exchanger (102) is communicated with the lower-right channel (54) via the right shutter (61).

The first air taken into the casing (10) flows from the outdoor-side lower channel (42) into the lower-left channel (56) through the first lower-left opening (26). The second air taken into the casing (10) flows from the room-side lower channel (47) into the left-side channel (52) through the second left-side opening (32).

As illustrated also in FIG. 5B, the first air in the lower-left channel (56) flows into the humidity control passageways (85) of the second adsorbing element (82). While the first air flows through the humidity control passageways (85), the water vapor contained therein is adsorbed by the adsorbent. The first air deprived of its moisture through the second adsorbing element (82) flows into the upper-left channel (55).

The second air in the left-side channel (52) flows into the cooling passageways (86) of the second adsorbing element (82). While flowing through the cooling passageways (86), the second air absorbs heat of adsorption, which has been generated when the water vapor is adsorbed by the adsorbent through the humidity control passageways (85). Thus, the second air flows through the cooling passageways (86) as a cooling fluid. The second air having taken the heat of adsorption flows into the center channel (57) to pass through the regenerative heat exchanger (102). Then, in the regenerative heat exchanger (102), the second air is heated by heat exchange with the refrigerant. Then, the second air flows from the center channel (57) into the lower-right channel (54).

The first air heated through the second adsorbing element (82) and the regenerative heat exchanger (102) is introduced into the humidity control passageways (85) of the first adsorbing element (81). In the humidity control passageways (85), the adsorbent is heated by the second air, whereby water vapor is desorbed from the adsorbent. Thus, the first adsorbing element (81) is regenerated. The water vapor desorbed from the adsorbent is given to the second air, thereby humidifying the second air. The second air humidified through the first adsorbing element (81) then flows into the upper-right channel (53).

As illustrated in FIG. 23, the second air having flown into the upper-right channel (53) flows into the room-side upper channel (46) through the second upper-right opening (33). While flowing through the room-side upper channel (46), the second air passes through the first heat exchanger (103). At this point, the first heat exchanger (103) is inactive, and the second air is neither heated nor cooled. Then, the humidified second air is supplied into the room through the room-side outlet (14).

The first air having flown into the upper-left channel (55) is passed into the outdoor-side upper channel (41) through the first upper-left opening (25). While flowing through the outdoor-side upper channel (41), the first air passes through the second heat exchanger (104), where it is cooled by heat exchange with the refrigerant. Then, the first air deprived of its moisture and heat is discharged to the outside through the outdoor-side outlet (16).

Operation of Refrigerant Circuit

Figure 24A:
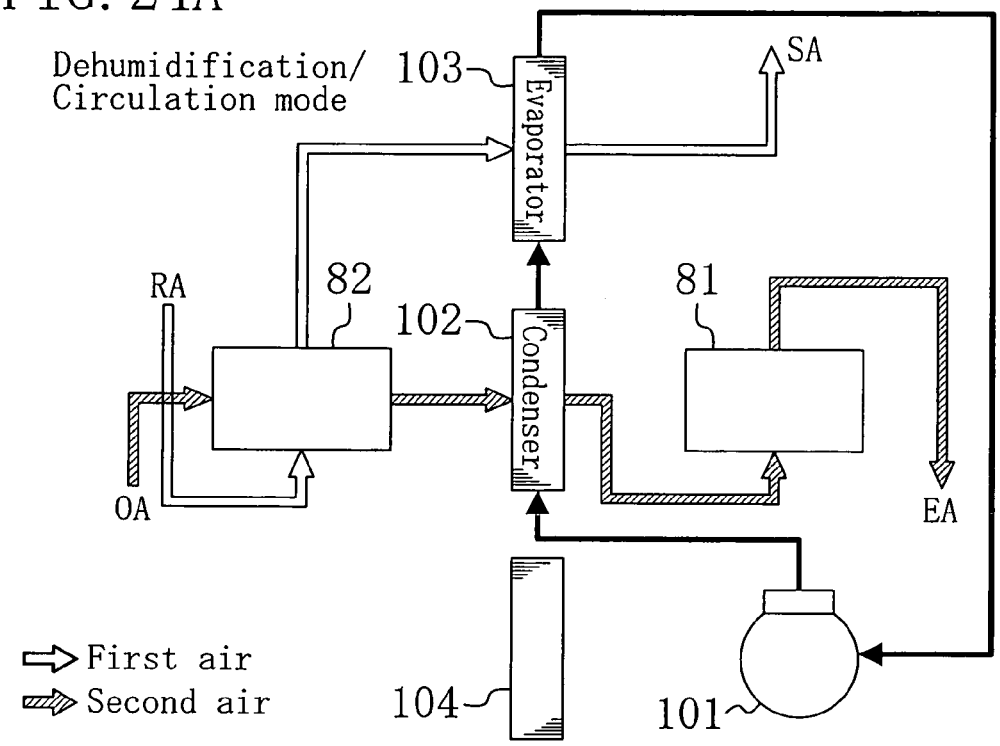
FIGS. 24A and 24B is a conceptual diagram illustrating operating modes of the humidity control apparatus according to the first variation of the alternative embodiments.
Figure 24B:
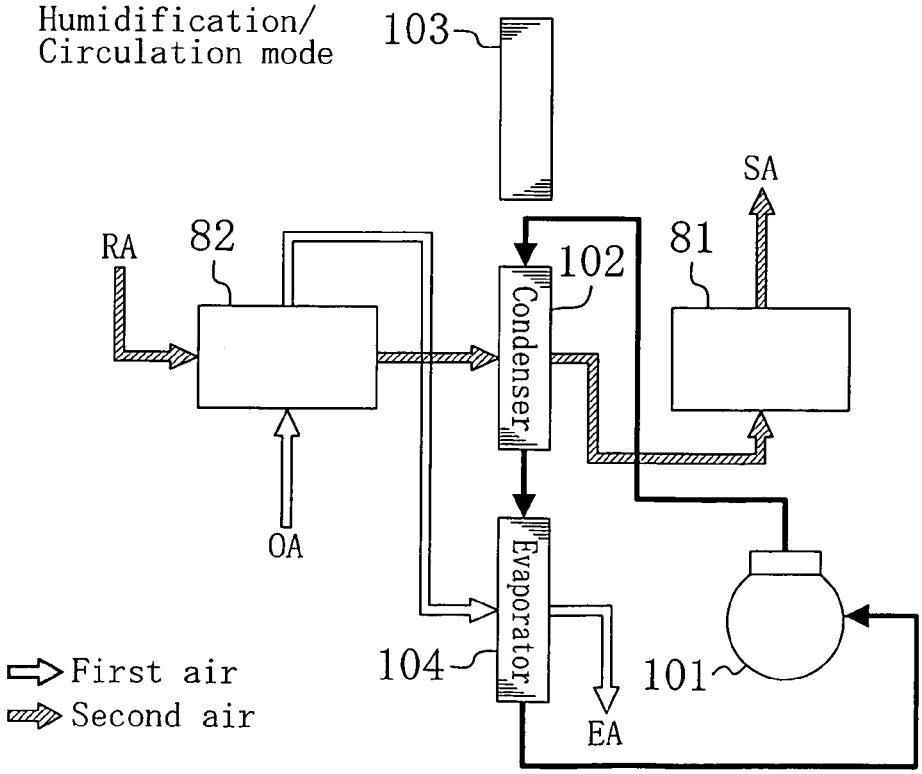
Figure 25:
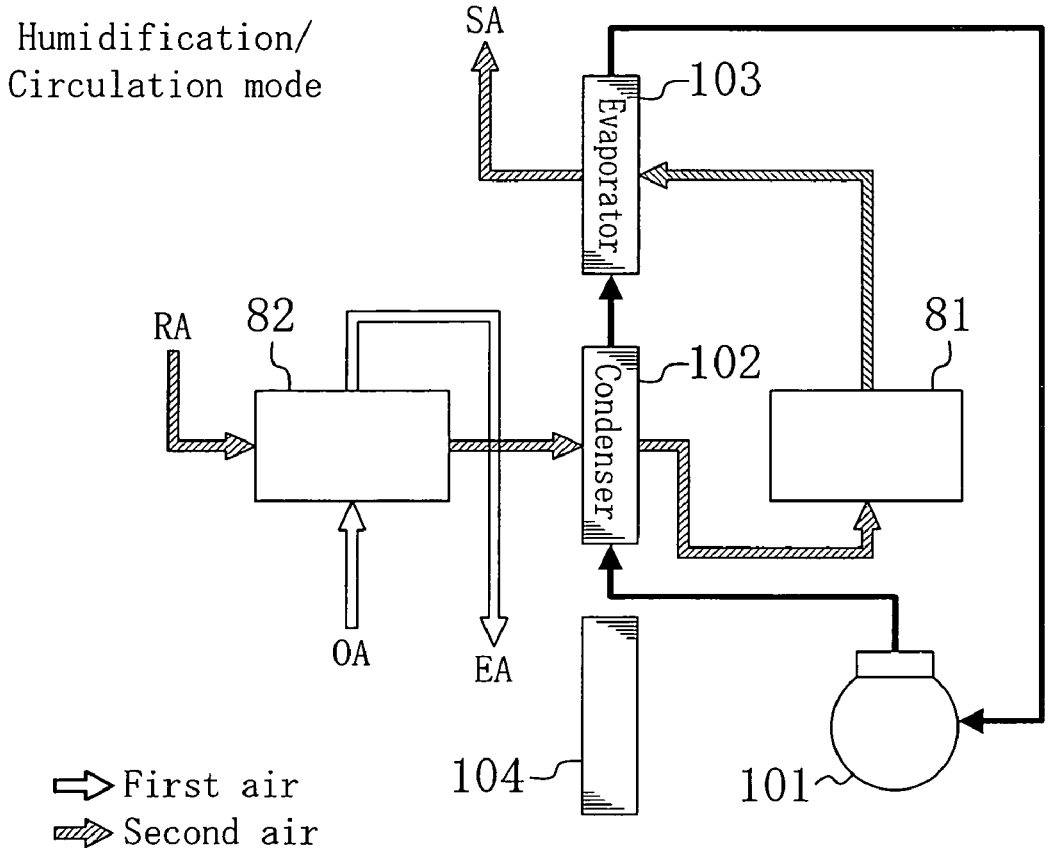
FIG. 25 is a conceptual diagram illustrating an operating mode of the humidity control apparatus according to the first variation of the alternative embodiments.

The operation of the refrigerant circuit (100) will be described with reference to FIG. 24 and FIG. 25. Note that the flow of the first air and the flow of the second air illustrated in FIG. 24 and FIG. 25 are those in the second operation.

The operation of the refrigerant circuit (100) in the dehumidification/circulation mode is similar to the operation in the dehumidification mode of Embodiment 1. Specifically, in the refrigerant circuit (100), the regenerative heat exchanger (102) serves as a condenser and the first heat exchanger (103) as an evaporator, while the second heat exchanger (104) is inactive, as illustrated in FIG. 24A.

In the humidification/circulation mode, the refrigerant circuit (100) can operate in two different operating modes. In the humidification mode, the two operating modes are selectively performed.

The first operating mode of the refrigerant circuit (100) in the humidification mode is similar to the humidification mode of Embodiment 1. Specifically, in the refrigerant circuit (100), the regenerative heat exchanger (102) serves as a condenser and the second heat exchanger (104) as an evaporator, while the first heat exchanger (103) is inactive, as illustrated in FIG. 24B.

The second operating mode of the refrigerant circuit (100) in the humidification mode is similar to the dehumidification mode of Embodiment 1. Specifically, in the refrigerant circuit (100), the regenerative heat exchanger (102) serves as a condenser and the first heat exchanger (103) as an evaporator, while the second heat exchanger (104) is inactive, as illustrated in FIG. 25. The refrigerant is condensed by heat exchange with the second air through the regenerative heat exchanger (102), and the refrigerant is evaporated by heat exchange with the second air through the first heat exchanger (103). In the second operating mode, the second air, which has been humidified and then cooled, can be supplied into the room.

Second Variation

In the humidity control apparatus of any embodiment described above, the regenerative heat exchanger (102) may be placed in a generally horizontal, laid-down position. The difference between the humidity control apparatus of this variation and those of the embodiments above will now be described.

Figure 26:
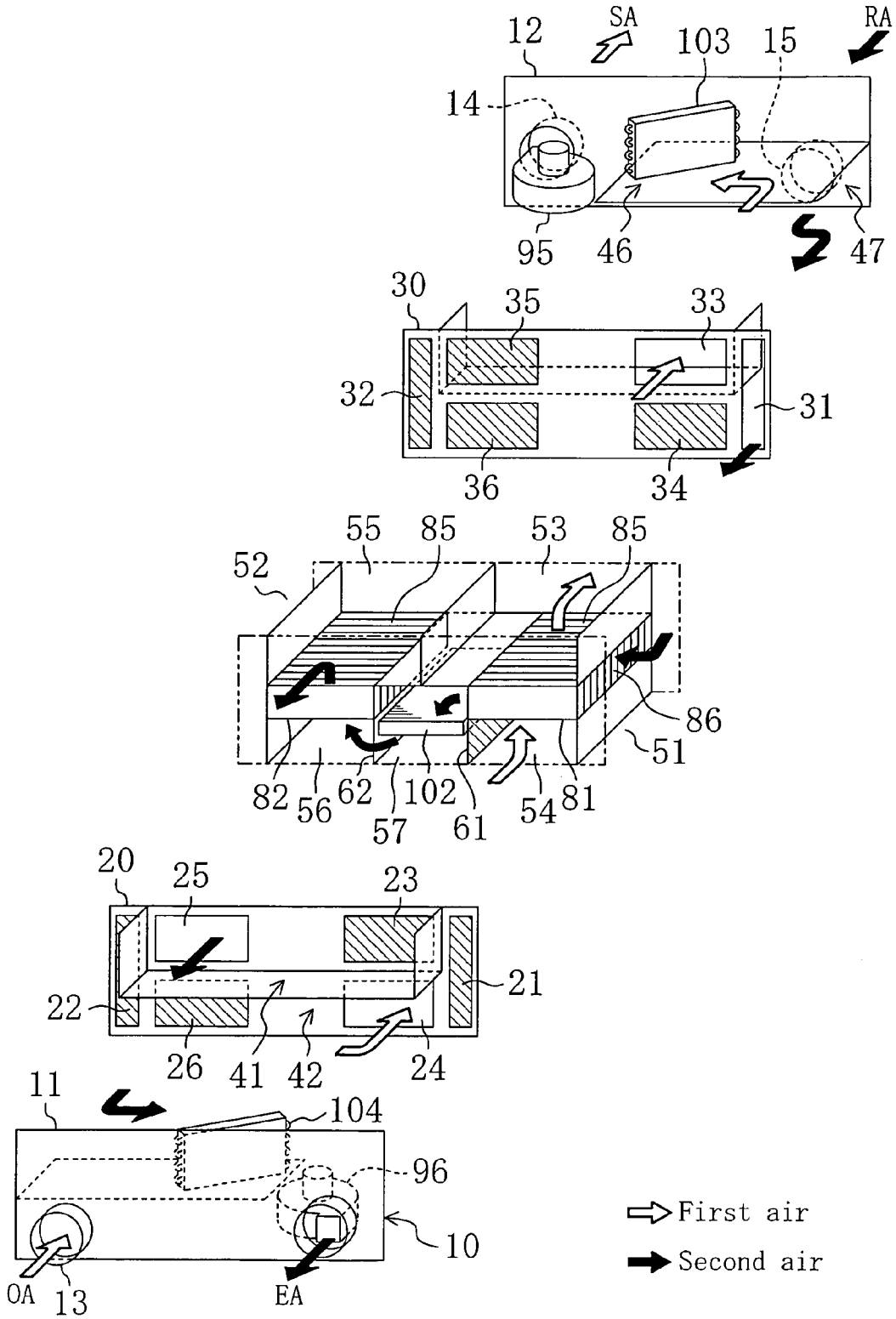
FIG. 26 is an exploded perspective view illustrating the configuration of a humidity control apparatus according to the second variation of the alternative embodiments.

In this humidity control apparatus, the center channel (57) has a rectangular cross section as seen in FIG. 26 and FIG. 27. The regenerative heat exchanger (102) is provided so as to divide the center channel (57) into upper and lower portions. Moreover, the regenerative heat exchanger (102) is positioned so that the upper surface thereof is slightly below the lower surfaces of the first and second adsorbing elements (81, 82).

Moreover, in this humidity control apparatus, the right shutter (61) separates the portion of the center channel (57) below the regenerative heat exchanger (102) from the lower-right channel (54). The left shutter (62) separates the portion of the center channel (57) below the regenerative heat exchanger (102) from the lower-left channel (56).

Figure 27A:
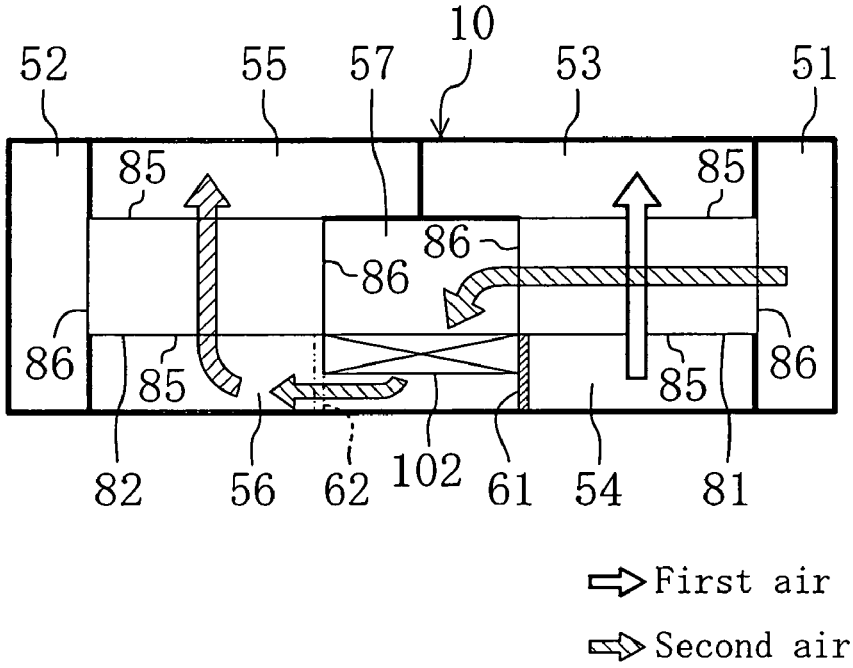
FIGS. 27A and 27B are schematic views illustrating an important part of the humidity control apparatus according to the second variation of the alternative embodiments.
Figure 27B:
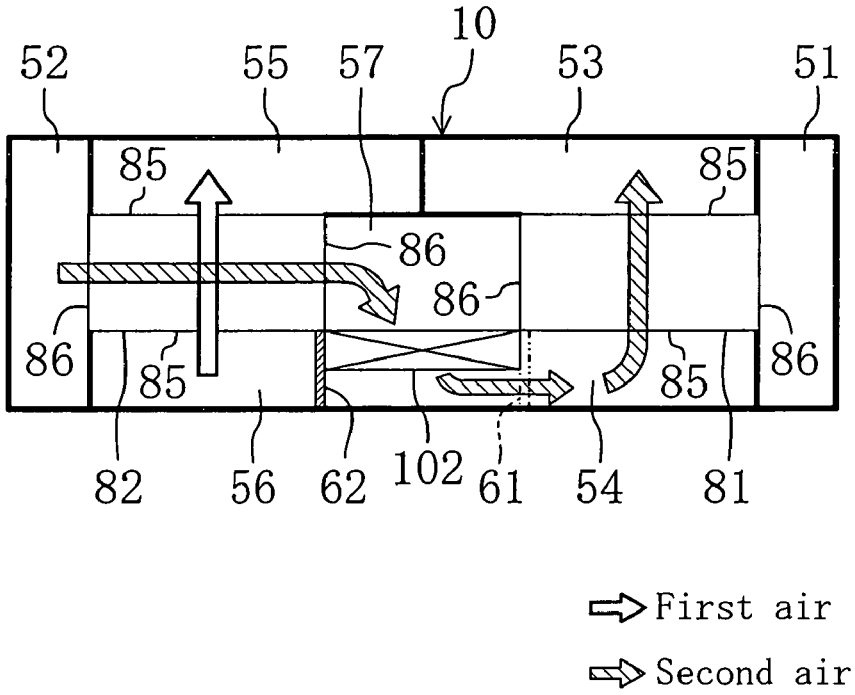

In the dehumidification mode and in the humidification mode, the humidity control apparatus of the present variation operates in a manner similar to the embodiments described above. Note that FIG. 26 shows the first operation of the dehumidification mode. Moreover, FIG. 27A shows the first operation, and FIG. 27B shows the second operation.

With the arrangement of the regenerative heat exchanger (102) of the present variation, there are fewer limitations on the installment of the humidity control apparatus. Specifically, the first and second the adsorbing elements (81, 82) may need to be taken out of the casing (10) in some cases for maintaining the humidity control apparatus. In the humidity control apparatus of the present variation, the regenerative heat exchanger (102) is positioned below the adsorbing elements (81, 82). Therefore, the two adsorbing elements (81, 82) can both be taken out only by opening one of the left and right side surfaces of the casing (10). Thus, this humidity control apparatus can be installed, for example, with one of the left and right side surfaces of the casing (10) being closely positioned to a wall.

Third Variation

While the casing (10) accommodates the entirety of the refrigerant circuit (100) in the embodiments described above, the casing (10) may alternatively accommodate only a portion of the refrigerant circuit (100). For example, there may be a compressor unit accommodating only the compressor (101), separate from the casing (10) of the humidity control apparatus. In such a case, the refrigerant circuit (100) being a closed circuit can be formed by using a connection pipe connecting the compressor (101) in the compressor unit with the regenerative heat exchanger (102), etc., in the casing (10).

Moreover, the refrigerant circuit (100) may include an additional heat exchanger serving as an evaporator by exchanging heat between the refrigerant and an air that is different from the first air or the second air, in addition to the first heat exchanger (103) and the second heat exchanger (104) in the casing (10). Moreover, the additional heat exchanger may be accommodated in the compressor unit together with the compressor (101).

Fourth Variation

While the humidity control apparatus of Embodiment 1 can operate both in the dehumidification mode and in the humidification mode, the humidity control apparatus may alternatively operate only in the humidification mode. The difference between the humidity control apparatus of this variation and that of Embodiment 1 will now be described.

Figure 28:
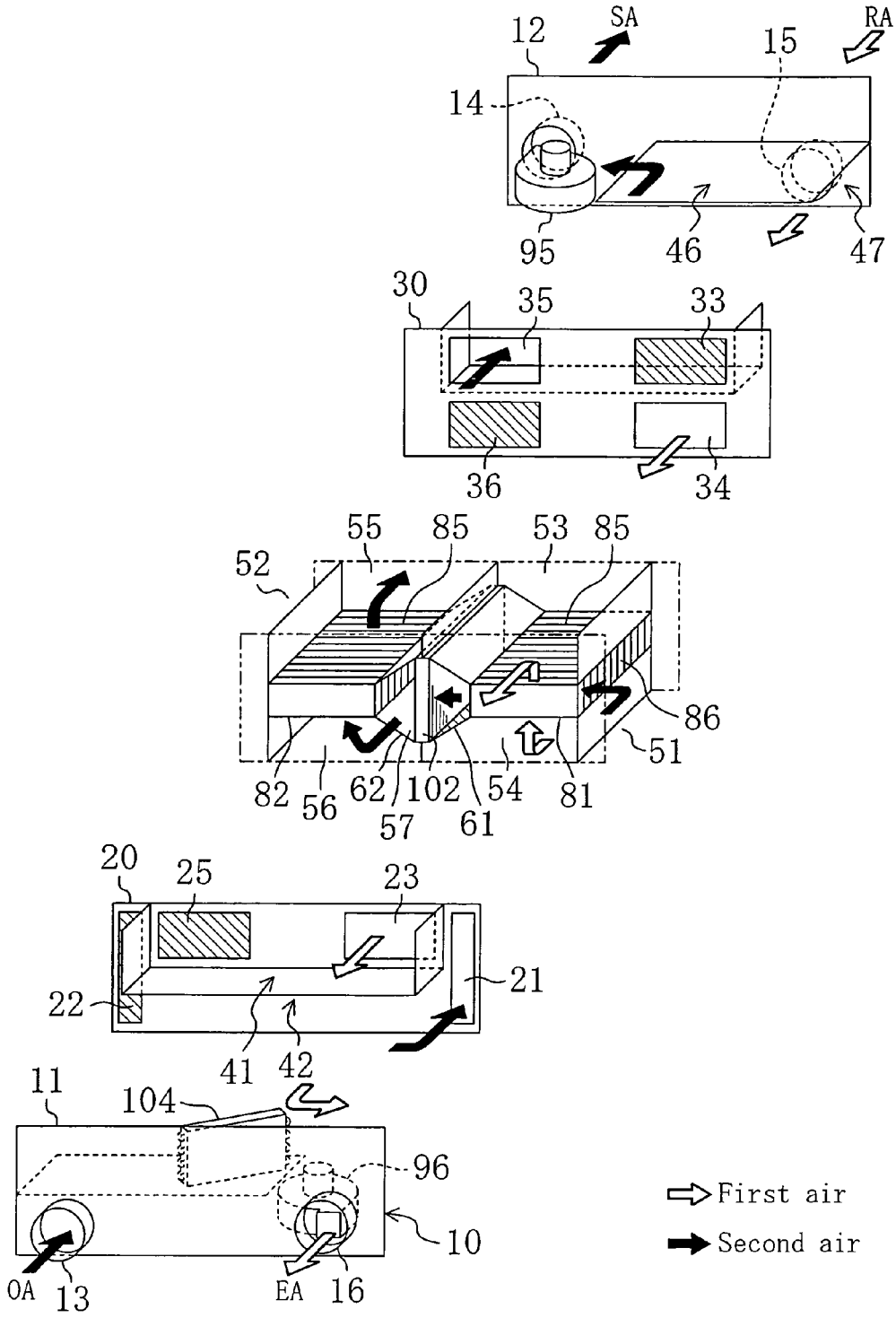
FIG. 28 is an exploded perspective view illustrating the first operation of the humidification mode of a humidity control apparatus according to the fourth variation of the alternative embodiments.
Figure 29:
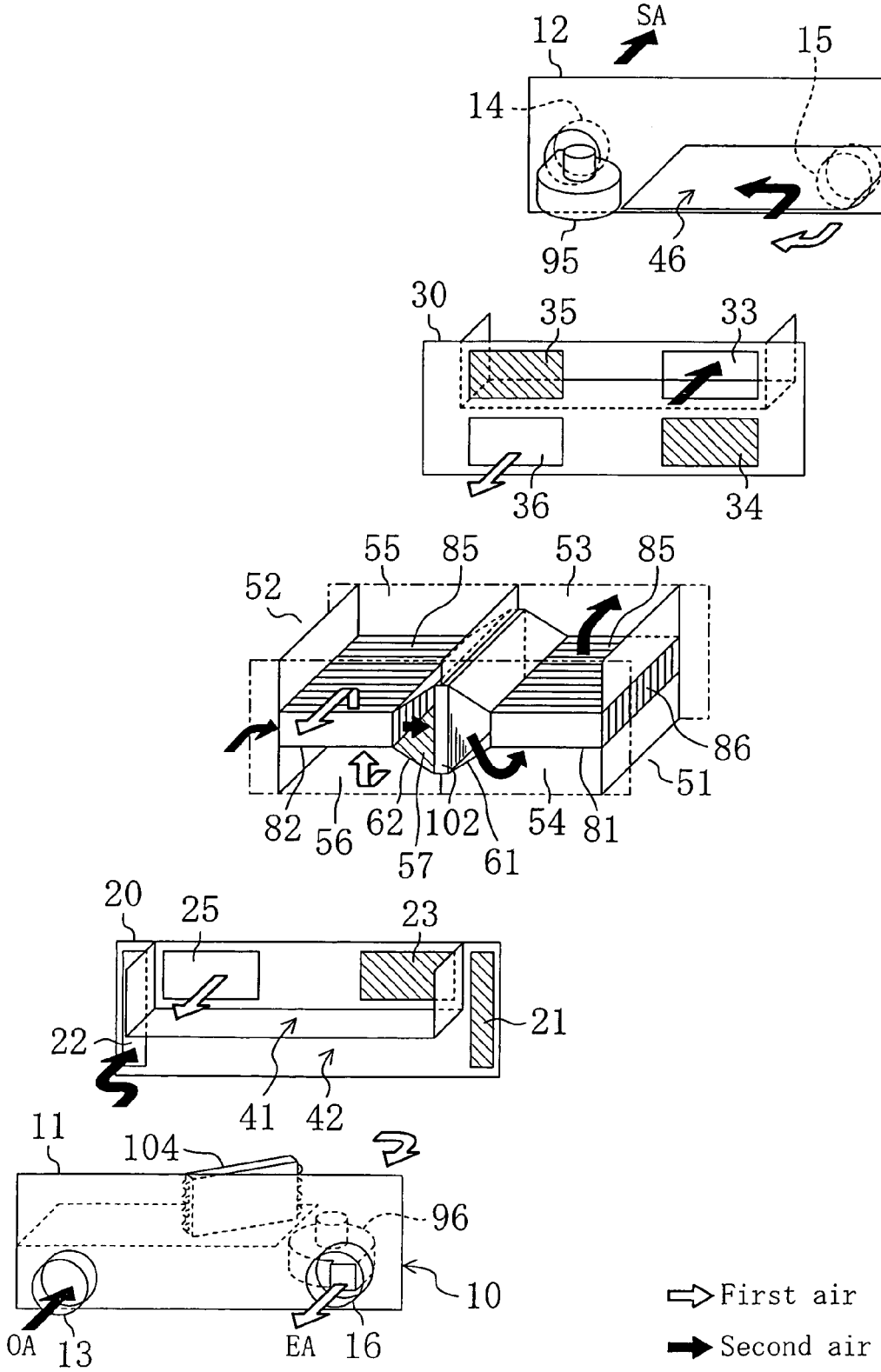
FIG. 29 is an exploded perspective view illustrating the second operation of the humidification mode of the humidity control apparatus according to the fourth variation of the alternative embodiments.

In the first partition (20) of the humidity control apparatus of the present variation, only the first right-side opening (21), the first left-side opening (22), the first upper-right opening (23) and the first upper-left opening (25) are formed, while the first lower-right opening (24) and the first lower-left opening (26) are not formed, as illustrated in FIG. 28 and FIG. 29. Moreover, in the second partition (30), only the second upper-right opening (33), the second lower-right opening (34), the second upper-left opening (35) and the second lower-left opening (36) are formed, while the second right-side opening (31) and the second left-side opening (32) are not formed. Moreover, the heat exchangers provided in the refrigerant circuit (100) are only the regenerative heat exchanger (102) and the second heat exchanger (104), while the first heat exchanger (103) is not provided in the refrigerant circuit (100). The humidity control apparatus of the present variation performs the humidification mode operation by alternately repeating a first operation and a second operation.

INDUSTRIAL APPLICABILITY

As described above, the present invention is useful for making a humidity control apparatus for controlling the humidity of the air.

The invention claimed is:

1. A humidity control apparatus, comprising an adsorbing element including an adsorbent for bringing the adsorbent into contact with an air, and a refrigerant circuit including a refrigerant circulating therethrough to perform a refrigerating cycle, wherein:

the humidity control apparatus performs an adsorption operation of adsorbing moisture in a first air onto the adsorbing element and a regeneration operation of regenerating the adsorbing element with a second air heated by the refrigerant in the refrigerant circuit, and one of the first air and the second air having passed through the adsorbing element is supplied into a room while the other is discharged to an outside; and the refrigerant circuit includes a regenerative heat exchanger for heat exchange between the second air to be supplied to the adsorbing element and the refrigerant, a first heat exchanger for heat exchange between the air to be supplied into the room and the refrigerant, and a second heat exchanger for heat exchange between the air to be discharged to the outside and the refrigerant, and the regenerative heat exchanger serves as a condenser while at least one of the first heat exchanger and the second heat exchanger serves as an evaporator: wherein the refrigerant circuit can perform an operation in which one of the first heat exchanger and the second heat exchanger serves as an evaporator while the other is inactive.

2. The humidity control apparatus of claim 1, wherein the refrigerant circuit can perform an operation in which one of the first heat exchanger and the second heat exchanger serves as an evaporator while the other is inactive, and an operation in which the first heat exchanger and the second heat exchanger both serve as an evaporator.

3. The humidity control apparatus of claim 1, wherein the refrigerant circuit can perform an operation in which one of the first heat exchanger and the second heat exchanger serves as an evaporator while the other is inactive, an operation in which the first heat exchanger and the second heat exchanger both serve as an evaporator, and an operation in which one of the first heat exchanger and the second heat exchanger serves as an evaporator while the other serves as a condenser or a subcooler.

4. The humidity control apparatus of claim 1, wherein the refrigerant circuit can perform an operation in which the first heat exchanger and the second heat exchanger both serve as an evaporator, and an operation in which one of the first heat exchanger and the second heat exchanger serves as an evaporator while the other serves as a condenser or a subcooler.

5. The humidity control apparatus of claim 2, 3 or 4, wherein the humidity control apparatus can perform an operation in which the first heat exchanger of the refrigerant circuit serves as an evaporator when supplying the first air into the room while discharging the second air to the outside, and an operation in which the second heat exchanger of the refrigerant circuit serves as an evaporator when supplying the second air into the room while discharging the first air to the outside.

6. A humidity control apparatus, comprising an adsorbing element including an adsorbent for bringing the adsorbent into contact with an air, and a refrigerant circuit including a refrigerant circulating therethrough to perform a refrigerating cycle, wherein;

the humidity control apparatus performs an adsorption operation of adsorbing moisture in a first air onto the adsorbing element and a regeneration operation of regenerating the adsorbing element with a second air heated by the refrigerant in the refrigerant circuit, and the humidity control apparatus can perform a humidification operation in which the second air, selected from among the first air and the second air having passed through the adsorbing element, is supplied into a room while the first air is discharged to an outside;

the refrigerant circuit includes a regenerative heat exchanger for heat exchange between the second air to be supplied to the adsorbing element and the refrigerant, thus serving as a condenser, and an discharge-side heat exchanger for heat exchange between the air to be discharged to the outside with the refrigerant, thus serving as an evaporator in the humidification mode; wherein the humidity control apparatus can perform a dehumidification operation in which the first air, selected from among the first air and the second air having passed through the adsorbing element, is supplied into the room while the second air is discharged to the outside;

the refrigerant circuit includes a first heat exchanger for heat exchange between the air to be supplied into the room and the refrigerant, thus serving as an evaporator in the dehumidification mode; and the discharge-side heat exchanger of the refrigerant circuit forms a second heat exchanger; and wherein the refrigerant circuit can perform an operation in which one of the first heat exchanger and the second heat exchanger serves as an evaporator while the other is inactive.

7. The humidity control apparatus of claim 6, wherein the refrigerant circuit can perform an operation in which one of the first heat exchanger and the second heat exchanger serves as an evaporator while the other is inactive, and an operation in which the first heat exchanger and the second heat exchanger both serve as an evaporator.

8. The humidity control apparatus of claim 6, wherein the refrigerant circuit can perform an operation in which one of the first heat exchanger and the second heat exchanger serves as an evaporator while the other is inactive, an operation in which the first heat exchanger and the second heat exchanger both serve as an evaporator, and an operation in which one of the first heat exchanger and the second heat exchanger serves as an evaporator while the other serves as a condenser or a subcooler.

9. The humidity control apparatus of claim 6, wherein the refrigerant circuit can perform an operation in which the first heat exchanger and the second heat exchanger both serve as an evaporator, and an operation in which one of the first heat exchanger and the second heat exchanger serves as an evaporator while the other serves as a condenser or a subcooler.

10. The humidity control apparatus of claim 2, 3 or 4, wherein the humidity control apparatus can perform an operation in which the first heat exchanger and the second heat exchanger of the refrigerant circuit each serve as an evaporator when supplying the first air into the room while discharging the second air to the outside.

11. The humidity control apparatus of claim 7, 8 or 9, wherein the humidity control apparatus can perform an operation in which the first heat exchanger and the second heat exchanger of the refrigerant circuit each serve as an evaporator when supplying the first air into the room while discharging the second air to the outside.

12. The humidity control apparatus of claim 2, 3 or 4, wherein the humidity control apparatus can perform an operation in which the first heat exchanger and the second heat exchanger of the refrigerant circuit each serve as an evaporator when supplying the second air into the room while discharging the first air to the outside.

13. The humidity control apparatus of claim 7, 8 or 9, wherein the humidity control apparatus can perform an operation in which the first heat exchanger and the second heat exchanger of the refrigerant circuit each serve as an evaporator when supplying the second air into the room while discharging the first air to the outside.

14. The humidity control apparatus of claim 3 or 4, wherein the humidity control apparatus can perform an operation in which the first heat exchanger of the refrigerant circuit serves as an evaporator while the second heat exchanger serves as a condenser or a subcooler when supplying the first air into the room while discharging the second air to the outside.

15. The humidity control apparatus of claim 8 or 9, wherein the humidity control apparatus can perform an operation in which the first heat exchanger of the refrigerant circuit serves as an evaporator while the second heat exchanger serves as a condenser or a subcooler when supplying the first air into the room while discharging the second air to the outside.

16. The humidity control apparatus of claim 3 or 4, wherein the humidity control apparatus can perform an operation in which the first heat exchanger of the refrigerant circuit serves as a condenser or a subcooler while the second heat exchanger serves as an evaporator when supplying the second air into the room while discharging the first air to the outside.

17. The humidity control apparatus of claim 8 or 9, wherein the humidity control apparatus can perform an operation in which the first heat exchanger of the refrigerant circuit serves as a condenser or a subcooler while the second heat exchanger serves as an evaporator when supplying the second air into the room while discharging the first air to the outside.

18. The humidity control apparatus of claim 2, 3 or 4, wherein in an operating mode in which the first heat exchanger and the second heat exchanger both serve as an evaporator, the refrigerant circuit can perform an operation in which the first heat exchanger and the second heat exchanger are connected in series with each other while heat is exchanged between the refrigerant and an air by using only a portion of one of the first heat exchanger and the second heat exchanger that is located downstream of the other.

19. The humidity control apparatus of claim 7, 8 or 9, wherein in an operating mode in which the first heat exchanger and the second heat exchanger both serve as an evaporator, the refrigerant circuit can perform an operation in which the first heat exchanger and the second heat exchanger are connected in series with each other while heat is exchanged between the refrigerant and an air by using only a portion of one of the first heat exchanger and the second heat exchanger that is located downstream of the other.

20. The humidity control apparatus of claim 2, 3 or 4, wherein in an operating mode in which the first heat exchanger and the second heat exchanger both serve as an evaporator, the refrigerant circuit can perform an operation in which the first heat exchanger and the second heat exchanger are connected in series with each other while only a portion of the refrigerant from one of the first heat exchanger and the second heat exchanger that is located upstream of the other is supplied to one of the heat exchangers that is located downstream of the other.

21. The humidity control apparatus of claim 7, 8 or 9, wherein in an operating mode in which the first heat exchanger and the second heat exchanger both serve as an evaporator, the refrigerant circuit can perform an operation in which the first heat exchanger and the second heat exchanger are connected in series with each other while only a portion of the refrigerant from one of the first heat exchanger and the second heat exchanger that is located upstream of the other is supplied to one of the heat exchangers that is located downstream of the other.

22. The humidity control apparatus of claim 1, wherein the humidity control apparatus can perform an operation in which an outside air is taken in as the second air and passed to the regenerative heat exchanger while a room air is taken in as the first air and passed to the adsorbing element when supplying the second air into the room while discharging the first air to the outside.

23. The humidity control apparatus of claim 6, wherein the humidity control apparatus can perform an operation in which an outside air is taken in as the second air and passed to the regenerative heat exchanger while a room air is taken in as the first air and passed to the adsorbing element when supplying the second air into the room while discharging the first air to the outside.

24. The humidity control apparatus of claim 1, wherein the humidity control apparatus can perform an operation in which an outside air is taken in as the first air and passed to the adsorbing element while a room air is taken in as the second air and passed to the regenerative heat exchanger when supplying the first air into the room while discharging the second air to the outside.

25. The humidity control apparatus of claim 6, wherein the humidity control apparatus can perform an operation in which an outside air is taken in as the first air and passed to the adsorbing element while a room air is taken in as the second air and passed to the regenerative heat exchanger when supplying the first air into the room while discharging the second air to the outside.

* * * * *